US006354398B1

(12) United States Patent
Angelo et al.

(10) Patent No.: US 6,354,398 B1
(45) **Date of Patent: *Mar. 12, 2002**

(54) MUFFLERS FOR USE WITH ENGINE RETARDERS; AND METHODS

(75) Inventors: Theodore G. Angelo, St. Paul; John Hamrin, Bloomington, both of MN (US); Eivind Stenersen, River Falls, WI (US); John Hiemstra, Lakeville, MN (US); Wayne M. Wagner, Apple Valley, MN (US); Ted J. Wiegandt, Bloomington, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/571,342

(22) Filed: May 16, 2000

Related U.S. Application Data

(63) Continuation of application No. 09/246,508, filed on Feb. 8, 1999, now Pat. No. 6,082,487, which is a continuation-in-part of application No. 09/023,625, filed on Feb. 13, 1998, now abandoned.

(51) Int. Cl.[7] ..... F01N 1/24
(52) U.S. Cl. ..... 181/256; 181/272
(58) Field of Search ..... 181/225, 256, 181/258, 252, 264, 269, 272, 282

(56) References Cited

U.S. PATENT DOCUMENTS

| | | | |
|---|---|---|---|
| 1,857,845 | A | 5/1932 | Hamilton |
| 2,039,800 | A | 5/1936 | Jack |
| 2,046,193 | A | 6/1936 | Spicer |
| 2,101,460 | A | 12/1937 | Schmidt |
| 2,164,365 | A | 7/1939 | Wilson |
| 2,166,417 | A | 7/1939 | Manning |

(List continued on next page.)

FOREIGN PATENT DOCUMENTS

| | | |
|---|---|---|
| DE | 1 268 434 | 5/1968 |
| DE | 23 60 044 | 6/1975 |
| EP | 0 475 398 A1 | 3/1992 |
| JP | 05202746 | 8/1993 |

OTHER PUBLICATIONS

Jakes® Brake Brouchure, Detroit Diesel, Engine Retarders From Jacobs®, 4 pages (Copyright 1995).
Reinhart, T. et al., "Reducing Compression Brake Noise, "Cummins Engine Company, *Society of Automotive Engineers, Inc.*, pp. 1–8 (copyright 1997).
Reinhart, t. et al., "A Proposed Compression Brake Noise Test Procedure, " Cummins Engine Company, 8 pgs. (1997).
Reinhart, T. et al., "Characteristics of Compression Brake Noise," Cummins Engine Company, 8 pgs. (1997).
SAE Recommended Practice, Measurement Procedure for Determination of Silencer Effectiveness in Reducing Engine Intake or Exhaust Sound Level, *SAE, The Engineering Society of Advantage Mobility Land Sear Air and Space*, 10 pgs. (Feb. 1987).
Wahl, T. et al., "Developing a Test Procedure for Compression Brake Noise," Cummins Engine Company, *Society of Automotive Engineers, Inc.*, pp. 1315–1325 (Copyright 1997).

*Primary Examiner*—Khanh Dang
(74) *Attorney, Agent, or Firm*—Merchant & Gould P.C.

(57) ABSTRACT

A muffler is described for muffling both positive power and compression brake type engine retarders. The muffler includes an outer shell defining an internal volume. A first, inner, perforated wall is spaced from the outer shell and defines a first, annular, volume therebetween. A first volume of packing material is positioned within the annular volume. An inlet tube is oriented within the internal volume. In certain embodiments, the inner perforated wall circumscribes at least a portion of the inlet tube, and extends a distance of at least 25% of the axial length of the outer wall. Both single and dual muffler systems are described. Methods of use and operation are also provided.

10 Claims, 13 Drawing Sheets

U.S. PATENT DOCUMENTS 2,745,509 A 5/1956 Argentieri
2,798,569 A 7/1957 Fischer, Jr.
2,805,730 A 9/1957 Applegate
2,809,709 A 10/1957 Billey
2,824,619 A 2/1958 Bremer et al.
2,853,148 A 9/1958 Billey
2,937,707 A 5/1960 Ernst
2,940,538 A 6/1960 Billey
3,209,861 A 10/1965 Whitney
3,468,397 A 9/1969 Vegeby
3,590,945 A 7/1971 Murphy
3,630,030 A 12/1971 Wagner
3,642,093 A 2/1972 Schach
3,672,464 A 6/1972 Rowley et al.
3,776,364 A 12/1973 Van Doeren
3,786,897 A 1/1974 Swanson
3,811,531 A 5/1974 Forssman
3,889,776 A 6/1975 Postma
3,957,132 A 5/1976 Swanson
4,023,645 A 5/1977 Retka et al.
4,109,752 A 8/1978 Ferralli
4,113,289 A 9/1978 Wagner et al.
4,116,303 A 9/1978 Trudell
4,126,205 A 11/1978 Bauerschmidt
4,263,981 A 4/1981 Weiss et al.
4,267,899 A 5/1981 Wagner et al.
4,270,689 A 6/1981 Canfield
4,282,950 A 8/1981 Fuchs
4,314,621 A 2/1982 Hansen
4,359,135 A 11/1982 Wagner et al.
4,361,423 A 11/1982 Nitz
4,458,779 A 7/1984 Johansson et al.
4,487,289 A 12/1984 Kicinski et al.
4,541,240 A 9/1985 Munro
4,580,657 A 4/1986 Schmeichel et al.
4,598,790 A 7/1986 Uesugi et al.
4,632,216 A 12/1986 Wagner et al.
4,676,111 A 6/1987 Wagner et al.
4,693,338 A 9/1987 Clerc
4,700,805 A 10/1987 Tanaka et al.
4,700,806 A 10/1987 Harwood
4,712,644 A 12/1987 Sun
4,736,817 A 4/1988 Harwood
4,785,909 A 11/1988 Young
4,834,214 A 5/1989 Feuling
4,842,096 A 6/1989 Fujitsubo
4,846,302 A 7/1989 Hetherington
4,969,537 A 11/1990 Wagner et al.
5,025,890 A 6/1991 Hisashige et al.
5,092,122 A 3/1992 Bainbridge
5,123,501 A 6/1992 Rothman et al.
5,200,582 A 4/1993 Kraai, Jr. et al.
5,266,755 A 11/1993 Chien
5,280,143 A 1/1994 Kakuta
5,355,973 A 10/1994 Wagner et al.
5,365,025 A 11/1994 Kraai et al.
5,371,331 A 12/1994 Wall
5,426,269 A 6/1995 Wagner et al.
5,475,976 A 12/1995 Philips
5,633,482 A 5/1997 Erion et al.
5,655,367 A 8/1997 Peube et al.
5,670,757 A 9/1997 Harris
5,705,777 A 1/1998 Flanigan et al.
5,731,557 A 3/1998 Norres et al.
5,783,780 A 7/1998 Watanabe et al.
5,810,566 A 9/1998 Pauwels
5,821,473 A 10/1998 Takahashi

MUFFLERS FOR USE WITH ENGINE RETARDERS; AND METHODS

CROSS REFERENCE TO RELATED APPLICATIONS

This application is a continuation of application Ser. No. 09/246,508, now U.S. Pat. No. 6,082,487, filed Feb. 8, 1999. Application Ser. No. 09/246,508 is a continuation-in-part of application Ser. No. 09/023,625, now abandoned, filed Feb. 13, 1998 now abandoned. Applications Ser. Nos. 09/246,508 and 09/023,625 are incorporated herein by reference.

FIELD OF THE INVENTION

The present invention relates to mufflers. The invention particularly concerns methods and arrangements for mufflers which, in addition to normal attenuation duties, are responsible for muffling the types of noise associated with engine retarders, especially engine retarders of the type sometimes referred to as engine compression brake-type systems.

BACKGROUND OF THE INVENTION

Diesel engine retarders, of the type sometimes called engine compression brakes, are used to slow down vehicles such as trucks, either without the application of the truck's normal wheel brakes or to enhance braking when used in cooperation with wheel brakes. In trucks which have such engine retarders, operation is generally as follows. First, fuel flow to the engine is shut off so as to stop the combustion process and subsequent power generation. Next, a device in the engine valve train opens the exhaust valve a slight amount at the end (top) of the usual compression stroke. As a result, the engine is turned into a very inefficient pump. The energy input to this pump, i.e. to the engine, comes from the inertia of the moving truck through the power train (transmission, axles, wheels, etc.). This pumping process (pump work) significantly slows the moving truck.

A typical compression-type brake can be understood by comparing it with a four-cycle engine that does not have a compression-type brake system. (It is noted, however, that most compression brake-type systems are useful on both two and four-cycle diesel engines.) Without a compression-type brake, on stroke 1, called the induction stroke, the piston moves down and an inlet valve opens. This draws air into the cylinder. If there is a turbo charger, the air is forced into the cylinder by boost pressure from the turbo charger. On stroke 2, called the compression stroke, the inlet valve closes and the piston moves up. The fuel mixture is thus compressed. The energy required to compress this air is produced by the driving wheels of the vehicle. On stroke 3, called the power stroke, fuel is injected into the cylinder, in turn igniting due to compression, forcing the piston back down the cylinder. As the piston is forced back down the cylinder, the energy is returned to the driving wheels. On stroke 4, called the exhaust stroke, the exhaust valve opens and the piston rises, pushing the exhaust gases out of the cylinder.

With a compression-type brake system, the typical four-cycle engine is modified from that described above. With a compression-type brake activated, on the compression stroke the inlet valve opens, and air is drawn or forced into the cylinder from the intake manifold. This is no different from the typical induction stroke. On the compression stroke, air is compressed to approximately 500 psi or higher by the engine piston. The energy required to compress the air is produced by the inertia of the truck's driving wheels.

During the compression stroke, near top dead center, the compression-type brake opens the exhaust valves, venting the high pressure air and dissipating the stored energy through the exhaust system. In the power stroke, essentially no energy is returned to the piston, and thus, essentially no energy is returned to the driving wheels. There is a loss of energy. This loss is the engine retarding work done. During the exhaust stroke, the outlet valve opens and the piston rises, pushing the exhaust gases out of the cylinder. The exhaust stroke, during operation of a compression-type brake is no different than the exhaust stroke of a normal diesel engine.

Typically, trucks with engine retarders are provided with an overall on/off control switch in the truck cab. That is, the engine retarder is left "on" or "off" by the driver; and, when the retarder is "on" it will automatically engage when the driver takes pressure off the accelerator pedal or when pressure is applied to the wheel brakes, depending upon the system. Application of a compression brake-type engine retarder can produce as much or more power to stop the vehicle, than the engine can produce during normal operation. This is considered beneficial by truck operators in many instances, since it significantly reduces brake wear while still serving as an effective brake.

A major manufacturer of such engine retarders in the United States is Jacobs Vehicle Systems of Bloomfield, Conn. The systems manufactured by, or under the direction of, Jacobs Vehicle Systems, are generally available under the trademark "Jake Brake". At the present time, Jake Brake® Systems, or similar engine retarders, are found on many trucks, either installed by the manufacturer (for example, Freightliner, Peterbilt, Mack), or installed afterwards, by choice of the truck owner.

The use of such compression brake engine retarders, although considered highly effective for braking and safety, is associated with undesirable noise. In particular, compression brake operation is associated with a very distinctive, high amplitude, staccato noise or engine "bark". This noise is of a nature that cannot be adequately muffled, by conventional truck muffler systems. The noise is often so objectionable that in many municipalities, especially in hilly areas, signs are posted prohibiting the use of compression brake-type engine retarders.

SUMMARY OF THE DISCLOSURE OF SER. NO. 09/023,625

In certain applications, this disclosure is directed to muffler arrangements effective for muffling engine compression brake-type systems. Certain muffler arrangements, in accordance with this aspect of the disclosure, include an outer wall, usually cylindrical, defining an internal volume, and an inlet and outlet tube oriented within the internal volume of the outer wall. In typical arrangements, the outlet tube defines a sonic choke. An inner, perforated wall is spaced from the outer wall, to define an annular volume therebetween. The annular volume may include a packing, or padding, of absorptive material within the annular volume. The packing material within the annular volume provides an absorptive function, and helps reduce drumming of the outer wall or shell.

In certain arrangements, the inner perforated wall and annular volume is in alignment with the inlet region of the muffler. That is, the first, inner perforated wall may circumscribe at least a portion of the inlet tube.

In one preferred arrangement, at least one second volume of packing material is positioned against and around a section of the outlet tube construction. Preferably, the second volume of packing material is positioned spaced from the outer wall or shell.

In one embodiment, a third volume of packing material is positioned against and around a section of the inlet tube. Preferably, the third volume of packing material is positioned spaced from the outer wall or shell. Preferably, the first volume of packing material in the first annular volume circumscribes both the inlet tube construction and outlet tube construction, with the packing materials positioned thereagainst. Other embodiments include more volumes of packing material positioned against the outlet tube.

Muffler constructions in accordance with the principles characterized herein have been found to perform desirable muffling functions at high frequency octave band values; that is, octave bands in a frequency range in which prior art muffler constructions have not adequately muffled. Certain applications described herein include trucks with high horsepower engines and equipped with engine compression brake-type engine retarders and exhaust mufflers which muffle objectionable noises emitted from the truck during operation of the compression brake-type engine retarder.

In certain applications, this disclosure is directed to a method for muffling exhaust noise from a truck during operation of a compression-type brake using a muffler. The truck typically has an engine rated for operation, typically at some rpm between 1,800 rpm and 2,100 rpm, inclusive, for a power of at least 500 hp. The preferred muffler is cylindrical with an outside diameter of no greater than about 11 inches and an overall length of no greater than 60 inches. The method includes a step of muffling noise, during operation of the compression brake-type engine retarder to an overall sound pressure level of no greater than 68 dba. Muffler constructions of the type described herein may be used to accomplish this method.

SUMMARY OF THE PRESENT DISCLOSURE

Muffler arrangements are described that are effective for muffling engine compression brake-type systems. Certain muffler arrangements described herein achieve enhanced performance at low frequencies, such as 125 Hz and 63 Hz.

In one arrangement, there is an outer shell wall, an inner perforated wall, a region of packing material positioned between the perforated wall and the outer wall, a second inner wall spaced from a perforated section of an outlet tube, and a second region of packing material positioned between the second inner wall and the perforated section of the outlet tube.

Another muffler construction includes a first region of packing material positioned between an outermost wall and an inner perforated wall, and a second region of packing material positioned around a perforated section of a tubular extension of an outflow tube. The outflow tube may include both the tubular extension and an outlet tube section, wherein the outlet tube section circumscribes the tubular extension.

In certain preferred arrangements, the outlet tube includes a perforated section that is spaced from an internal end of the outlet tube a distance of at least 20 percent of a total axial length of the outlet tube construction. In certain preferred embodiments, this first perforated section is spaced a distance from the internal outlet tube a distance of no greater than 50 percent of a total axial length of the outlet tube construction.

DETAILED DESCRIPTION

Figure 1:
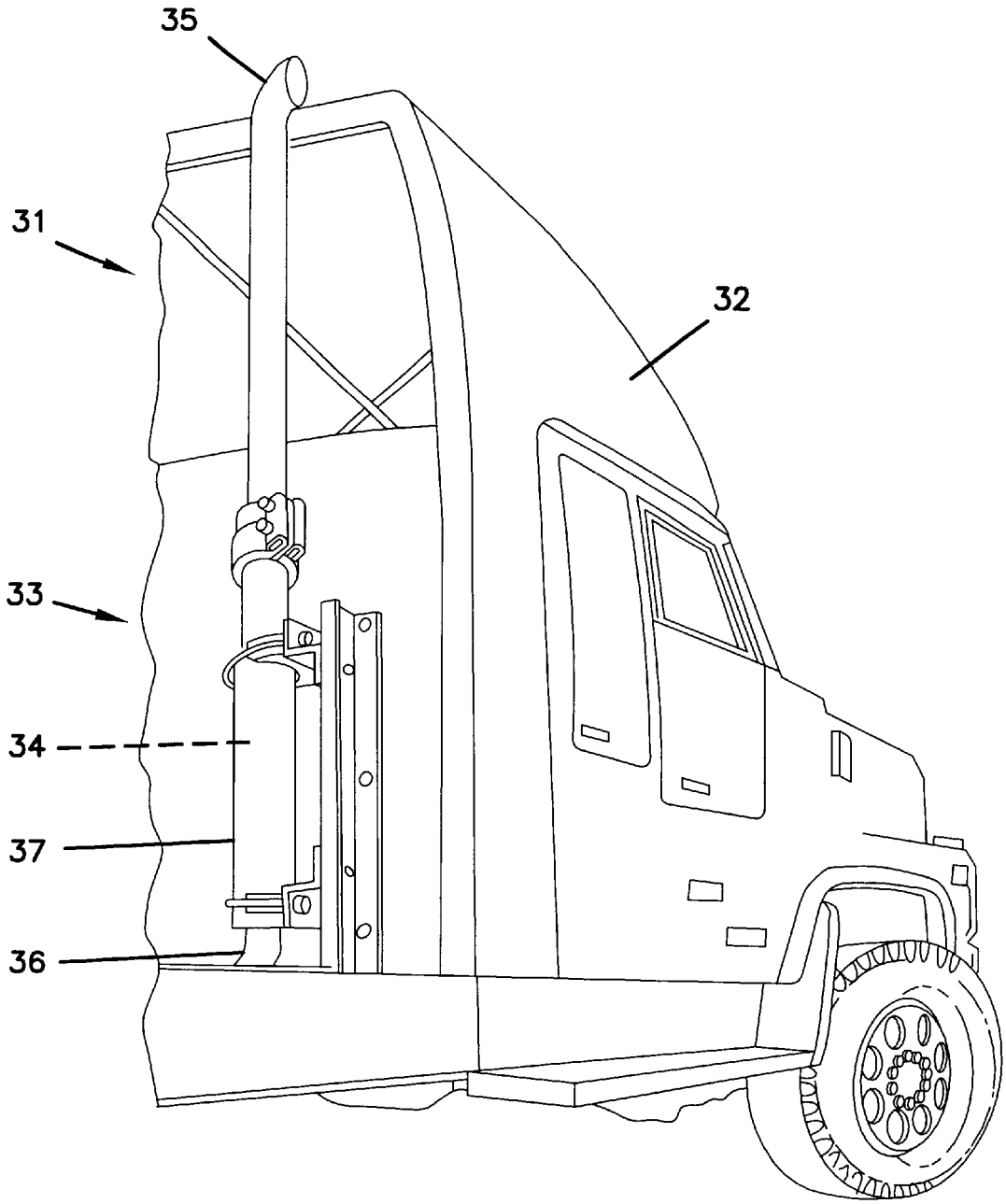
FIG. 1 is a perspective view of one embodiment of a truck, depicting its exhaust system, and utilizing an engine retarder, in accordance with principals of the present invention.

A. Characteristics of Typical Trucks with Engine Retarders

Engine retarders or compression brakes of the type of concern with respect to the present disclosure are typically found on class 7 or 8 trucks, but they may be used on other equipment such as class 4–6 trucks. Such trucks, for example, have engines which operate within the range of about 300 hp (horsepower) to 600 hp (223,680–447,360 watts or W). Such trucks typically have a gross vehicle weight (GVW) (total weight of loaded vehicle including chassis, body and payload) of about 14,000 to 26,000 lbs. Class 8 trucks, for example the diesel engine over-the-highway semi-tractors, usually have engines of about 300–600 hp. Class 8 trucks typically have a GVW of 33,000 to 80,000 lbs. The class 7 trucks, used for example as dump trucks, cement mixers and delivery trucks, usually have engines of 300–500 hp (223,680–372,800 W), and a GVW of 26,000 to 33,000 lbs.

Herein, in some instances engines will be referred to by their "rating" which is generally a defined hp at some specific rpm, usually selected for normal highway operation. A common engine rating for over the highway trucks, for example, is 500 hp (372,800 W) and 2100 rpm. Typically, the rpm selected for the "rating" is either 1800 or 2100 rpm. The hp at the rating rpm will typically be within the range of 300–600 hp (223,680–447,360 W). A particular engine referenced herein is the Detroit Diesel Engine Series 60 which is rated at 500 hp at 2100 rpm. This engine is referenced in this document in part because it is a popular truck diesel engine which utilizes compression-type engine brakes.

As used herein, certain engines are characterized as being rated for a power, for example, 300 hp, 400 hp or 500 hp at some selected rpm value of 1800 or above. By this it is not meant that the horsepower rating listed is necessarily met at 1800 rpm. All that is meant is that at some rpm value which is either 1800 or above 1800, the horsepower identified is the rating.

With diesel powered trucks, a typical and conventional muffler design has an outer, cylindrical, shell of circular cross-section with an inside diameter of about 10 inches (25.4 cm) and end pipes (outlet and inlet tubes) of about 5 inches (12.7 cm) in diameter. The length of the 10 inch (25.4 cm) diameter portion of such mufflers is generally about 44–45 inches (111.76–114.3 cm). For example, the M100580 muffler, available from Donaldson Company of Minneapolis, Minn. (the assignee of the present invention), is a widely used muffler design for heavy duty (class 7 or 8) trucks. Its dimensions are: 10 in. (25.4 cm) diameter by 45 in. (114.3 cm) long. Such standard mufflers generally have a single wall outer shell of 20 gauge steel, and a weight of about 28–33 pounds (about 13–15 kg). They are typically oriented vertically when used.

The reference number 31, FIG. 1, generally depicts a typical truck having an engine retarder of the compression brake-type therein. For example, the truck could be a class 7 or 8 truck. The vertical exhaust system, indicated behind the cab 32, at reference No. 33, includes muffler 34. The muffler 34 is positioned between downstream exhaust pipe 35 and upstream, inlet, exhaust conduit 36. The muffler 34 is sized to fit behind cab extender 37. The muffler may be, for example, a M100580 muffler available from Donaldson Company. Such mufflers are generally manufactured of relatively inexpensive materials.

In general, for typical heavy duty (class 7 or 8) trucks, the total vertical distance available for the positioning of the muffler is limited. Standard muffler lengths (for the 10 inch (25.4 cm) diameter portion of the outer shell) are about 45 inches (114.3 cm). In many instances, then, preferred constructions should be no longer than 45 inches (114.3 cm) in length. It has been found, however, that with certain trucks (engines) such as Ford or Freightliner, up to about 55 or 60 inches (about 140 or 152 cm) of length can be taken, for the 10 inch (25.4 cm) diameter portion of the muffler shell. In certain preferred embodiments described hereinbelow, then, a muffler of overall length of less than about 60 inches (about 152 cm) and generally about 55 inches (about 140 cm) is provided.

In doing the evaluations relating to the present invention, it was determined that for single muffler systems, the design most appropriate or preferred would differ, depending upon the size of engine involved. In general, if the engine was rated for operation (at 1800 rpm flow restrictive design was preferred; and, if the rating of the engine (at 1800 rpm or 2100 rpm) of the vehicle was below about 500 hp (372–800 W), alternate, shorter designs were sometimes useable. For dual muffler systems, a single design covered both under 500 hp and over 500 hp systems.

In connection with the following discussions of the preferred muffler designs, it should be understood that the preferred muffler needs to achieve several principal objectives:

(1) Satisfactory muffling of ordinary engine exhaust noise comprised of both exhaust gas and muffler shell noise (referred to as positive power operation);

(2) Satisfactory muffling of engine exhaust noise comprised of both exhaust gas and shell noise during intermittent use of the engine retarder or compression brake;

(3) offer no greater than acceptable level of back pressure to the system, typically 3 inches (about 76 mm of mercury) maximum; and, (4) meet size, weight, and shape criteria.

B. An Evaluation of Engine Noise and Typical Muffler Operation

In the experimental section below, studies conducted as part of evaluating muffler issues relating to ordinary engine operation and engine retarder operation are presented. As is discussed in more detail in the experimental section, the report reflects laboratory studies conducted on vertically oriented mufflers and vertically oriented exhaust pipes. Some of the studies were conducted on single muffler systems, others on dual muffler systems. In general, the designation SVV refers to a study conducted on a system having a Single muffler wherein the muffler is Vertically oriented and the exhaust pipe is Vertically oriented; and, the designation DVV refers to the situation in which a Dual muffler study was conducted in which both mufflers were Vertically oriented and both exhaust pipes were Vertically oriented. In DVV systems, each muffler is of the same design.

While the studies were conducted on vertically-oriented mufflers (i.e., mufflers whose central, longitudinal axis is generally normal to the ground), it is believed that principles of the invention herein may be applied to horizontally-mounted mufflers. For horizontal mufflers, the central longitudinal axis of the muffler is generally parallel to the ground surface. Horizontal mufflers can typically be 11 inches (about 28 cm) in diameter for circular configurations; or, for oval configurations, 10 inches by 15 inches (about 25 by 38 cm), 12 inches by 18 inches (about 30 by 46 cm), and 8.25 inches by 11.5 inches (about 21 by 29 cm). Horizontal mufflers will vary in length from 24–60 inches (about 61–152 cm), with the inlet and outlet tubes varying in geometrical locations.

In the experimental section, a base study was conducted evaluating noise attributable to a Detroit diesel engine (a Detroit Diesel Engine; Series 60, rated at 500 hp at 2100 rpm engine) under positive power operation and under braking operation, i.e. when an engine retarder or compression brake-type system was operated. Comparisons were done with systems involving: no muffler, i.e. only straight vertical pipes; a standard muffler; and various improved mufflers according to the present invention. Herein the term "braking" will sometimes be used to refer to operation when the engine retarder is engaged and operating to brake. A dynamometer system was used to simulate engine load, in the laboratory tests.

The acoustical study was conducted with evaluations of: A-weighted overall sound pressure level; and, A-weighted sound pressure level defined at various octave bands. Further, sound quality was quantified, with specific focus on evaluating: loudness; roughness; and sharpness.

The studies show, inter alia, a comparison of the operation of: (1) an engine with a straight vertical pipe and no muffler, under the two compared conditions of positive power operation and engine retarder (braking) operation. During this comparison it was observed that when the engine retarder is operated, there is a substantial increase in sound pressure level (overall) and especially at mid to higher octave bands, particularly the 500; 1,000; 2,000; and 4,000 Hz bands. This was correlated to the distinctive and characteristic "bark" sound associated with such brakes.

In a typical four-cycle diesel engine, when the piston is at top dead center, the pressure and the resulting temperature are so high that diesel fuel will self ignite if injected into the cylinder. Since it has been noted that with the compression-type brake activated, the exhaust valve is opened near top dead center, and very high pressures are suddenly released into the exhaust system. The result is a very loud sound that is emitted each time a cylinder reaches top dead center during engine brake operation. This sound is very objectionable, unless properly attenuated.

When a similar comparison was made, but with the standard M100580 Donaldson muffler, it was noted that this standard muffler muffles the engine noise under positive power operation very effectively, both overall and at all frequencies (octave bands), to generate an even, muffled sound (in terms of sound pressure level of the various octave bands). That is, the M100580 Donaldson muffler is well tuned to muffle the noise associated with positive power operation of typical class 7 or 8 heavy duty truck engines.

However, when evaluations were made with the standard muffler during engine retarder (braking) operation it was observed that there were still significantly high sound pressure levels in the mid to upper octave bands, especially the 500; 1,000; 2,000; and 4,000 Hz levels; and, the overall sound quality was objectionable. Indeed, to the human ear, the sound was still the objectionable, loud, high frequency, staccato noise or bark distinctive of engine retarder (braking) operations. For example, the shell noise contribution to the overall sound pressure level was about 1 dba at 50 feet (about 15.2 m), with noticeable objectionable "tinnyness."

Based upon the studies conducted, it became apparent that the standard muffler construction does not satisfactorily muffle engine compression brake retarder noise. That is, the comparative studies, reported in Examples I–VI, indicate that the standard muffler is well tuned to handle positive power operation since the sound pressure level at each octave is not only reduced, but it is smoothed out to a fairly even level. However, it was also apparent that the standard muffler is not appropriately tuned for handling engine retarder operation. That is, even though some muffling occurs, the muffling is not tuned to handle the higher frequency octave bands adequately to achieve acceptable sounds.

During the evaluations, it was determined that, in general, it would be preferred that the method used to muffle the characteristic engine retarder noise or bark be "passive". That is, it would preferably be a system that involves no moving parts and is continuously "on line" so that no separate control system would be necessary for its implementation. It was also determined that it would be preferred that the system used to muffle the engine retarder noise be one that can be contained within the muffler shell that would necessarily be present for the muffling of positive power operation anyway, in typical trucks. In this manner, assembly would be facilitated. Further, avoidance of additional equipment taking up additional space, weight, and requiring substantial further expense, could be achieved. It was determined that it would be preferred to provide such systems, if possible, at an overall weight of no more than about 55 lbs. (about 25 kg).

The issue, then, was to develop appropriate muffler designs that would be adequately tuned to muffle exhaust sounds associated with engine retarder systems or compression brakes, while at the same time also being adequately tuned to address ordinary (positive power) engine exhaust noise. It was apparent, however, that standard muffler designs would not be adequate to address the problem, since they do not adequately attenuate both the high sound pressure levels and the higher frequency octave bands associated with engine brake operation. That is, standard mufflers are designed for positive power muffling, not braking. Also, it was apparent that preferred implementation of the improvements would involve avoidance of a need to increase the outer diameter of the muffler; and avoidance of the need to increase the length if possible, and certainly and preferably avoidance of an increase in overall length to beyond 60 inches (about 152 cm). It was further desired that this be accomplished with a design that does not exceed current back pressure limits for the system, for proper and recommended engine operation.

In the Figures, certain preferred designs for accomplishing this are presented.

In general, the preferred designs presented take advantage of four types of sound reduction operations. These are: reactive silencing or muffling; resistive silencing or muffling; absorptive silencing or muffling; and body shell noise damping.

Reactive silencing or muffling is the application of "wave cancellation" techniques. That is, attenuation occurs as a result of impedance changes that cause wave reflection within the muffler, and cancellation. Resonators, stagnant air columns, and cross-sectional area changes to achieve this, and methods to tune them for various frequencies, are well known in conventional muffler technology. For example, the Donaldson M100580 muffler uses reactive silencing.

Resistive sound attenuation primarily results from energy dissipation such as forcing or directing flow of the sound through smaller diameter holes, apertures, or tubes causing a smoothing of pressure pulsations (noise). Techniques of this type also have generally been used in truck mufflers, for example in the Donaldson M100580 muffler.

Another type of muffling technique applied herein is absorptive. With this type, the energy represented by the sound waves is dissipated as heat. Generally, it results from passing or directing the sound waves over or through a packing, such as a fibrous packing. The packing will absorb and dissipate the energy of the sound waves by the sound energy being converted into motion of the fibers.

Another type of muffling technique is shell damping. Shell damping is important, since shell vibration will result in the unwanted transmission of exhaust noise into the environment (through drumming). Shell damping involves any method of reducing the tendency of the muffler shell to vibrate as a result of the sound pressures within the muffler. Friction is utilized to dissipate energy. Effective techniques include laminated bodies, external fibrous (e.g. fiberglass) wraps, and internal fibrous packing.

It will be apparent from the study of the preferred embodiments presented, that all four muffling techniques are applied in preferred mufflers according to the present invention. The applications are conducted in manners designed to enhance and in some instances to optimize achievement of positive power muffling and also muffling under conditions of engine compression braking.

Information about compression brake noise is found in the following publications, incorporated herein by reference:

Wahl, Thomas J. and Thomas E. Reinhart, "Developing a Test Procedure for Compression Brake Noise," *SAE Technical Paper Series* 972038, Society of Automotive Engineers, 1997.

Reinhart, Thomas E. and Thomas J. Wahl, "Characteristics of Compression Brake Noise," presented at conference in Adelaide, Australia, December, 1997.

Reinhart, Thomas E. and Thomas J. Wahl, "A Proposed Compression Brake Noise Test Procedure," presented at conference in Adelaide, Australia, December, 1997.

C. A First Embodiment

Figure 2:
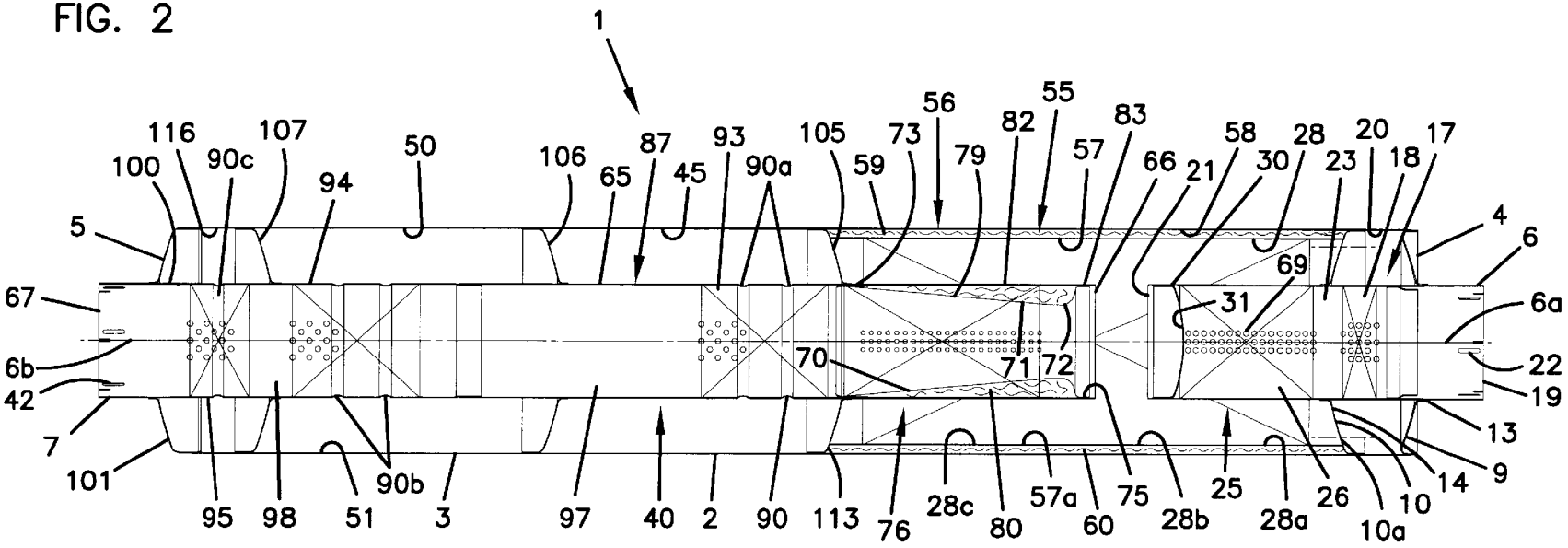
FIG. 2 is a schematic, cross-sectional view of a first embodiment of a muffler arrangement, according to principles of the present invention.

Attention is first directed to FIG. 2. In FIG. 2, a first improved muffler design according to the present invention is generally presented. The specific muffler design of FIG. 2 has an overall outer diameter of less than 11 inches (about 28 cm), typically about 10 inches (about 25 cm). Herein, the term "outer diameter" in this and similar contexts is meant to refer to the largest dimension of a cross-section taken substantially perpendicular to a line from the inlet to the outlet. For typical mufflers, the outer shell is a cylindrical body and the outer diameter is the diameter of this cylindrical body.

The overall length of the outer shell (10 inch diameter body)(about 25 cm), for the embodiment of FIG. 2, is about 55 inches (about 140 cm). Thus, the embodiment of FIG. 2 is somewhat longer than the standard 10 inch by 45 inch muffler (about 25 cm by 114 cm). Herein, the terms "length" and "longitudinal dimension" used in this and similar contexts, refer to the length of outer shell or outer diameter body, i.e. to the longitudinal, end-to-end, length of the wide part of the shell. That is, length of tubes at the inlet and outlet are generally disregarded when this reference is made. This will be further understood by reference to the drawings.

The arrangement of FIG. 2 is particularly well adapted for use in connection with vehicles such as trucks in which the engine power rating is such that operation at greater than, or about, 500 hp is involved (at 1800 or 2100 rpm or somewhere therebetween). The muffler of the embodiment of FIG. 2 can be made with an overall weight of less than about 54 lbs. (about 24.5 kg), typically about 51 lbs. (about 23.1 kg). Thus, the embodiment of FIG. 2 represents a suitable muffler design for trucks having engines with high horsepower ratings (e.g., exceeding 500 hp) for which the size of the area in which the muffler is to be positioned can accommodate the extra overall length (about 10 inches extra); and, in which the added weight (about 15 pounds bringing total weight to 51) due to the larger size (by comparison to a 29–36 lb. standard muffler) is acceptable. The design, then, will be preferred with high horsepower engines with anticipated operation in environments wherein substantial operation of the engine retarder system is anticipated; and, in which a suitable level of muffling of the concomitant engine bark or staccato noise is desired, without exceeding system back pressure limits (typically 3 inches of mercury or less).

Referring still to FIG. 2, the improved muffler is generally indicated at reference numeral 1. The muffler 1 includes an outer casing, shell or body 2 with an outer wall 3 having first and second opposite ends 4 and 5 as indicated above; the longitudinal distance between ends 4 and 5 preferably being less than 56 inches, most preferably about 55 inches.

The muffler 1 includes an inlet tube 6, projecting from end 4, and an outlet tube 7, projecting from end 5. In operation, engine noise and exhaust are directed into the muffler 1 through inlet tube 6, with the exhaust eventually passing outwardly through outlet tube 7. In general, in operation muffler 1 will be positioned vertically, with inlet tube 6 toward the bottom. The preferred muffler 1 depicted has an "in-line" design. That is, a center line **6*a* of the inlet tube 6 is substantially co-linear with a center line 6*b* of the outlet tube 8**. This avoidance of a substantially tortuous exhaust flow path inhibits flow loss (back pressure build up) during operation.

Inlet tube 6 is secured within end 4 by baffles 9 and 10. Baffle 9 is an end baffle enclosing end 4, and has a central aperture 13 through which inlet tube 6 extends. Baffle 9 can be a standard baffle for a 10 inch diameter muffler, such as used on the conventional M100580 Donaldson muffler.

As indicated previously, inlet tube 6 is also secured in position by extension through baffle 10. Baffle 10 is positioned secured against outer shell 3 and spaced inwardly from baffle 9 a distance of about 2 to 6 inches, typically about 3 inches. Baffle 10 preferably is perforated. More specifically, baffle 10 includes peripherally positioned apertures **10*a* around its peripheral area. Preferably, if there are apertures 10*a*, there are from 1 to 4, typically 2 apertures (0.5 to 2 inches, typically about ⅝ inch in diameter) evenly radially spaced, each located anywhere between the center line 6*a* to the outer shell, typically about midway. Note that baffle 10 includes central aperture 14 through which inlet tube 6 extends, and by which inlet tube 6** is secured in position, for example through a weld.

Note that inlet tube 6 preferably defines a series of open grooves or slots 22. These slots 22 can be for aiding connection and clamping to other tubes in the exhaust assembly. Slots 22 are generally of a type described in U.S. Pat. No. 4,113,289, which patent is hereby incorporated by reference.

Attention is now directed to region 17 of inlet tube 6. Region 17 preferably comprises a perforated section 18 of inlet tube 6 positioned between baffles 9 and 10. As a result of perforated section 18, exhaust gasses and exhaust sound entering muffler 1, through inlet tube 6, can expand into volume 20 between baffles 9 and 10. Volume 20 acts as an expansion-can resonator. Preferably, perforated section 18 comprises 14–18 gauge steel, with quarter inch circular holes in a staggered pattern. As used herein, perforation sections are described as either in a "standard pattern" or in a "staggered pattern". As used herein, a standard pattern is one that is defined as follows: The center lines of a row of circular perforation holes will align with a circumferential arc drawn on the respective tube. The circumferential spacing between holes is regular, preferably ⅜ inch center to center, but ranging from ¼ inch to ¾ inch. Additional rows are identical, with each row being axially separated from the previous row by a distance that is the same as that of the perforation spacing within the rows. Thus, the perforation holes are aligned both axially and circumferentially. A staggered perforation pattern differs from a standard perforation pattern in one way. Specifically, the center lines of holes in two adjacent rows are offset in the circumferential direction by ½ of the distance that defines the perforation spacing. Thus, the perforations are aligned circumferentially, but staggered axially. For both standard perforation patterns and staggered perforation patterns, the percentage of open area typically and preferably ranges between about 5% and 35%.

Volume 20 preferably will, as a result, operate as an expansion-can resonator. It can be tuned to lower-to-mid frequencies; that is, the first peak in the transmission loss is at about 500–900 Hz using standard acoustic design techniques.

Continuing inwardly from a first, outer, end 19 of inlet tube 6 to a second, inner, end 21, and beyond region 17, solid or unperforated region 23 is encountered. Region 23 is a solid cylindrical region which is secured to baffle 10, for example by welding. Region 23 is preferably about 1–3 in., typically 1.3 inches long.

Beyond region 23, and moving toward end 21, region 25 is encountered. Region 25 preferably comprises a second perforated section 26 of tube 6. Perforated section 26 has a staggered pattern, as defined above. As a result of the perforations in perforated section 26, exhaust gasses and sound within inlet tube 6 can expand into volume 28.

Volume 28 preferably includes three subvolumes, volume 28*a*, volume 28*b*, and volume 28*c*. Volume 28*a* is defined between perforated section 26 of the inlet tube 6 and inner wall 57. Volume 28*a* may preferably function as an expansion chamber with a broad-band attenuation. Volume 28*b* is the volume in the space between end 66 of the outlet 40 and end 21 of the inlet tube 6, and the inner wall 57. Volume 28*b* also may preferably function as an expansion chamber with broad band attenuation. Volume 28*c* is the volume defined between end 66 of outlet 40, baffle 105, and inner wall 57. Volume 28*c* may preferably function as a stagnant air column. That is, there is no net air flow in volume 28*c*. Volume 28*c* preferably attenuates effectively in frequency bands centered about frequencies defined by odd multiples of the frequency whose wave length is four times the length of the stagnant air column.

Beyond region 25, and toward end 21, is positioned unperforated end section 30 which is enclosed by end cover 31. End cover 31 is preferably solid, but it also may be perforated.

In preferred arrangements, such as the one shown in FIG. 2, end 21 in section 30 of inlet tube 6 has a circular, cylindrical, exterior configuration. That is, preferably end 21 is a non-crimped construction. "Crimped" constructions are typical for many mufflers, such as described in U.S. Pat. .4,580,657 incorporated herein by reference. By "non-crimped", it is meant that the inlet tube has a cross-section at its end region which is not substantially different from the cross-section of the inlet tube. If circular, the inlet tube has a diameter at its end region which is not more or less than about 10 percent from the diameter of the rest of the inlet tube. A reason for the non-crimped construction is that avoidance of such crimping was found to lead to a slight reduction in sound pressure level during braking operation; and, the effect was found to be greatest with respect to higher frequency components, particularly the 1,000 to 8,000 Hz octave bands which are especially characteristic problem bands of engine retarder brakes.

Inlet tube 6 preferably is designed to function as a full choke. By "full choke", it is meant that air flow through the inlet tube 6 is obstructed from flowing directly (axially) into the muffler interior. The full choke of the inlet tube disrupts the air flow by, in this instance, plug 31 and forcing the air to flow through perforations 69.

The remainder of the muffler 1 generally comprises two principal units: outlet tube construction 40; and, features defined with respect to the outer shell 3.

In general, interior volume 45 of shell 2 is preferably separated into three major volumes: (a) volume 20, located immediately adjacent to end 4; (b) volume 28, located generally adjacent to volume 20; and, (c) volume 50 located toward end 5, from volume 28. Volume 50, as described below, for the preferred embodiment shown actually comprises 3 sub-volumes or resonators.

Volume 20 has previously been partially described. Preferably, it is an expansion volume around inlet tube 6 between baffles 9 and 10 and generally located immediately adjacent to end 4. Volume 20 is bounded (circumferentially) on the exterior by the outer wall 3 of shell 3. It preferably acts as an expansion-can resonator.

In the preferred embodiment shown, volume 28 is located toward end 5 of shell 3, from baffle 10. Volume 28 preferably is a double-walled volume 55. That is, in the specific embodiment illustrated, in volume 28, outer shell 2 has a double-wall construction 56 comprising outer wall 3 and inner wall 57. Alternatively stated, volume 28 is circumferentially bounded by a double wall construction 56. Preferably, inner wall 57 comprises a perforated member 57*a*, perforated in a standard pattern of 0.1875 inch diameter holes, with a distance of 0.375 inches between centers of adjacent holes. "Adjacent holes", in this context, means both holes that are laterally next to, and holes that are immediately above or below, any one given hole.

An annular volume 58 preferably is defined between inner wall 57 and outer wall 3. In the illustrated embodiment, the annular volume 58 is filled with an absorptive filling, such as stuffing, padding, or packing 59. Generally, packing 59 is a fibrous packing 60 such as fiberglass. For example 0.5 inch "E" type glass fiber can be used, although a variety of forms of the packing can be used. In most arrangements, the thickness of the packing material 60 is usually under 2 inches, and typically 1 inch or less. In some arrangements, the thickness of the packing can be about 1 inch or greater than 1 inch. Advantages which result from the presence of an annular volume 58 filled with packing 59, positioned generally where shown in FIG. 1, will be discussed further below. High temperature fiberglass of the type above is preferred because it is relatively inexpensive and is readily available; it can withstand the temperature of the muffler environment (about 650° to 1100° F. for a diesel engine); and, it can withstand the chemical environment (typically corrosive environment) of the exhaust gas muffler environment.

Figure 2A:
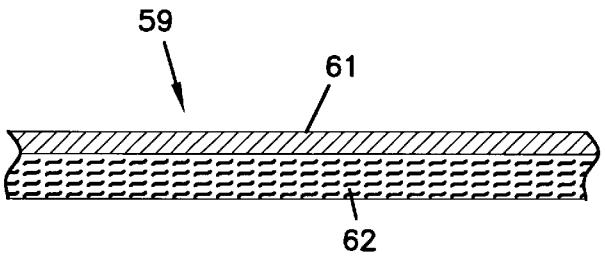
FIG. 2A is a schematic, fragmentary, cross-sectional view of an embodiment of a packing arrangement, used in FIG. 2.

Packing 59 may comprise a loose, fibrous material. Alternatively, packing 59 may comprise a non-woven mat. Attention is directed to FIG. 2A. In FIG. 2A, a schematic, cross-sectional view of packing 59 is illustrated. In this specific embodiment, packing 59 comprises a backing 61 and non-woven fibers 62 attached to backing 61. Backing 61 provides stability and integrity to the packing 59. When installed in annular volume 58, fibers 62 are adjacent to the outer wall 51, while backing 61 is adjacent to inner wall 57.

A variety of techniques may be used to fill annular volume 58. However, as long as annular volume 58 is well-filled, the muffler 1 will perform satisfactorily, including damping the shell, regardless of the technique used.

One technique useable to fill the annular volume 58 is described in copending U.S. patent application Ser. No. 09/156,834, filed Sep. 18, 1998. application Ser. No. 09/156,834 is commonly assigned and is incorporated by reference herein. That application describes apparatus and processes for constructing mufflers, including the installation of fibrous packing in muffler constructions. Application Ser. No. 09/156,834 also describes one example packing material as E-glass, commercially available from Bay Insulation of Green Bay, Wis. This packing material comprises a fibrous glass 98.7% by wt., and having a specific gravity of 2.5.

A preferred perforation pattern for wall 57 is a 3/16 inch diameter hole, standard pattern, with 0.375 inch by 0.375 inch distance between centers of adjacent holes. Such a pattern operates to retain the packing 59 in place and, at the same time, to allow sufficient passage of sound into the packing for effective absorbent-type sound attenuation.

Preferably, annular volume 58 has an annular dimension (average radial dimension, when circular) or average thickness of 0.25 to 1 in., typically about 3/8 in. That is, preferably the cross-sectioned dimension (diameter) of wall 57 is about 0.5 to 1 in., typically about 0.75 in. smaller than a cross-sectional dimension (diameter) of wall 3. Other dimensions for the cross-sections thickness of volume 58 are contemplated.

When arranged in muffler 1 with packing 59, annular volume 58 preferably functions as an absorptive attenuator and body shell damper. That is, it operates to attenuate mid-to-higher frequencies. Typical frequencies muffled by annular volume 58 are at the 500 Hz octave band and higher.

Attention is now directed to outlet tube construction 40. Outlet tube construction 40, in the specific illustrated embodiment, has an outer wall 65 which extends between first end or inlet end 66 and second end or outlet end 67. Note that near outlet end 67, outlet tube construction 40 preferably defines slots 42 to aid in connection and clamping with other conduits in the exhaust system. Slots 42 may be of the type described in U.S. Pat. No. 4,113,289, hereby incorporated by reference.

Still referring to FIG. 2, outlet tube construction 40, adjacent to first end 66, preferably includes throat section 70. In throat section 70, an interior surface 71 is provided which tapers downwardly in dimension (diameter) in extension toward throat 72 from point 73. Between throat 72 and end 66, section 70 expands outwardly in somewhat of a bell configuration or bell section 75.

Preferred dimensions with respect to section 70 and tapering throat section 70 are described herein below. In general, section 70, as thus far described, operates as a convergent-divergent duct or sonic choke (or sonic throat). It preferably absorbs a wide range of frequencies, depending on flow rate and temperature through the muffler. That is, it acts as a convergent-divergent duct with sub-sonic mean flow incorporating a surrounding stagnant air column. It reduces the transmission of acoustic energy to the environment, and this reduction is increased as the engine mass flow rate is increased. It is typically more effective than a straight pipe of equal length, within back pressure considerations.

For muffler constructions 1 having an overall length of about 55 in., a tapering in throat section 70 of at least 2.5° downwardly from the widest diameter to throat 72 having an overall diameter of no smaller than about 2.25–3.5 inches will be preferred. Indeed, the tapering in throat section 70 preferably is no greater than about 8°, generally about 3°–7°, and typically about 5°. Throat 72 preferably has an overall diameter of about 3.25 in.

Still referring to throat section 70, an outer tapering surface 79 is preferably provided surrounding throat section 70. This outer tapering surface 79 is surrounded with packing 80, contained against outer surface 79 by retaining construction 82. Retaining construction 82 is preferably cylindrical in configuration and extends between outer point 83 adjacent to end 66, and outer point 73 which is approximately the point at which throat section 70 begins to converge or taper, in extension toward throat 72.

Throat section 70 is perforated, in a 3/16 inch standard pattern.

Preferably, retaining construction 82 may be a solid section. Preferably, packing 80 is a fibrous packing such as fiberglass, and may be as described above for packing 59. For example, 0.5 inch "E" glass mat can be used for packing 80. The combination of retaining construction 82 and outer tapering surface 79 with packing 80 therebetween acts as an absorptive attenuator. That is, it operates to muffle mid-to-higher frequencies, e.g., typically the 500 Hz octave band and higher.

Outlet tube construction 40 includes, immediately adjacent section 70, and extending from section 70 to outlet end 67, extension section 87. Extension 87 is generally cylindrical in external configuration, except for anti-whistle beads or rings 90, positioned and configured as described below. Extension 87 preferably includes at least two perforated sections. The particular embodiment shown includes first, second, and third perforated sections 93, 94 and 95, respectively separated, as shown, by solid sections 97 and 98. Extension 87 includes end section 100. End section 100 is secured to end flange 101, of outer shell 3, with extension through aperture 102, in a conventional manner, for example by welding. Outlet tube construction 40 preferably includes, surrounding extension 87 and securing the same in place, interior baffles 105, 106 and 107. For the preferred embodiment shown, each of baffles 105, 106 and 107 is solid, i.e. non-perforated. However, baffles 105, 106, 107 can be perforated, as well. Baffle 105 is positioned around extension 87 at point 73 separating throat section 76 from perforated section 93. Baffle 105 is also secured to the outer wall 2 of shell 3. For the preferred embodiment shown, baffle 105 is positioned at end 113 of the annular volume 58 defined by inner wall 57. Thus, inner wall 57 and annular volume 50 generally extend between baffles 10 and 105.

Baffle 106 is also, preferably, a solid baffle, extending between extension 87 and outer wall 3. Baffle 106 is secured to extension section 87 around solid or unperforated section 97. In the preferred embodiment illustrated, volume 45 is defined between baffles 105 and 106. Volume 45 preferably is a sub-volume of volume 50 and comprises an expansion volume for gasses and sound within extension section 87 expanding through perforated section 95. Preferably, volume 45 is an expansion-can resonator tuned to broad band frequency attenuation.

Baffle 107 is also a solid baffle extending between extension section 87 and outer wall 2 of shell 3. Baffle 107 may be secured to extension section 87 at region 98. As a result of the positioning of baffle 107, volume 51 is preferably defined between baffles 106 and 107 around extension 87. Volume 51 is a sub-volume of volume 50 and preferably comprises an expansion volume for sound and gasses within extension 87 expanding outwardly therefrom through perforated section 94. Preferably, volume 51 is a resonator tuned to broad band frequency attenuation. In the embodiment illustrated, baffle 107 is secured to extension section 87 around solid section 98. Volume 45 and volume 51 are tuned to work together, as ganged resonators. That is, they are double expansion-can resonators with internal connecting tubes. Ganged resonators typically provide a broader range, and fewer null points in the transmission loss of attenuated frequencies, than single expansion chambers. The length of the connecting tube is chosen to provide the most effective band of frequencies. The ganged resonators have a broad band attenuation with peaks at about 400; 700; 1,300; and 1,800 Hz.

In the preferred embodiment illustrated, between baffle 107 and end 101 of shell 5 is defined volume 116. Volume 116 is a sub-volume of volume 50 and comprises an expansion volume for sound and gasses within extension 87 expanding outwardly therefrom through perforated section 95. Preferably, volume 116 is an expansion-can resonator tuned to relatively high frequencies; that is the first peaks in the transmission loss are at about 600–1,000 Hz.

Attention is now directed to annular rings or anti-whistle beads 90. Anti-whistle beads 90 are preferably positioned in the illustrated embodiment as follows: two beads 90*a* are positioned in perforated section 93; two beads 90*b* are positioned in perforated section 94; and one bead 90*c* is positioned in perforated section 95. The beads 90 are substantially identical to one another, except the positioning as shown. In general, each bead is semi-circular in configuration (in cross-section) and described in U.S. Pat. No. 4,023,645, hereby incorporated by reference. The beads 90 generally operate as anti-whistle beads, in order to inhibit whistling as exhaust passes through extension section 87, by disturbing the boundary layer as it flows over the perforations.

In general, three types of perforations were evaluated with respect to sections 93, 94 and 95. These were ⅛ inch, 3⁄16 inch, and, ¼ inch diameter perforations. It was generally found that the larger perforations, especially ¼ inch and sometimes 3⁄16 inch, worked better for sound attenuation of the higher frequency noise associated with engine retarders. However, during exhaust flow through the system, these larger sizes tended to whistle more readily. Thus, anti-whistle beads such as beads 90 will generally be preferred for extensions of perforate material on outlet tube constructions according to the present invention, when larger perforations, ¼ inch and in some instances 3⁄16 inch, are chosen for the perforated sections in the outlet tube construction. The preferred embodiment of FIG. 2, as indicated below, uses the larger perforations in these sections.

In general, it has also been found that the throat diameter or choke diameter at region 72, or analogous regions in the other embodiments, which is preferred will in part be dependent upon the flow rate of exhaust gases length of muffler chosen. In general, with longer mufflers, there are more flow losses due to friction, and greater back pressure problems are encountered. As a result, with longer mufflers, larger throat diameters will be preferred, in order to compensate for this. In general, with mufflers having an overall outer shell length of about 55 inches (about 140 cm), choke or throat diameters at throat region 72 on the order of about 2.25 to 3.50 in. (about 6–9 cm) will be preferred. On the other hand, as illustrated with respect to FIGS. 3 and 4, for mufflers having an overall outer shell length of about 45 inches (about 114 cm), choke or throat diameters on the order of about 2.25 to 3.25 in. (about 6–8 cm) will be preferred.

Note that the muffler embodiment 2 lacks moving parts. That is, all components (internal and external) are always stationary and do not move relative to each other.

D. The Embodiment of FIG. 3

Figure 3:
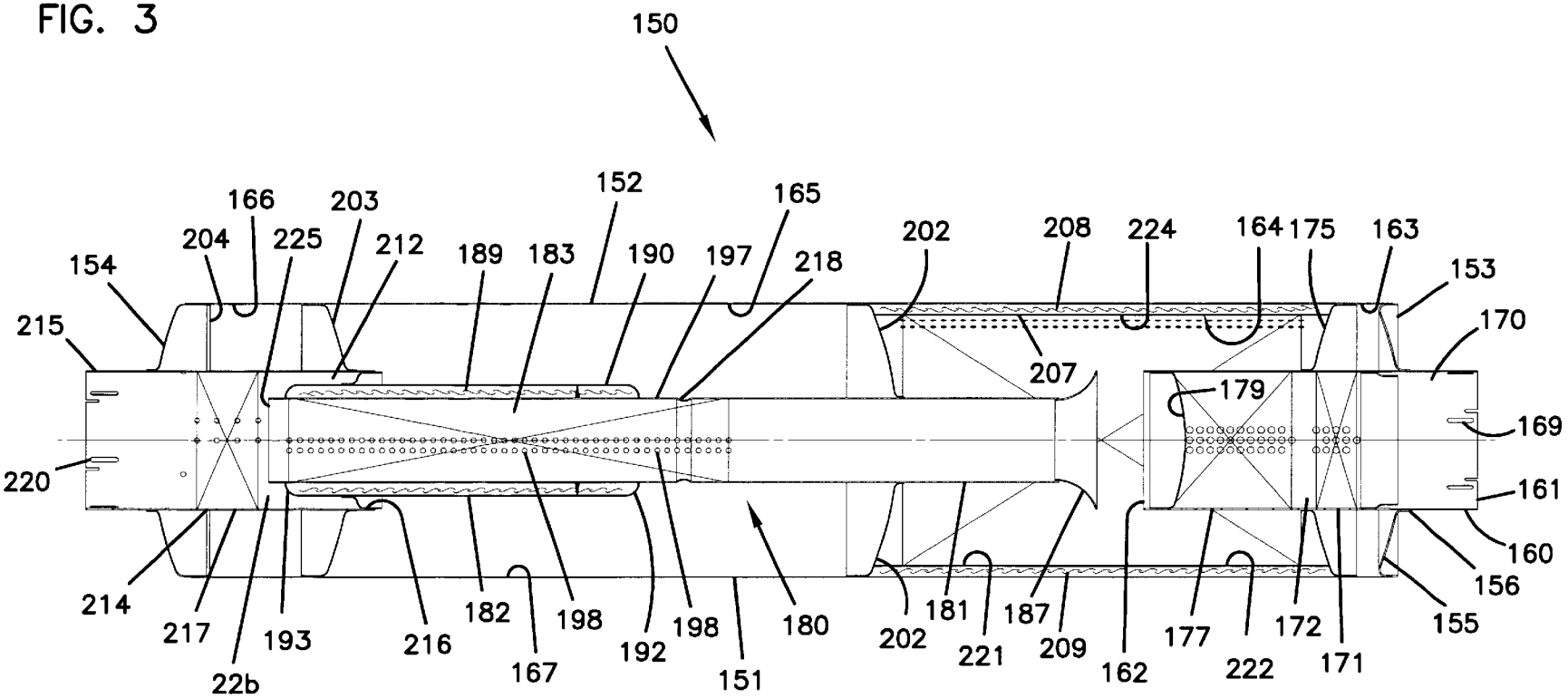
FIG. 3 is a schematic, cross-sectional view of a second embodiment of a muffler arrangement, according to principles of the present invention.

The arrangement of FIG. 3 is preferred for use with vehicles such as trucks with dual muffler systems. Trucks of this type have power of at least about 300 hp (of rated rpms).

The muffler of the embodiment of FIG. 3 can be made with an overall weight of less than 46 pounds (about 20.9 kg), generally about 42–44 pounds (about 19.0–20.0 kg), typically about 43 pounds (about 19.5 kg). The specific muffler design of FIG. 3 has an overall outer diameter of less than 11 inches (about 28 cm), typically about 10 inches (about 25 cm). The overall length of the outer shell for the 10 inch (about 25 cm) diameter body for the embodiment of FIG. 3 is about 45 inches (about 114 cm). That is, the configuration of FIG. 3 illustrates modifications that can be made within the interior of a conventionally sized 10 inch diameter (about 25 cm) by 45 inch (about 114 cm) length muffler, to achieve substantial engine retarder exhaust sound attenuation.

Many of the features of the arrangement of FIG. 3 are analogous to features found and described for the arrangement of FIG. 2.

Referring to FIG. 3, the improved muffler, indicated generally at reference 150, generally comprises an outer shell 151 defined by outer wall 152 extending between first end 153 and second end 154. At end 153, muffler 150 includes baffle 155 (preferably a solid baffle) having interior aperture 156. The muffler 150 includes an inlet tube 160 (having inlet end 161 and opposite end 162) positioned and secured within, and extending through, aperture 156. Inlet tube 160 preferably defines slots 169, analogous to slots 22 in FIG. 2.

Within shell 151 are preferably defined volumes 163, 164, 165 and 166. Volumes 165 and 166 may be viewed as sub-volumes within volume or region 167. In the illustrated embodiment, region 167 is defined between baffle 202 and baffle 204.

Still referring to FIG. 3, the preferred inlet tube 160 is generally cylindrical and has a first, non-perforated, section 170, to which baffle 155 is secured. Inlet tube 160, inwardly from section 170, includes perforated section 171, which preferably allows for expansion of gases and sound into volume 163. Inlet tube 160 further includes solid section 172, inwardly from perforated section 171. Solid section 172 provides a section for adjoining baffle 175. Volume 163 preferably is defined between baffles 155 and 175 (and between tube 160 and outer wall 152). Thus, volume 163 is circumferentially bounded by, and is circumscribed by, outer wall 152. Volume 163 preferably operates as an expansion-can resonator tuned to a peak attenuation frequency of about 975 Hz.

Referring again to inlet tube 160, the inlet tube 160 includes perforated section 177 positioned inwardly in extension along tube 160 from solid section 172 (and baffle 175).

End 162 of inlet tube 160 is closed by end plug 179. Preferably plug 179 is solid, but can also be perforated. As with the embodiment of FIG. 2, preferably end 162 has a circular cross-section and tube 160 is generally cylindrical (not closed by a crimp). As used in the preferred construction herein, inlet tube 160 operates as a full choke.

Generally, muffler 150 includes outflow tube construction 180. The tube construction 180 includes section 181, provided with bell section 187. It is noted that the preferred arrangement of FIG. 3 is also an "in-line " arrangement.

Preferably, tube construction 180 further includes extension section 197 which is generally cylindrical in configuration and preferably includes perforated section 198. An anti-whistle bead 218 is preferably positioned near an upstream end of perforated section 198.

Extension section 197 includes damping section 183. In the example embodiment illustrated, section 183 is surrounded by packing 189 (preferably fibrous packing such as fiberglass) contained against an outer wall 182 by cylinder 190. Cylinder 190 extends generally around section 183 in extension from point 192 (which is about ⅔ of the extension across volume 165 from end 154) to point 193, where extension 183 ends. Point 193, where extension 183 ends, is within outlet tube 215. Section 183, including packing 189 in an annular space between section 183 and outer wall 182 of cylinder 190, acts as an absorptive attenuator. It absorbs mid-to-high frequency noise. For example, frequencies at about 500 Hz octave band and greater are attenuated.

Preferably, section 183 extends and projects into outlet tube 215. Outlet tube 215 is generally cylindrical and attached to wall 182 at baffle 216. Outlet tube 215 is generally a standard size, i.e. about 5 inch diameter tube. Its diameter is greater than the diameter of extensions 197, 181, and 183 of tube construction 180. Typically, extensions 197, 181, and 183 have a diameter of about 3 inches. This diameter of tube construction 180 is smaller than the typical 5 inch diameter; as such, it allows for a greater expansion ratio, which results in a quieter, more muffled sound. Normally, a narrower diameter to tube construction 180 may create backpressure concerns. However, because this is used in a dual muffler system, the backpressure concerns are alleviated and it is possible and advantageous to use the tube construction 180 to have a diameter smaller than the typical 5 inch diameter.

Outlet tube 215 preferably defines slots 220 outside of muffler interior. Slots 220 help to connect outlet tube 215 to other conduits, and are analogous to slots 42 in FIG. 2.

Muffler 150 includes inner baffles 202 and 203, and end baffle 204.

Volume 164 is generally defined between baffles 175 and 202. Preferably, volume 164 is a double-walled volume defined by inner wall 207 and outer wall 151 with annular space 208 therebetween. Preferably, annular space 208 is 0.25 inch to 0.5 inch thick and is filled by packing 209, preferably fibrous packing such as fiberglass. The annular space 208 may be adjusted, depending upon the desired thickness of the packing material 209. In most instances, the packing material 209 will have a thickness usually under 2 inches, and typically 1 inch or less. In some arrangements, the thickness of the packing 209 will be under 0.5 inch, and in some arrangements the thickness of the packing 209 will be greater than 0.5 inch. Preferably, inner wall 207 is a perforated wall having a perforated pattern of 0.2 inch diameter holes, with a distance of 0.375 inches between centers of adjacent holes. Annular space 208, when filled with packing 209, functions as absorptive attenuator and body shell damper, absorbing mid to high frequencies, such as the 500 Hz octave band and greater. Volume 164 acts as an expansion chamber that has broad band attenuation.

Between perforated section 177 (which permits expansion from tube 160 into volume 222) of the inlet tube construction 160 and inner wall 207 is volume 222. That is, volume 222 preferably is a subvolume of volume 164 and is bordered by, and contained within, inner wall 207, plug 179, baffle 175, perforated section 177 and solid section 172. Volume 222 is an expansion chamber which functions as a region of broad band attenuation, due to the change in cross-sectional area from tube 160 to volume 222.

Between bell 187 and baffle 202 is region 221. Region 221 is a sub-volume of volume 164. Region 221 functions as a stagnant air column. It attenuates in frequency bands centered about frequencies defined by odd multiples of the frequency whose wavelength is four times the length of the stagnant air column (the distance from opening of bell 187 to baffle 202).

Between end 162 of inlet 160 and bell 187, and including the volume within bell 187, is volume 224. Volume 224 is a subvolume of volume 164. Volume 224 is an expansion chamber, which functions as a broad band attenuator.

Still referring to FIG. 3, preferably baffles 202 and 203 extend between tube construction 180 and outer wall 152 of shell 151. Note that for the preferred arrangement shown in FIG. 3, baffles 202 and 203 are non-perforated, or solid baffles, but could also be perforated.

Baffle 203 is secured to outlet tube 215 at solid region 212; solid region 212 being positioned adjacent to perforated region 217.

Volume 165 is a sub-volume of volume 167 and comprises an expansion-can resonator defined between baffles 202 and 203, surrounding extension section 197. It is preferably tuned to muffle frequencies of at least 150 Hz and higher. Perforated section 198 of extension 197 provides for expansion of sound and gasses into volume 165.

Outlet tube construction 215 is secured within end baffle 204 at region 214, for example by welding. Between end baffle 204 and inner baffle 203, volume 166 is defined. Volume 166 is a sub-volume of volume 167 and operates as an expansion-can resonator. Volume 166 surrounds perforated section 217 of outlet tube 215. Perforated section 217 allows for expansion of sound and gasses into volume 166. Preferably, volume 166 is tuned to muffle frequencies of at least 350 Hz and higher.

In the preferred embodiment illustrated, within outlet tube 215, the region between end 225 of tube construction 180 and perforated section 217 is region 226. Region 226 is an area discontinuity which functions as a broad band attenuator.

E. The Embodiment of FIG. 4

Figure 4:
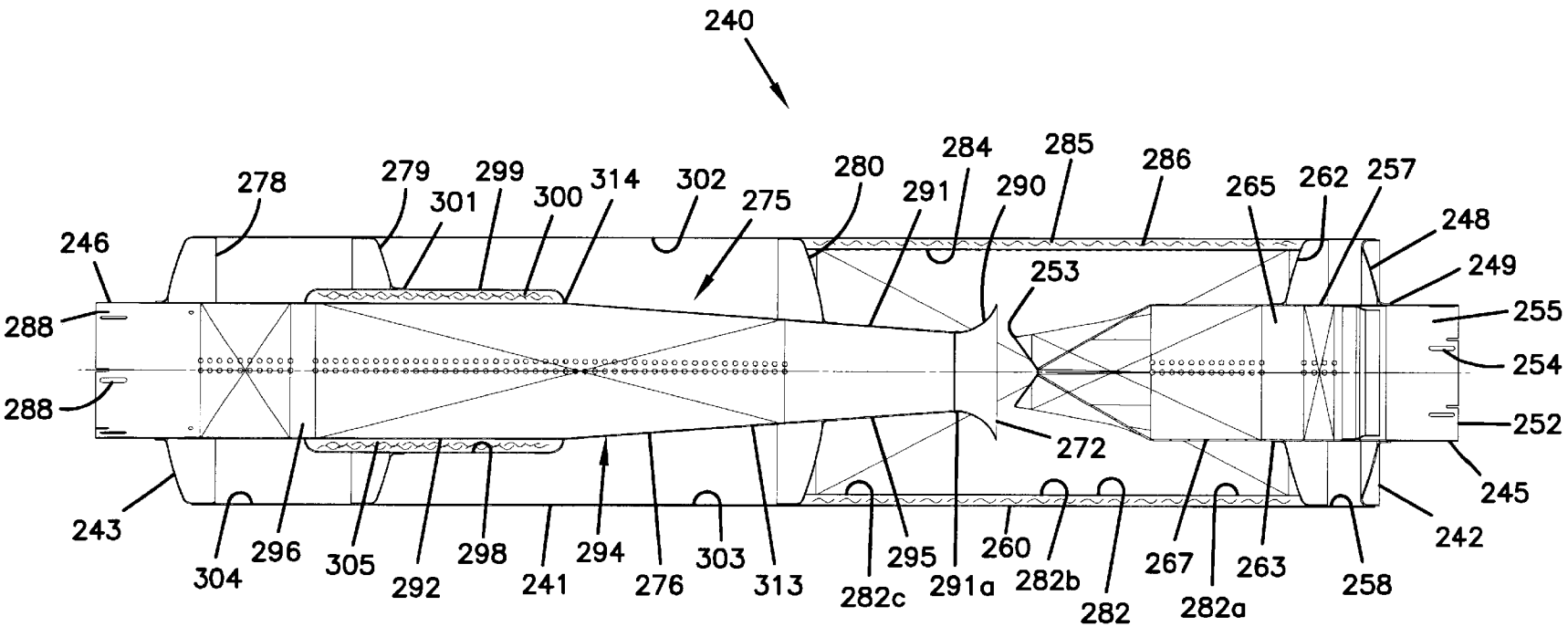
FIG. 4 is a schematic, cross-sectional view of a third embodiment of a muffler arrangement, according to principles of the present invention.

Attention is now directed to FIG. 4. The arrangement of FIG. 4 is a preferred embodiment for situations in which the standard dimensions of about 10 inches (about 25 cm) by about 45 inches (about 114 cm) are preferred; and, the engine of the vehicle under consideration is rated (at a rated rpm) for operation at less than about 500 hp, typically 250 to 500 hp. In such situations, the arrangement of FIG. 4 will generally be preferred to the arrangements of FIG. 2 because of smaller size and weight.

Referring to FIG. 4, muffler 240 includes outer shell 241 extending between first end 242 and second end 243. The muffler 240 includes an inlet tube 245 and an outlet tube construction 246. Again, a preferred in-line construction is used.

The muffler 240 includes inlet baffle 248 at end 242. The inlet baffle 248 preferably is a solid baffle having central aperture 249 therein. The inlet tube 245 is secured within central aperture 249, for example by welding.

The inlet tube 245 includes first end 252 and second end 253. Inlet tube 245 preferably defines slots 254, analogous to slots 22 in FIG. 2. The inlet tube 245 includes a solid section 255 adjacent first end 252. The inlet baffle 248 is secured to the inlet 245 within solid section 255.

Inwardly toward second end 253 from solid section 255, inlet tube 245 preferably includes perforated section 257. Perforated section 257 allows for expansion of sound and gasses into volume 258. Volume 258 is defined between outer wall 260 of outer shell 241 and inlet tube 245. It is contained on opposite ends or sides by inlet baffle 248 and central baffle 262. Note that preferably central baffle 262 is solid, but could be perforated. Central baffle 262 includes central aperture 263 therein. Inlet tube 245 is secured to central aperture 263 for example by welding, at section 265. Preferably section 265 is a solid section. In general, volume 258 comprises an expansion-can resonator and is preferably tuned for a peak attenuation frequency of about 750 Hz.

In the example embodiment illustrated, between section 265 and second end 253, inlet tube 245 is preferably perforated, having perforated section 267. For the embodiment shown, perforated section 267 is crimped or bent into a "star crimp" 268 of the type generally as described in U.S. Pat. 4,580,657, incorporated herein by reference. By "crimped", it is meant that the inlet tube has a cross-section at its end region which is substantially different from the rest of the inlet tube. For example, the outer periphery of the inlet tube at the end region may be bent inwardly toward the center of the tube, to a point where it either nearly touches or touches another portion of the periphery. As used in the construction herein, inlet tube 245 operates as a full choke, utilizing resistive attenuation techniques.

Muffler 240 includes outlet tube construction 275. The outlet tube construction 275 includes extension section 276. Extension section 276 preferably is secured centrally within muffler 240 by outlet baffle 278, at end 243 and central baffles 279 and 280. Preferably, each of central baffles 279 and 280 is a solid baffle, (but could be perforated) extending between extension 276 and outer wall 260 of shell 241.

Note that, in the preferred embodiment illustrated, outlet tube construction 275 includes diverging duct section 313, between baffle 280 and point 314 (where outer wall 299 begins). Diverging duct section 313 is perforated and allows for expanding flow (note the sloped surfaces). Due to this arrangement, preferably diverging duct 313 is anti-whistle bead free; that is, it contains no anti-whistle beads, as they are not necessary. The geometry of the preferred diverging duct 313 produces no whistling noise.

Volume 282 is defined between baffle 262 and 280. Within volume 282, preferably outer shell 241 has a double-wall construction comprising outer wall 260 and inner wall 284, with annular region 285 defined between inner wall 284 and outer wall 260. Preferably, annular region 285 is filled with packing 286, most preferably fibrous packing such as fiberglass as characterized above for other embodiments. Most preferably, inner wall 284 is a perforated section. A preferred perforation pattern is 0.1875 inches in diameter holes, 0.375 inches between centers of adjacent holes, standard pattern. In general, volume 282 is an expansion chamber. Also, because of packing 286 and perforated wall 284, the region 285 will act as an absorptive attenuator and body shell damper, muffling mid-to-high frequencies, such as the 500 Hz octave band and higher.

Volume 282 preferably includes three subvolumes, volume 282*a*, volume 282*b*, and volume 282*c*. Volume 282*a* is defined between perforated section 267 of the inlet tube 245 and inner wall 284. In general, volume 282*a* functions as an expansion chamber with a broad-band attenuation. Volume 282*b* is the volume in the space between end 272 of the outlet 275 and end 253 of the inlet tube 245, and the inner wall 284. Volume 282*b* also generally functions as an expansion chamber with attenuation. Volume 282*c* is the volume defined between end 272 of outlet 275, baffle 280, and inner wall 284. Volume 282*c* generally functions as a stagnant air column. That is, there is no net air flow in volume 282*c*. Volume 282*c* attenuates effectively in narrow frequency bands centered about frequencies defined by odd multiples of the frequency whose wave length is four times the length of the stagnant air column.

Extension 276 generally includes three portions: bell 290, diverging section 291; and cylindrical section 292. In preferred embodiments, the cylindrical section 292 and diverging section 291 are generally integral, with one another with bell 290 comprising a second piece secured to throat 291*a* of diverging section 291 as shown. Preferably in region 294, diverging section 291 and cylindrical section 292 are perforated. Also, preferably in section 295 throat section 291 is solid; and, in region 296, cylindrical section 292 is solid.

In general, extension 276 is secured to central baffle 280 and solid region 295.

Attention is now directed to cylindrical section 292 of extension 276. In the example illustrated, surrounding a portion of cylindrical section 292 is provided a packing annulus 298 defined by an outer wall 299 spaced from cylindrical section 292 to define an annular volume 300 which, preferably is filled with a packing, or filling, or padding 305 (preferably a fibrous packing such as fiberglass as characterized above in connection with other embodiments). Section 292, when annulus 298 contains packing 305, acts as an absorptive attenuator and muffles mid to high frequencies, such as the 500 Hz octave band and higher. In general, outer wall 299 is secured to central baffle 279 at aperture 301. In this manner, extension 276 is secured in position by baffle 280.

Outlet tube construction 275 preferably defines slots 288 for aiding in the connection to other conduits in the exhaust system. Slots 288 are analogous to slots 42 in FIG. 2.

As a result of the construction described, the embodiment of FIG. 4 includes single (outer) wall volume 302 divided into sub-volumes 303 and 304. Preferably, sub-volume 303 is an expansion-can resonator tuned for peaks at 200, 625, and 815 Hz. Preferably, sub-volume 304 is an expansion-can resonator tuned for attenuation peaks at 450 Hz and 815 Hz.

F. The Embodiment of FIG. 5

Figure 5:
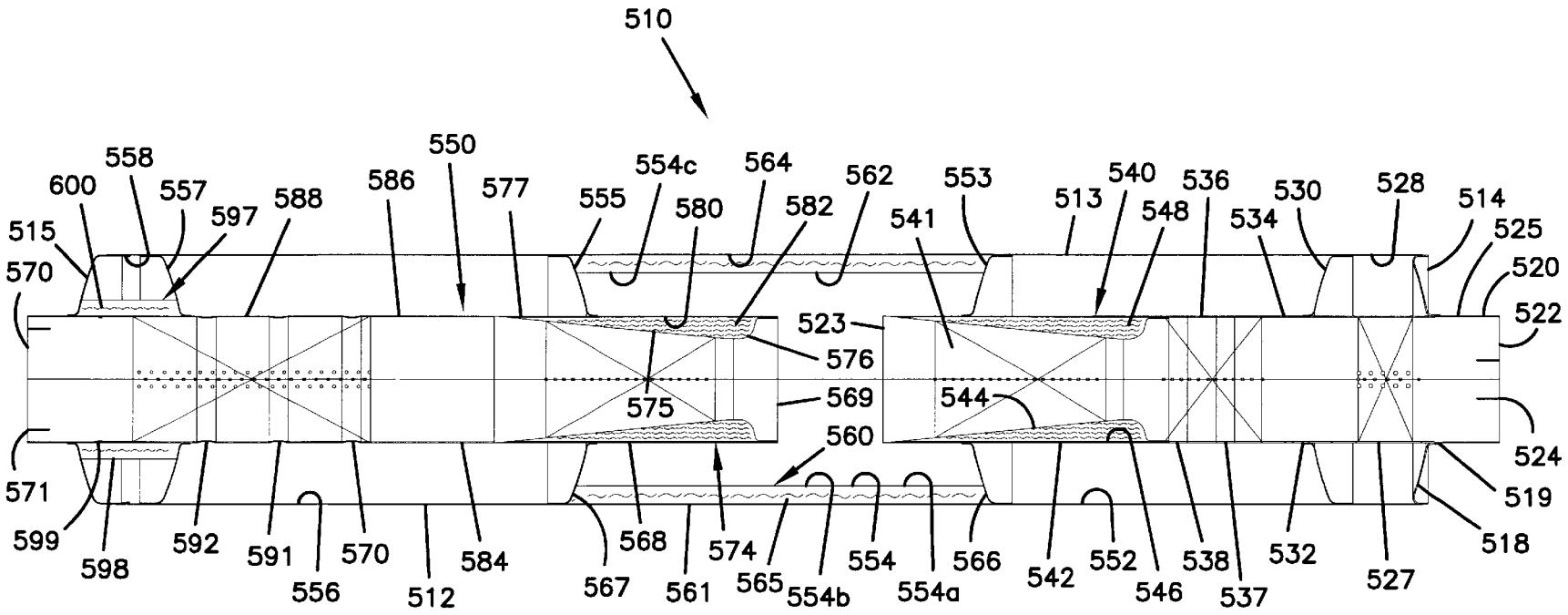
FIG. 5 is a schematic, cross-sectional view of a fourth embodiment of a muffler arrangement, according to principles of the present invention.

Referring to FIG. 5, another embodiment of an improved muffler is generally indicated at reference numeral 510. The muffler 510 includes an outer casing, shell or body 512 with an outer wall 513 having first and second opposite ends 514 and 515; the longitudinal distance between ends 514 and 515 preferably being less than 56 inches (about 142 cm), most preferably about 55 inches (about 140 cm).

The muffler 510 includes inlet baffle 518 at end 514. The inlet baffle 518 preferably is a solid baffle having central aperture 519 therein. The inlet tube 520 is secured within central aperture 519, for example, by welding.

The inlet tube 520 includes first end 522 and second end 523. Inlet tube 520 preferably defines slots 524, analogous to slots 22 in FIG. 2. The inlet tube 520 generally includes a solid section 525 adjacent to first end 522. The inlet baffle 518 is secured to the inlet tube 520 within solid section 525.

In the example illustrated, inwardly toward second end 523 from solid section 525, inlet tube 520 includes perforated section 527. Perforated section 527 allows for expansion of sound and gases into volume 528. Volume 528 is preferably defined between wall 513 of shell 512 and inlet tube 520. In the specific embodiment shown, it is contained on opposite ends or sides by inlet baffle 518 and central baffle 530. Note that the preferred central baffle 530 is solid. However, it may also be perforated. Central baffle 530 includes central aperture 532 therein. Inlet tube 520 is secured to central aperture 532, for example, by welding, at section 534. Preferably, section 534 is a solid section. In general, volume 528 comprises an expansion-can resonator.

Between section 534 and second end 523, inlet tube 520 is preferably perforated, having perforated section 536. Perforated section 536 preferably includes anti-whistle beads 537, 538.

Generally, between perforated section 536 and second end 523 is throat section 540. Throat section 540 preferably includes an outer wall 542, and an inner, perforated wall 544. Inner wall 544 is spaced from and angled relative to outer wall 542, such that inner wall 544 slants toward outer wall 542 and meets it at second end 523. Outer wall 542 and inner wall 544 define an annular space 546 therebetween. Preferably, in annular space 546 is packing material 548. Packing material 548 may be analogous to packing material 59 described above with respect to FIG. 2. When arranged in muffler 510 with packing 548, annular space 546 functions as an absorptive attenuator. That is, it operates to muffle mid-to-higher frequencies. Typical frequencies muffled are at least the 500 Hz octave band and higher.

As mentioned above, inner wall 544 is preferably perforated. More preferably, it is perforated in a standard 3/16 inch pattern.

The remainder of muffler 510 generally comprises two principal units: outlet tube construction 550; and features defined with respect to the outer shell 512.

For the preferred arrangement shown, the interior volume of shell 512 is separated into at least four major volumes: (a) volume 528, located immediately adjacent to end 522; (b) volume 552, located between baffle 530 and baffle 553; (c) volume 554, located between baffle 553 and baffle 555; (d) volume 556, located between baffle 555 and baffle 557; and (e) volume 558, located toward end 515.

Volume 554 is located between baffles 553 and 555. Volume 554 preferably is a double-walled volume. That is, in volume 554, outer shell 512 has a double-wall construction 560, comprising outer wall 561 and inner wall 562. Alternatively stated, volume 554 is circumferentially bounded by a double-wall construction 560. Preferably, inner wall 562 comprises a perforated wall, perforated in a pattern as described above with respect to reference number 57 in FIG. 2.

In the illustrated embodiment, an annular volume 564 is defined between inner wall 562 and outer wall 561. Preferably, the annular volume 564 is filled with packing 565. Generally, packing 565 may be the same type packing described above, with respect to reference numeral 59 in FIG. 2.

Preferably, annular volume 564 is 0.25–1 inch, typically about 3/8 inches thick. That is, preferably, the cross-sectioned dimension (diameter) of wall 562 is about 0.5–2 inch, typically about 0.75 inches smaller than a cross-sectional dimension (diameter) of outer wall 561.

It should be noted that double-wall construction 560 is preferably spaced from first end 514. Preferably, it is spaced about 15–20 inches, generally about 18 inches, from first end 514; and about 16–21 inches, generally about 19 inches, from second end 515. In certain preferred constructions, opposite ends 566, 567 of double-wall construction 560 are spaced about evenly from respective ends 514, 515 of muffler 510. Preferably, double-wall construction 560 occupies at least 20%, no more than about 50%, generally 28–38%, and preferably about 33% of the overall axial length between first end 514 and second end 515 of muffler 510.

Double-wall construction 560, when arranged in muffler 510 with packing 565, acts as an absorptive attenuator and body shell damper. That is, it operates to muffle mid-to-higher frequencies, e.g. at least 500 Hz octave band and higher.

Attention is now directed to outlet tube 550. Outlet tube 550 has an outer wall 568 which preferably extends between a first end or inlet end 569 and a second end or outlet end 570. Note that near outlet end 570, outlet tube 550 preferably defines slots 571 to aid in connection and clamping with other conduits in the exhaust system.

Still referring to FIG. 5, outlet tube 550 adjacent to first end or inlet end 569, preferably includes throat section 574. In throat section 574, an interior surface 575 is provided which tapers downwardly in dimension (diameter) in extension toward throat 576 from point 577.

In general, throat section 574 operates as a convergent-divergent duct or sonic choke.

Interior surface 575 preferably is perforated. More preferably, it is perforated in the pattern as described above with respect to reference numeral 57, FIG. 2. Between interior surface 575 and outer wall 568 is an annular space 580. Annular space 580 is filled with packing material 582, such as that described above for packing material 59, FIG. 2.

Outlet tube 550 preferably includes, immediately adjacent throat section 574, and extending from throat section 574 to outlet end 570, extension section 584. Extension 584 preferably includes a solid section 586 and a perforated section 588. Perforated section 588 preferably includes anti-whistle beads 590, 591, 592.

Outlet tube 550 includes, surrounding extension section 584 and securing the same in place, interior baffle 557. Interior baffle 555 also secures outlet tube 550 in place, and is secured around throat section 574.

For the embodiment shown, each of baffles 530, 553, 555, and 557 is solid, i.e., non-perforated. However, each of the baffles may also be perforated. Baffle 555 is positioned around throat section 574, separating throat section 574 from extension section 584.

In the preferred arrangement shown, volume 554 includes three subvolumes, volume 554*a*, volume 554*b*, and volume 554*c*. Volume 554*a* is defined between: perforated section 541 of the inlet tube 520, inner wall 544, baffle 553, and end 523 of inlet 520. Volume 554*a* functions as an expansion chamber with broad-band attenuation. Volume 554*b* is the volume in the space between end 569 of the outlet 550 and end 523 of the inlet tube 520, and the inner wall 544. Volume 554*b* also functions as an expansion chamber with broad-band attenuation. Volume 554*c* is the volume defined between end 569 of outlet 550, baffle 555, and inner wall 544. Volume 554*c* functions as a stagnant air column. That is, there is no net air flow in volume 554*c*. Volume 554*c* attenuates effectively in frequency bands centered about frequencies defined by odd multiples of the frequency whose wavelength is four times the length of the stagnant air column.

Volume 556, between baffles 555 and 557 is preferably an expansion chamber and acts as a resonator for broad band frequency attenuation.

Volume 558, between baffle 557 and 515 is an expansion-can resonator, tuned for muffling higher frequencies.

Still in reference to FIG. 5, note that outlet tube 550 includes a double-walled construction 597 adjacent to the outlet end 570. Double-walled construction 597 includes an outer wall 598 circumscribing outlet tube portion 599. Wall 598 is preferably spaced from outlet tube portion 599 by a distance between about 0.25 inch–1 inch, typically about 3/8 inch. In the annular recess defined by the space between wall 598 and wall of outlet tube region 599 is a packing material 600. Packing 600 may comprise a fiberglass material, as described previously. Double-walled construction 599 provides absorption-type attenuation. It muffles frequencies in the mid-to higher ranges, such as about 500 Hz octave band and higher. As can be seen in FIG. 5, double-walled construction 597 is oriented in and extends between baffle 557 and second end 515. As such, the preferred embodiment of FIG. 5 includes four regions of packing; an outermost region pressed against the outer wall or shell, and three regions of packing spaced from the outer wall or shell and pressed against the inlet tube, and the outlet tube. Walls 597 and 598 are each perforated in a standard pattern, as described above for wall 57 (FIG. 2).

G. Achievement of Advantageous Sound Attenuation

Constructions as described herein, and techniques generally presented, are useable to achieve preferred muffler constructions. Preferred muffler constructions can be generally characterized with respect to the type and manner of sound attenuation or acoustical performance achieved during: (1) positive power operation; (2) operation during compression brake-type engine retarder performance; and/or, both.

Performance of a muffler under these circumstances can, for example, be generally characterized into each of three overall manners:

(1) overall measured sound pressure level A-scale;

(2) sound pressure level A-weighted defined with respect to various octave bands; and, (3) sound quality.

In general, sound pressure level (A-weighted) is the acoustical pressure level the ear senses during operation. It is generally measured in decibels (dba) which are units of measurement for sound pressure level. Specifically, the equation for sound pressure measured in decibels is $20\times\log(\text{pressure}/(2\times10^{-5}))$. The log is log base 10 and the pressure is measured in Pascals. In the experimental section below, a laboratory technique for measuring overall sound pressure level is presented. It will be understood from the description that the technique described, in general, involves application of standard measuring equipment (namely a type 1 sound level meter, such as a Brule and Kjaer meter) applied in circumstances in which the muffler is isolated to avoid measurement of noise from other or extraneous sources.

It has also been found useful to evaluate sound pressure level with respect to various octave bands. An octave band is a frequency range. For each octave band or frequency band, the number given as the defining frequency for the band is generally the center frequency of the band. The unit of measurement used herein with respect to octave bands is hertz (Hz). In general, the width of each frequency band is about two times the width of the previous (lower) band. More specifically, the width is defined by a lower end and a higher end. The lower end is equal to the center of frequency divided by the square root of 2. The higher end is equal to the center of frequency times the square root of 2.

The techniques described in the experimental section below provide straight-forward methods for measuring sound pressure level as a function of frequency or octave band. Evaluating noise on the basis of octave band is a useful technique to evaluate the nature of the noise and to determine how the noise can be attenuated. In general, techniques which are applicable to attenuate low frequency noise are not necessarily efficient or productive when applied to attenuate higher frequency noise.

A number of factors have been utilized in the acoustics field to characterize sound quality. Three characteristics often referenced, and used herein with respect to characterization of sound quality are: loudness; roughness; and, sharpness.

The characteristic of loudness is the level attribute of the sound. In general, sounds are ordered from soft to loud. Equal changes in sound pressure do not necessarily correspond with equal changes of loudness level.

The concept of loudness level was originally introduced by Barkhausen in the 1920's. In general, the definition of loudness level is the sound pressure level of a 1 kilohertz (1000 Hz) tone that is as loud as the sound. The unit of measurement is called the "phon".

In general, for persons with normal hearing, the threshold of loudness at the low end, i.e. quiet, is about the 3 phon level, and the threshold of pain is at around 120 phon.

Another way to look at loudness is that it is an effort to relate the sensation stimulus to a known standard sound by asking subjects how much louder or softer a test sound is. The approach allows subjective loudness to be placed on a linear scale. Loudness measurement is based on the equal-loudness contours for pure tones for the human ear.

Sharpness is the ratio of high frequency levels to overall level. For narrow band sounds, sharpness increases with increasing frequency. For broad band sounds, sharpness increases with increasing high frequency spectral content.

In general, sharpness is an integration of specific loudness multiplied by a weighting function, divided by total loudness. In general, sharpness is normalized to a reference sound, specifically a narrow band of noise centered at 1 kilohertz at a level of 60 dba and a band width of 160 Hz, which has an agreed or set value of 1 acum.

Roughness is created by quick changes produced by amplitude modulation in the region between 15 Hz to 300 Hz. Frequency modulation has also been shown to indicate roughness. Roughness is at its maximum at an amplitude modulation frequency of 70 Hz. In general, sounds which contain amplitude modulations over 20 Hz are considered to be rough sounding. However, the sensation of roughness is not limited to true modulating sounds. Noises (broad band and narrow band) are also perceived as rough due to the random nature of the envelope. In general, the parameters important to roughness are the degree of amplitude modulation (AM) and the frequency modulation index (FM). The reference sound for roughness, for the algorithm used herein, is at 1 kilohertz tone at 60 decibel and 100% amplitude modulation at 70 hertz. This reference has been assigned the sound roughness of 1 asper.

In general, roughness is generated by sounds that contain: tones spaced within a critical band; amplitude modulated tones; frequency modulation; and/or narrow-band noise. Sensitivities to roughness peak at approximately 70 hertz modulation. For center frequencies at and above 1 kilohertz, peak roughness sensation occurs at 70 hertz. For center frequencies below 1 kilohertz, the peak roughness is dependent upon the width of the critical band.

Further information regarding the sound qualities of loudness, sharpness, and roughness are in the book Psychoacustics by Zwicker and H. Fastl.

From the experimental descriptions below, especially in association with the specific muffler configurations described and presented with respect to FIGS. 2–6, it is apparent that the techniques described above can be used to achieve specific, desirable, levels of sound attenuation in trucks. General characterizations of these desirable sound attenuations are described below.

Consider a truck having a Detroit Diesel Series 60 engine rated for operation at a power of at least 500 hp at 2100 rpm; and having a compression brake-type engine retarder such as a Jake Brake® engine retarder. Such a truck will generally have an exhaust muffler system including at least one vertical muffler, in some instances two vertical mufflers. For typical operation, each muffler of the muffler system will be generally cylindrical and have an outside diameter of no greater than about 11 inches; and, an overall outer shell length of no greater than about 60 inches. Typically, each muffler will have an outer diameter of about 10 inches and a length of no greater than about 55 inches; and specifically, about 45 inches in some instances.

Based on the experiments conducted (which are described more fully below in Section J), when a typical prior art engine system, for example of the type characterized above, is evaluated for sound attenuation using a single, standard, muffler, (for example, the Donaldson M100580 muffler) vertically oriented, the following generalizations would be observed:

1. The overall sound pressure level (SPL) will be observed to be at least 68 dba or more (typically 70 dba or more) at positive power operation, and generally at least 15 dba (typically about 19.5 dba) less than straight pipe.

2. The overall sound pressure level will be observed to be greater than 75 dba, and indeed will typically be greater than 80 dba under braking operation.

3. The overall sound pressure level during braking will typically be about 20–22 dba less than straight pipe, during braking.

4. As a function of various octave bands[1], the sound pressure levels (SPL) will typically be observed to be as follows:

[1] Octave band data taken from positive power or braking and identified as "peak" was derived from the point that defines the peak average overall sound pressure level for that test run.

| | SPL (dba) | |
|---|---|---|
| Octave Band Hz | Positive Power[2] (Peak) | Braking (Peak) |
| 63 | >58, <63 | >50, <55 |
| 125 | >58, <63 | >60, <65 |
| 250 | >55, <59 | >62, <67 |
| 500 | >60 <65 | >71, <76 |
| 1,000 | >55, <60 | >69, <75 |
| 2,000 | >60, <65 | >73, <80 |
| 4,000 | >60, <65 | >70, <76 |
| 8,000 | >55, <60 | >68, <74 |

5. The sound quality (during braking) will typically be found to be as follows:

(a) loudness (phon)>98.5, indeed>99.5 would be typical.

(b) roughness (asper)>4.5, usually>5.0, 5.2 would be typical.

(c) sharpness (acum)>4.0, >4.4, indeed>4.9 would be typical.

When the similar type of standard muffler (Donaldson M100582) is used in a dual vertical muffler system, for example with a Detroit Diesel Series 60 truck engine rated at 500 hp at 2100 rpm, the following trends and conclusions would typically be observed:

1. The overall sound pressure level would typically be at least 65 dba, indeed typically at least 68 dba, at positive power operation.

2. The overall sound pressure level would typically de greater than 78 dba, and indeed would typically de at least about 80.5 dba, under braking operation.

3. As a function of the various octaves, the sound pressure levels, measured at overall SPL level point, would typically be as follows:

| | SPL (dba) | |
|---|---|---|
| Octave Band Hz | Positive Power (Peak) | Braking (Peak) |
| 63 | >48, <52 | >48, <52 |
| 125 | >48, <53 | >51, <57 |
| 250 | >51, <56 | >57, <65 |
| 500 | >58, <63 | >68, <73 |
| 1,000 | >57, <64 | >68, <75 |
| 2,000 | >60, <65 | >72, <80 |
| 4,000 | >56, <63 | >70, <75 |
| 8,000 | >50, <55 | >64, <70 |

4. The sound quality (during braking) would typically be found to be as follows:

(a) loudness (phon)>94.5, indeed>97.2 would be typical.

(b) roughness (asper)>3.0 usually>3.2, indeed>3.5 would be typical.

(c) sharpness (acum)>3.5, usually>3.8, indeed>4.0 would be typical.

When various preferred, improved, mufflers as characterized herein are similarly applied and evaluated, the following trends and conclusions will typically be observed (under single vertical muffler evaluation):

1. The overall sound pressure level would be observed to be less than 70 dba under positive power operation. Indeed it will generally be less than 69 dba, and in some instances would be less than 68 dba. The overall sound level will generally be at least 1 dba less (typically at least 1.5–3.5 dba less) than a similar system with a standard muffler, and at least 20 dba less than a straight pipe system, during positive power operation.

2. The overall sound pressure level would be observed to be less than 80 dba, and to generally be less than 75 dba under braking operation. Indeed in some instances it will be about 74 dba or less. In general, the overall sound pressure level will be at least 5 dba, and typically at least 7–9 dba less than a standard muffler, and at least 25 dba less than a straight pipe system, during braking.

3. As a function of the various octaves, the sound pressure levels (as measured at peak overall SPL point) will typically be as follows:

| | SPL (dba) | |
|---|---|---|
| Octave Band (Hz) | Positive Power (Peak) | Braking (Peak) |
| 63 | >50, <69 | >52, <62 |
| 125 | >57, <65 | >62, <69 |
| 250 | >47, <60 | >56, <67 |
| 500 | >47, <65 | >58, <68 |
| 1,000 | >48, <60 | >59, <69[1] |
| 2,000 | >50, <59 | >58, <69[3] |
| 4,000 | <58 | >60, <69[2] |
| 8,000 | <55 | >52, <63 |

1. Typically≦68, usually 67 dba or less, and in some instances, 65 dba or less.

2. Typically≦68, usually 67.5 dba or less, and in some instances, 66 dba or less.

3. Typically, ≦68, usually 67 dba or less, and in some instances, 66 dba or less.

Some comparative values would typically be as follows:

| Octave Band (Hz) | Comparison of Typical Preferred Mufflers and Typical Standard Mufflers (dba) During Braking (SVV) |
|---|---|
| 250 | no more than 3 dba higher for preferred muffler, typically no more than 1 dba higher, if higher at all |
| 500 | generally at least 5 dba lower, typically at least 10 dba lower, in some instances at least 11 dba for preferred mufflers |
| 1,000 | at least 2 dba lower, generally at least 4 dba lower, and in some instances at least 6 dba lower for preferred mufflers |
| 2,000 | at least 5 dba lower, generally at least 7 dba lower, and in some instances at least 10 dba lower, for preferred mufflers |
| 4,000 | at least 5 dba lower, generally at least 7 dba lower, and in some instances at least 8 dba lower, for preferred mufflers |
| 8,000 | at least 6 dba lower, generally at least 10 dba lower, and in some instances at least 11 dba lower, for preferred mufflers |

| Octave Band (Hz) | SPL (dba) Comparison Between Typical Preferred Mufflers and Straight Pipe During Braking (SVV) |
|---|---|
| 500 | at least 26 dba lower, generally or at least 33 dba lower and typically at least 35 dba lower, for preferred mufflers |
| 1000 | at least 25 dba lower, typically at least 28 dba lower and in some instances at least 30 dba lower, for preferred mufflers |
| 2000 | generally at least 27 dba lower, typically at least 29 dba lower and in some instances at least 31 dba lower, for preferred mufflers |
| 4000 | generally at least 18 dba lower, typically at least 20 dba lower and in some instances at least 23 dba lower, for preferred mufflers |
| 8000 | at least 18 dba lower, typically at least 22 dba lower and in some instances at least 23 dba lower, for preferred mufflers |

4. The sound quality (during braking) for improved preferred, mufflers would typically be found to be as follows:

(a) loudness (phon)<100, generally,<98, and typically<95. As compared to the standard muffler used me engine, the loudness would typically be less than a standard muffler by at least about 4 phons. As to a straight pipe used on the same engine, the would typically be less by at least 20 phons.

(b) roughness (asper)<3.5, generally<3.0 and indeed<2.5 will typically be found. As compared to a standard muffler used on the same engine, the roughness will typically be less by at least 2 aspers. As compared to a straight pipe used on the same engine, the roughness will typically be less by at least 14 aspers.

(c) sharpness (acum)<4.3; generally<4.0 and, indeed, specifically<3.8 will typically be found. As compared to a standard muffler used on the same engine, the sharpness will typically be less by at least 1 acum. As compared to a straight pipe used on the same engine, the sharpness will typically be less by at least 3 acums.

In addition, when certain specific, preferred, mufflers according to the present disclosure are evaluated in single, vertical muffler applications, the following will typically be also observed:

1. During operation of the compression brake-type engine retarder (braking), at each of the following octave bands the sound pressure level will typically be measured to be no more than 5 dba greater than the sound pressure level measured for the same system at 125 Hz: 1,000 Hz; 2,000 Hz; 4,000 Hz; and 8,000 Hz. Indeed in certain preferred systems it will typically not be more than 2 dba higher, at each of the identified frequencies.

2. The measured value during braking, in dba, at the 500 Hz octave band will typically be no more than about 10 dba higher (and indeed no more than about 9 dba higher) than the measured value, in dba, for the sound pressure level at the 500 Hz octave band, for the same system when measured under positive power operation.

3. The measured value during braking, in dba, at the 1,000 Hz octave band will typically be no more about 15 dba higher (and indeed in certain preferred arrangements no more than about 9 dba higher) than the measured value, in dba, for the sound pressure level, at the 1,000 Hz octave band, for the same system when measured under positive power operation.

4. The measured value during braking, in dba, at the 2,000 Hz octave will typically be less than 15 dba higher than the measured value, in dba, for the sound pressure level, at the 2,000 Hz octave, for the same system when measured under positive power operation. Indeed in certain preferred systems it will typically be no more than 13 dba higher.

5. The sound pressure level measured during braking, at each one of the following octave bands, will typically be less than 12.5 dba greater, and indeed often less than 8 dba greater, than the sound pressure level measured during braking at each of the other ones of the following identified octaves: 125 Hz; 250 Hz; 500 Hz; 1,000 Hz; 2,000 Hz; and 4,000 Hz.

When preferred improved mufflers as characterized herein are applied and evaluated in the laboratory in dual muffler applications, the following trends and conclusions will typically be observed:

1. The overall sound pressure level will typically be observed to be less than 70 dba under positive power operation. Indeed, it will typically be less than 68 dba. The overall sound level will generally be at least 1 dba less (typically at least 1.5–3.5 dba less) than a similar system with standard mufflers, and at least 20 dba less than a straight pipe system, during positive power operation.

2. The overall sound pressure level will typically be observed to be less than 80 dba, and generally less than 75 dba under braking operation. Indeed, it will typically be less than 73 dba during braking. In general, the overall sound pressure level will be at least 5 dba, and typically at least 7–9.0 dba, less than standard mufflers, and at least 25 dba less than a straight pipe, during braking.

3. As a function of the various octaves, the sound pressure levels, as measured at peak overall sound pressure level point, will typically be as follows:

| Octave Band (Hz) | SPL (dba) Positive Power (Peak) | Braking (Peak) |
|---|---|---|
| 63 | >50 <55 | >52, <59 |
| 125 | >52, <59 | >58, <65 |
| 250 | >52, <59 | >58, <65 |
| 500 | >55, <63 | >60, <68 |
| 1,000 | >57, <63 | >58, <68[1] |
| 2,000 | >53, <60 | >58, <69[3] |
| 4,000 | <55 | >58, <67[2] |
| 8,000 | <55 | <60, |

1. Typically less than 67 dba, and usually less than 65 dba.
2. Typically, no greater than 69 dba, and usually less than 65 dba.
3. Typically less than 67 dba, and usually less than 66 dba.

Typical comparative values would be as follows:

| Octave Band (Hz) | Difference Between Typical Preferred Muffler and Typical Standard Mufflers (dba) During Braking (DVV) |
|---|---|
| 500 | at least 2 dba lower, typically at least 4 dba lower for preferred muffler |
| 1,000 | at least 5 dba lower, typically at least 9 dba lower for preferred muffler |
| 2,000 | at least 7 dba lower, typically at least 9 dba lower for preferred muffler |
| 4,000 | at least 7 dba lower, typically at least 9 dba lower for preferred muffler |

| Octave Band (Hz) | SPL (dba) Difference Between Typical Preferred Muffler and Straight Pipes During Braking (DVV) |
|---|---|
| 500 | at least 25 dba lower, typically at least 33 dba lower, for preferred mufflers |
| 1,000 | at least 25 dba lower, typically at least 33 dba lower, for preferred mufflers |
| 2,000 | at least 18 dba lower, typically at least 22 dba lower, for preferred mufflers |
| 4,000 | at least 25 dba lower, typically at least 30 dba lower, for preferred mufflers |

4. The sound quality (during braking) will typically be found to be as follows:

(a) loudness (phon)<100, generally<95. As compared to standard mufflers on the same system, the loudness will typically be less than the standard mufflers by at least 3 phons. As compared to straight pipes in the same system, the loudness will typically be less by at least 20 phons.

(b) roughness (asper), 3.5, generally<3.0, and typically<2.0, and indeed will typically be found to be<1.5. As compared to standard mufflers on the same system, the roughness will typically be less than the standard mufflers by at least about 2 aspers. As compared to straight pipes on the same system, the roughness will typically be less by at least 12 aspers.

(c) sharpness (acum)<4.3, generally<4.0, typically<3.5; and, indeed will typically be found to be <3.0. As compared to standard mufflers on the same system, the sharpness will typically be less than the standard muffler by at least about 1 acum. As compared to a straight pipe on the same system, the sharpness will typically be less by at least about 3 acums.

In addition, when preferred mufflers as described herein are applied in a dual vertical muffler applications, and evaluated in the laboratory, the following will typically be observed:

1. During operation of the compression brake-type engine retarder at each of the following octave bands the sound pressure level will typically be measured to be no more than 6 dba greater than will the sound pressure level measured (during braking) for the same system at the 125 Hz octave band: 250 Hz; 500 Hz; 1,000 Hz; 2,000 Hz; and 4,000 Hz.

2. The measured value during braking, in dba, at the 500 Hz octave will typically be no greater than about 10 dba higher (and indeed typically no greater than about 9 dba higher) than the measured value, in dba, for the sound pressure level at the 500 Hz octave band for the same system measured during positive power operation.

3. The measured value during braking, in dba, at the 1,000 Hz octave band will typically be no greater than about 5 dba higher, and indeed, will generally be no greater than about 4 dba higher, than the measured value, in dba, for the sound pressure level, at the 1,000 Hz octave, for the same system during positive power operation.

4. The measured value during braking, in dba, at the 2,000 Hz octave band will typically be less than 12 dba higher (and indeed will generally be less than 11 dba higher) than the measured value, in dba, for the sound pressure level, at the 2,000 Hz octave, for the same system during positive power operation.

5. The sound pressure level measured, during braking, at each one of the following octaves will typically be less than 10 dba higher, and indeed will generally be less than 8 dba higher, than the sound pressure level measured at each one of the other ones of the following identified octave bands also measured during braking: 125 Hz; 250 Hz; 500 Hz; 1,000 Hz; 2,000 Hz; and, 4,000 Hz.

6. The sound pressure level measured, during braking, at each one of the following octaves will typically be less than 7 dba higher (and indeed less than 5 dba higher,) than the sound pressure level measured, during braking, at each of the other ones of the following identified octave bands: 500 Hz; 1,000 Hz; and 2,000 Hz.

RESULTS AND DISCUSSION

In general, then, selected, preferred, improved mufflers according to the present invention address the following objectives:

1. Reduction in braking noise levels (SPL) to closer to positive power levels (SPL), in order to reduce indication of brake operation through the presence of higher sound pressure levels.

2. Reduction in the "bark" or "staccato" noise signature associated with braking operations.

3. Achievement of muffler designs close to or similar to, normal, conventional, mufflers in: size, weight, back-pressure limits, and, positive power sound pressure level attenuation.

4. Reduce shell noise (drumming) especially in the expansion chamber of the muffler.

In general, the tests have shown that a complete reduction of braking noise to that of positive power has not yet been achieved in the size and weight limits imposed. However, as described below, in actual "on truck" tests with the preferred muffler designs it was shown that the design reaches sound pressure levels (braking) within about 0.5 to 2 dba of positive power levels. The difference varies depending on the truck tested, with louder trucks (exhaust noise excluded) having a smaller braking to positive power noise dba difference than quieter trucks. The "bark" was still somewhat noticeable during the testing on actual trucks, but it was greatly reduced as compared to standard mufflers. Indeed the sound quality measurements showed very substantial improvement. These "on-truck" silencer tests also showed much improvement with respect to "bark" and sound quality, especially by comparison to standard mufflers.

From the above descriptions, it can be appreciated that one can improve the muffling performance of an engine equipped with an engine compression brake-type system by replacing a standard muffler with one of the muffler constructions, as disclosed herein.

H. Mechanical Characteristics of Preferred Constructions

In general, the following overall mechanical characteristics are found in many preferred embodiments of mufflers according to the present invention:

1. There is at least one portion of packing positioned in order to dampen shell drumming. Often, there is an outer layer of packing against the outermost wall of the muffler shell. In many embodiments, there is also an internal layer of packing spaced from the first region of packing and against one of the internal tube constructions. For example, in many embodiments, the second region of packing is against the outlet or outflow tube. In some embodiments, the second region of packing is against the downstream end of the inlet tube. In some embodiments, there is packing against both the inlet and outlet tubes, in addition to the first region of packing against the outer wall of the muffler shell.

2. In many embodiments, the first region of packing against the outer wall or shell of the muffler is in the inlet region of the muffler. That is, in many embodiments, the first region of packing circumscribes the inlet tube, not necessarily the entire axial length of the inlet tube, but at least a portion of the axial length of the inlet tube. In many embodiments, the first region of packing circumscribes the most downstream end of the inlet tube.

3. In many embodiments, the first region of packing against the outermost wall or shell of the muffler extends an axial length of at least about 15% of the axial length of the outer wall. Indeed, in many preferred arrangements, the first region of packing extends a distance of at least 20% of the axial length of the outer wall. In many preferred arrangements, the distance is at least 25% or 30% of the axial length of the outer wall. In many preferred arrangements, the first region of packing extends no greater than about 75% of the axial length of the outer wall. Indeed, in many preferred embodiments, the first region of packing extends no greater than about 60% or about 50% of the axial length of the outer wall.

4. In many embodiments, the first region of packing which is against the outermost wall or shell of the muffler is spaced a distance of at least 1 inch, and no greater than about 5 inches from the inlet end of the muffler. In many embodiments, this first region of packing is separated from the inlet end of the muffler by a resonator chamber. In many embodiments, the first region of packing is spaced at least 15 inches, and generally 20 inches from the outlet end of the muffler, but generally no greater than 40 inches, and typically no greater than 35 inches from the outlet end of the muffler.

5. Many embodiments of the mufflers lack moving parts. That is, all components (internal and external) are always stationary and do not move relative to each other.

In the next section, three specific, preferred constructions are characterized with respect to dimensions, materials and use.

I. Four Specific, Preferred Constructions

Figure 6:
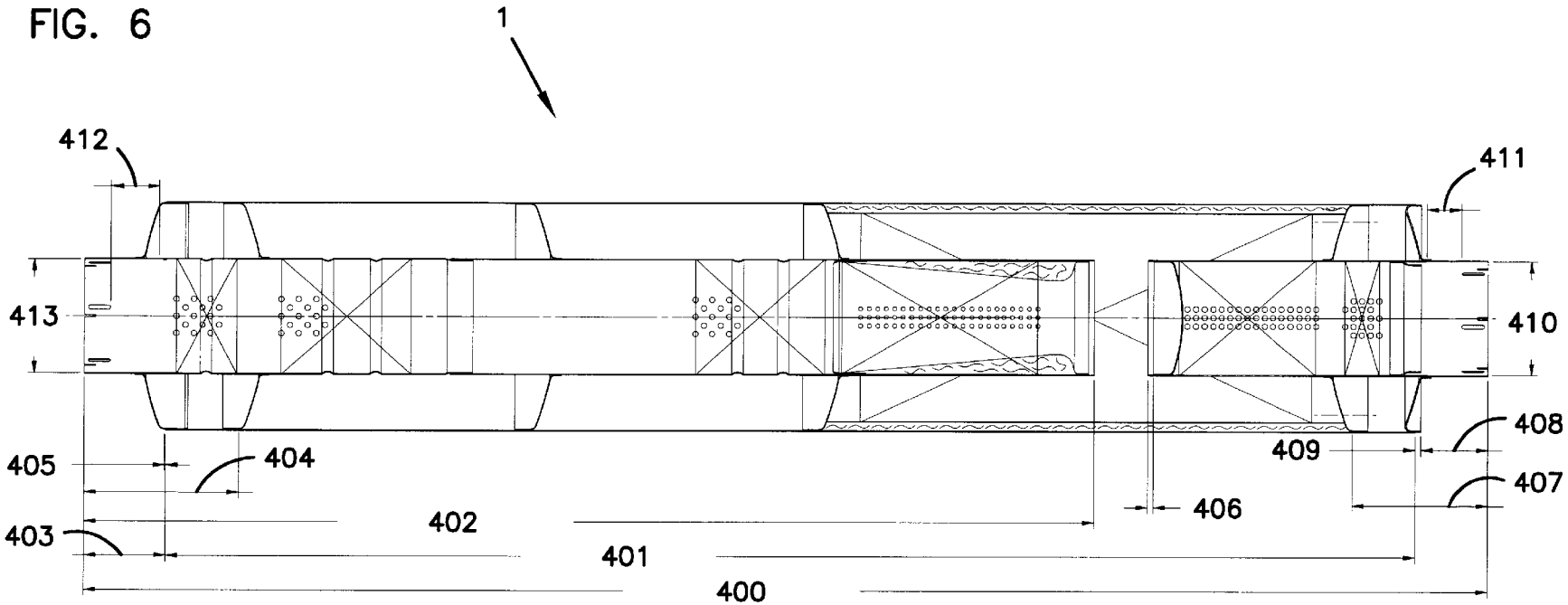
FIG. 6 is a schematic, cross-sectional view of the muffler arrangement depicted in FIG. 2, and defining certain preferred dimensions.

Attention is directed to FIG. 6. In FIG. 6, one preferred construction for muffler arrangement 1, as depicted in FIG. 2, is shown. In this section, specific constructions including dimensions and materials are described. Of course, many arrangements can be made, in accordance with principals of the invention as described herein. A table is presented below. In the table, there are reference numerals shown in the drawings. The reference numerals correspond with dimensions shown in FIG. 6. Next to the reference numerals, are typical, or preferred dimensions for the section corresponding with the dimensions shown in FIG. 6.

| Reference Number | Dimensions |
|---|---|
| 400 | No greater than about 1650 mm (about 65 inches); at least about 1500 mm (about 59 inches); preferably about 1562–1575 mm (about 61.5–62 inches); and more preferably about 1568 mm (about 61.75 inches). |
| 401 | No greater than about 1651 mm (about 65 inches); at least about 1219 mm (about 48 inches); preferably about 1346–1448 mm (about 53–57 inches); and more preferably about 1396 mm (about 55 inches). |
| 402 | No greater than about 1270 mm (about 50 inches); at least about 1016 mm (about 40 inches); preferably about 1124–1130 mm (about 44.25–44.5 inches); and more preferably about 1127 mm (about 44 inches). |
| 403 | No greater than about 127 mm (about 5 inches); at least about 51 mm (about 2 inches); preferably about 76–102 mm (about 3–4 inches); and more preferably about 90 mm (about 3.5 inches). |
| 404 | No greater than about 191 mm (about 7.5 inches); at least about 152 mm (about 6 inches); preferably about 165–178 mm (about 6.5–7 inches); and more preferably about 171 mm (about 6.75 inches). |
| 405 | No greater than about 6 mm (about 0.25 inches); and preferably about 1.5 mm (about 0.06 inches). |
| 406 | No greater than about 13 mm (about 0.5 inches); at least about 2 mm (about 0.06 inches); preferably about 3–10 mm (about 0.125–0.375 inches); and more preferably about 6.4 mm (about 0.25 inches). |
| 407 | No greater than about 178 mm (about 7 inches); at least about 127 mm (about 5 inches); preferably about 149–156 mm (about 5.9–6.1 inches); and more preferably about 152 mm (about 6 inches). |
| 408 | No greater than about 102 mm (about 4 inches); at least about 51 mm (about 2 inches); preferably about 74–79 mm (about 2.9–3.1 inches); and more preferably about 76 mm (about 3 inches). |

-continued

| Reference Number | Dimensions |
|---|---|
| 409 | No greater than about 13 mm (about 0.5 inches); at least about 3 mm (about 0.1 inches); and preferably about 6 mm (about 0.25 inches). |
| 410 | No greater than about 133 mm (about 5.25 inches); at least about 125 mm (about 4.9 inches); preferably about 127–128 mm (about 5.01–5.04 inches); and more preferably about 127.6 mm (about 5.025 inches). |
| 411 | No greater than about 51 mm (about 2 inches); at least about 32 mm (about 1.25 inches); preferably about 38–43 mm (about 1.5–1.7 inches); and more preferably about 40.4 mm (about 1.6 inches). |
| 412 | No greater than about 76 mm (about 3 inches); at least about 38 mm (about 1.5 inches); preferably about 51–57 mm (about 2–2.25 inches); and more preferably about 53 mm (about 2.09 inches). |
| 413 | No greater than about 133 mm (about 5.25 inches); at least about 125 mm (about 4.9 inches); preferably about 127–128 mm (about 5.01–5.04 inches); and more preferably about 127.6 mm (about 5.025 inches). |

The construction of the muffler of FIG. 6 was preferably made from the following materials: shell 3 comprises 0.032–0.073 inch thick aluminized steel; inner wall 57 comprises 0.032–0.073 inch thick aluminized steel; inlet tube 6 comprises 0.032–0.073 inch thick aluminized steel; outlet tube 7 comprises 0.032–0.073 inch thick aluminized steel; retaining construction 82 comprises 0.032–0.073 inch thick aluminized steel; baffle 9 comprises 0.032–0.073 inch thick aluminized steel; baffle 10 comprises 0.032–0.073 inch thick aluminized steel; baffle 105 comprises 0.032–0.073 inch thick aluminized steel; baffle 106 comprises 0.032–0.073 inch thick aluminized steel; and baffle 107 comprises 0.032–0.073 inch thick aluminized steel.

The packing at reference numerals 59 and 80 was a fiberglass mat and a single thickness of fiberglass cloth which is attached or layered to one side of the mat.

Figure 7:
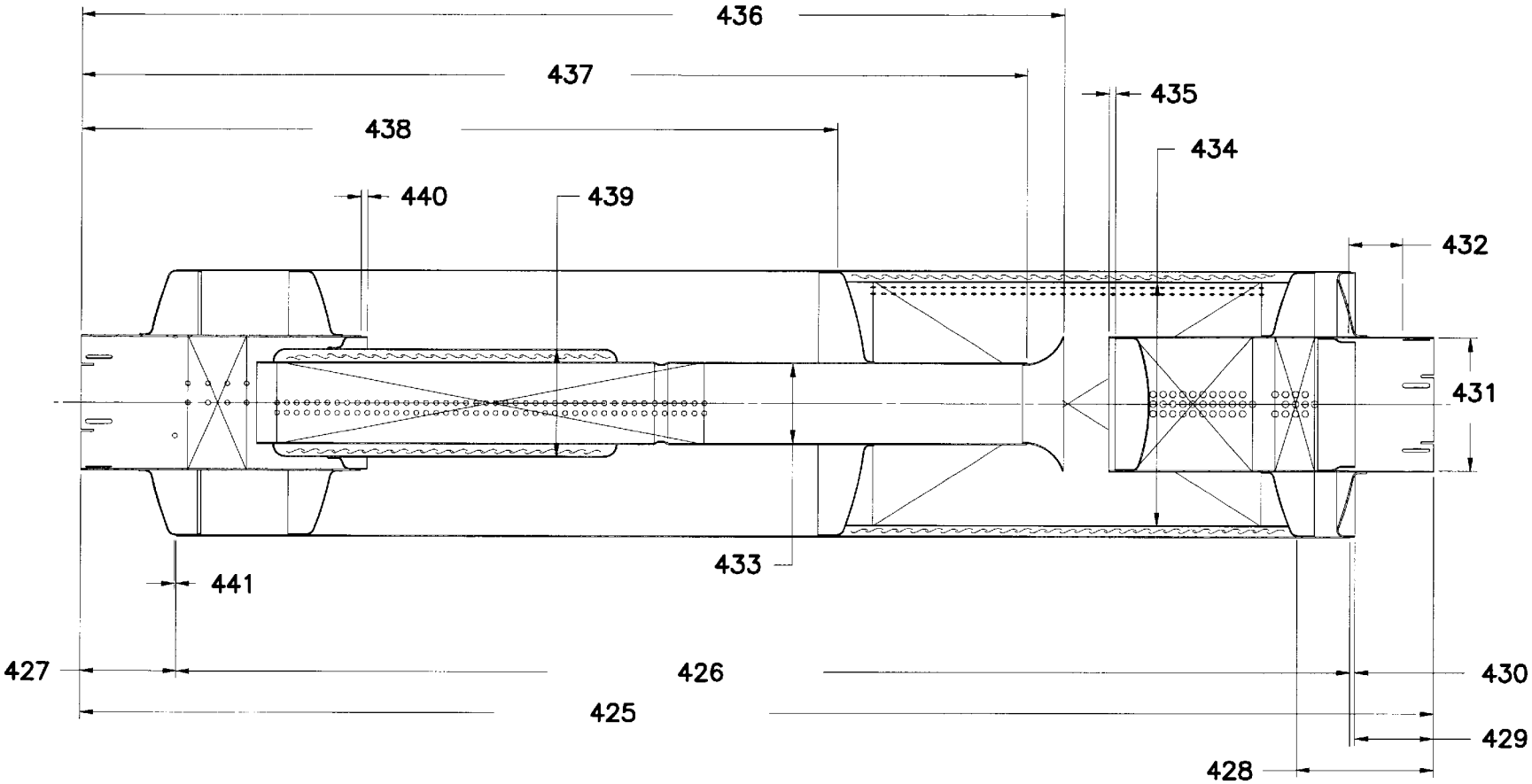
FIG. 7 is a schematic, cross-sectional view of the muffler arrangement depicted in FIG. 3, and defining certain preferred dimensions.

Attention is now directed to FIG. 7. In FIG. 7, the FIG. 3 embodiment is depicted with certain dimensions illustrated, analogous to those described above. The following table provides a correlation between the reference numerals shown in FIG. 7 and the dimensions indicated:

| Reference Number | Dimensions |
|---|---|
| 425 | No greater than about 1524 mm (about 60 inches); at least about 1143 mm (about 5 inches); preferably about 1245–1321 mm (about 49–52 inches); and more preferably about 1295 mm (about 51 inches). |
| 426 | No greater than about 1219 mm (about 48 inches); at least about 1067 mm (about 42 inches); preferably about 1117–1130 mm (about 44–44.5 inches); and more preferably about 1124 mm (about 44.25 inches). |
| 427 | No greater than about 127 mm (about 5 inches); at least about 76 mm (about 3 inches); preferably about 89–102 mm (about 3.5–4 inches); and more preferably about 90 mm (about 3.6 inches). |
| 428 | No greater than about 178 mm (about 7 inches); at least about 102 mm (about 4 inches); preferably about 127–133 mm (about 5–5.25 inches); and more preferably about 132 mm (about 5.2 inches). |
| 429 | No greater than about 102 mm (about 4 inches); at least about 50 mm (about 2 inches); preferably about 70–83 mm (about 2.75–3.25 inches); and more preferably about 76 mm (about 3 inches). |
| 430 | No greater than about 25 mm (about 1 inches); at least about 1 mm (about 0.05 inches); preferably about 2–8 mm (about 0.1–0.3 inches); and more preferably about 4.8 mm (about 0.2 inches). |
| 431 | No greater than about 133 mm (about 5.25 inches); at least about 125 mm (about 4.9 inches); preferably about 127–128 mm (about 5.01–5.04 inches); and more preferably about 127.6 mm (about 5.025 inches). |
| 432 | No greater than about 77 mm (about 3.0 inches); at least about 25 mm (about 1.0 inches); preferably about 48–58 mm (about 1.9–2.3 inches); and more preferably about 53 mm (about 2.1 inches). |
| 433 | No greater than about 102 mm (about 4.0 inches); at least about 63 mm (about 2.5 inches); preferably about 76–79 mm (about 3–3.1 inches); more preferably about 77 mm (about 3.02 inches). |
| 434 | No greater than about 280 mm (about 11.0 inches); at least about 203 mm (about 8.0 inches); preferably about 228–239 mm (about 9–9.4 inches); and more preferably about 234 mm (about 9.2 inches). |
| 435 | No greater than about 25 mm (about 1.0 inches); at least about 1 mm (about 0.05 inches); preferably about 2–10 mm (about 0.1–0.4 inches); and more preferably about 6.3 mm (about 0.25 inches). |
| 436 | No greater than about 1143 mm (about 45 inches); at least about 813 mm (about 32 inches); preferably about 914–965 mm (about 36–38 inches); and more preferably about 940 mm (about 37 inches). |
| 437 | No greater than about 965 mm (about 38 inches); at least about 838 mm (about 33 inches); preferably about 889–914 mm (about 35–36 inches); and more preferably about 904 mm (about 35.6 inches). |
| 438 | No greater than about 787 mm (about 31 inches); at least about 686 mm (about 27 inches); preferably about 711–737 mm (about 28–29 inches); more preferably about 723 mm (about 28.5 inches). |
| 439 | No greater than about 127 mm (about 5.0 inches); at least about 76.2 mm (about 3.0 inches); preferably about 96–109 mm (about 3.8–4.3 inches); and more preferably about 104 mm (about 4.1 inches). |

-continued

| Reference Number | Dimensions |
|---|---|
| 440 | No greater than about 18 mm (about 0.7 inches); at least about 1 mm (about 0.05 inches); preferably about 2–8 mm (about 0.1–0.3 inches); and more preferably about 6.4 mm (about 0.25 inches). |
| 441 | No greater than about 5 mm (about 0.2 inches); at least about 0.1 mm (about 0.005 inches); preferably about 0.2–2.5 mm (about 0.01–0.1 inches); and more preferably about 1.5 mm (about 0.06 inches). |

The construction of the muffler of FIG. 7 was made from the following materials: shell 151 comprises 0.032–0.073 inch thick aluminized steel; inner wall 207 comprises 0.032–0.073 inch thick aluminized steel; inlet tube 160 comprises 0.032–0.073 inch thick aluminized steel; outlet tube extension 181 comprises 0.032–0.073 inch thick aluminized steel; outlet tube 215 comprises 0.032–0.073 inch thick aluminized steel; cylinder wall 182 comprises 0.032–0.073 inch thick aluminized steel; baffle 175 comprises 0.032–0.073 inch thick aluminized steel; baffle 202 comprises 0.032–0.073 inch thick aluminized steel; baffle 203 comprises 0.032–0.073 inch thick aluminized steel; baffle 204 comprises 0.032–0.073 inch thick aluminized steel; and baffle 216 comprises 0.032–0.073 inch thick aluminized steel. It used packing material at 208 and 189 (FIG. 3) as described above with respect to FIG. 6.

Figure 8:
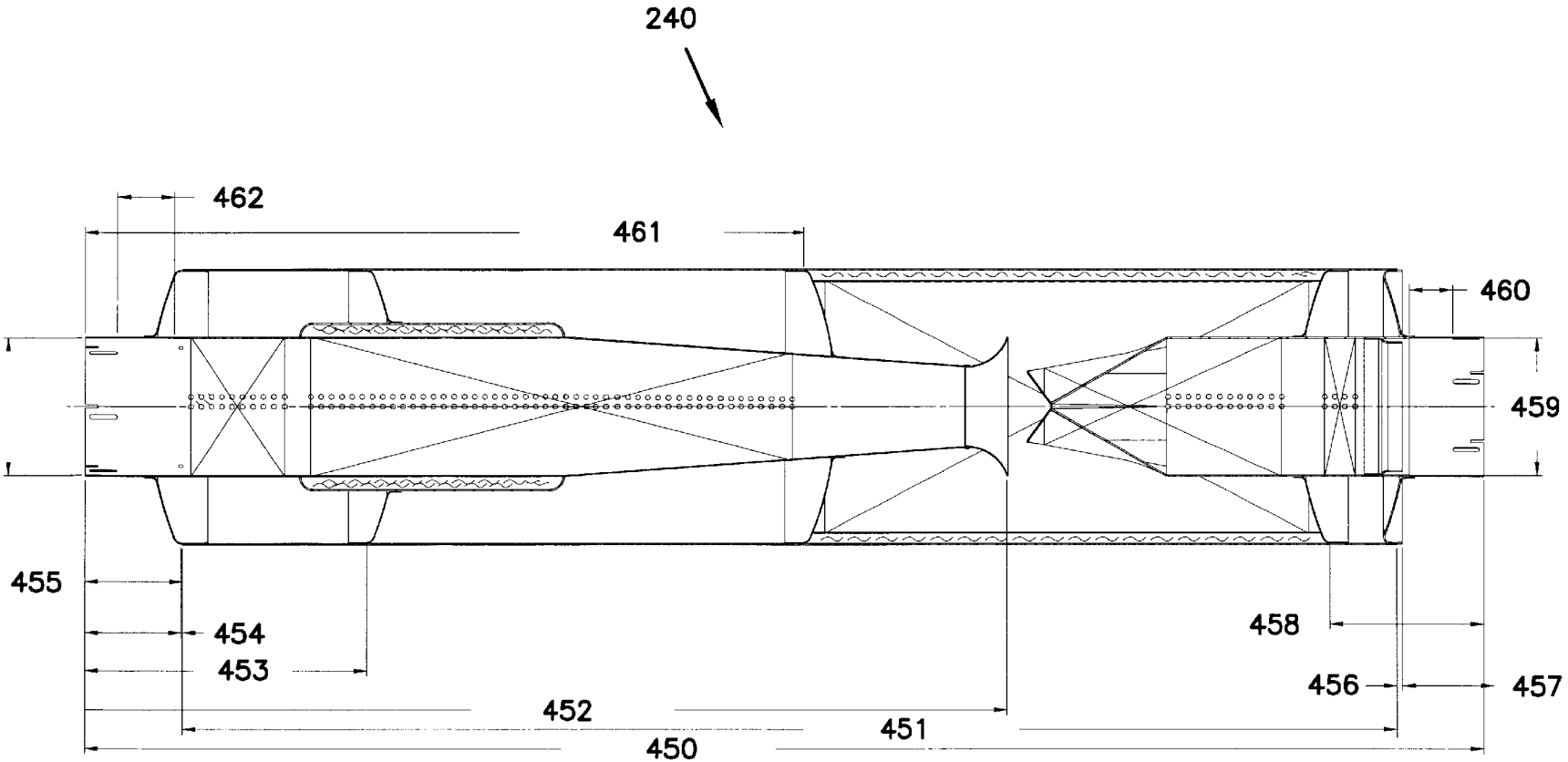
FIG. 8 is a schematic, cross-sectional view of the muffler arrangement depicted in FIG. 4, and defining certain preferred dimensions.

Attention is now directed to FIG. 8. In FIG. 8, the muffler arrangement 240, as depicted in FIG. 4, is shown with certain preferred dimensions. The following Table summarizes these dimensions, analogous to the tables above:

| Reference Number | Dimensios |
|---|---|
| 450 | No greater than about 1524 mm (about 60 inches); at least about 1143 mm (about 45 inches); preferably about 1245–1321 mm (about 49–52 inches); and more preferably about 1295 mm (about 51 inches). |
| 451 | No greater than about 1219 mm (about 48 inches); at least about 1067 mm (about 42 inches); preferably about 1117–1130 (about 44–44.5 inches); and more preferably 1124 mm (about 44.25 inches). |
| 452 | No greater than about 1016 mm (about 40 inches); at least about 711 mm (about 28 inches); preferably about 812–889 mm (about 32–35 inches); and more preferably about 855 mm (about 33.7 inches). |
| 453 | No greater than about 305 mm (about 12 inches); at least about 216 mm (about 8.5 inches); preferably about 247–267 mm (about 9.75–10.5 inches); and more preferably 260 mm (about 10.25 inches). |
| 454 | No greater than about 5 mm (about 0.2 inches); at least about 0.1 mm (about 0.005 inches); preferably about 0.2–2.5 mm (about 0.01–0.1 inches); and more preferably about 1.5 mm (about 0.06 inches). |
| 455 | No greater than about 127 mm (about 5 inches); at least about 76 mm (about 3 inches); preferably about 89–102 mm (about 3.5–4 inches); and more preferably about 90 mm (about 3.6 inches). |
| 456 | No greater than about 25 mm (about 1.0 inches); at least about 1 mm (about 0.05 inches); preferably about 2–8 mm (about 0.1–0.3 inches); and more preferably about 4.8 mm (about 0.2 inches). |
| 457 | No greater than about 102 mm (about 4 inches); at least about 50 mm (about 2 inches); preferably about 70–83 mm (about 2.75–3.25 inches); and more preferably about 76 mm (about 3.0 inches). |

-continued

| Reference Number | Dimensios |
|---|---|
| 458 | No greater than about 165 mm (about 6.5 inches); at least about 102 mm (about 4 inches); preferably about 127–152 mm (about 5–6 inches); more preferably about 143 mm (about 5.6 inches). |
| 459 | No greater than about 133 mm (about 5.25 inches); at least about 125 mm (about 4.9 inches); preferably about 127–128 mm (about 5.01–5.04 inches); and more preferably about 127.6 mm (about 5.025 inches). |
| 460 | No greater than about 64 mm (about 2.5 inches); at least about 25 mm (about 1.0 inches); preferably about 38–43 mm (about 1.5–1.7 inches); and more preferably about 40 mm (about 1.6 inches). |
| 461 | No greater than about 813 mm (about 32 inches); at least about 559 mm (about 22 inches); preferably about 647–686 mm (about 25.5–27 inches); and more preferably about 667 mm (about 26.25 inches). |
| 462 | No greater than about 77 mm (about 3.0 inches); at least about 25 mm (about 1.0 inches); preferably about 48–58 mm (about 1.9–2.3 inches); and more preferably about 53 mm (about 2.1 inches). |

The construction of the muffler of FIG. 8 was made from the following materials: shell 241 comprises 0.032–0.073 inch thick aluminized steel; inner wall 284 comprises 0.032–0.073 inch thick aluminized steel; inlet tube 245 comprises 0.032–0.073 inch thick aluminized steel; outlet tube 246 comprises 0.032–0.073 inch thick aluminized steel; wall 299 comprises 0.032–0.073 inch thick aluminized steel; baffle 248 comprises 0.032–0.073 inch thick aluminized steel; baffle 262 comprises 0.032–0.073 inch thick aluminized steel; baffle 2 78 comprises 0.032–0.073 inch thick aluminized steel; baffle 279 comprises 0.032–0.073 inch thick aluminized steel; and baffle 280 comprises 0.032–0.073 inch thick aluminized steel. It used packing material at 286 and 298 (FIG. 4) as described above with respect to FIG. 6.

Figure 9:
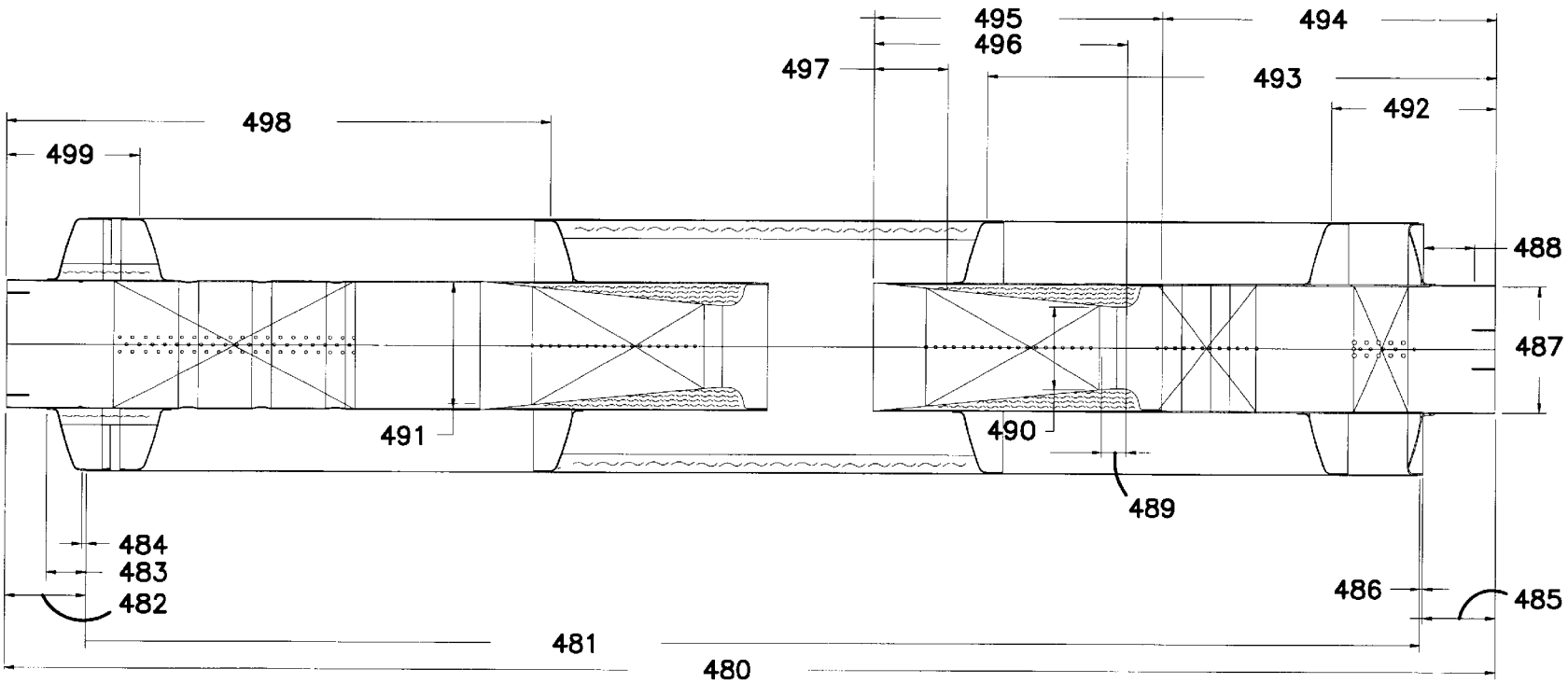
FIG. 9 is a schematic, cross-sectional view of the muffler arrangement depicted in FIG. 5, and defining certain preferred dimensions.

Attention is now directed to FIG. 9. In FIG. 9, the muffler arrangement 510, as depicted in FIG. 5, is shown with certain preferred dimensions. The following Table summarizes these dimensions, analogous to the tables above:

| Reference Number | Dimensios |
|---|---|
| 480 | No greater than about 1650 mm (about 65 inches); at least about 1500 mm (about 59 inches); preferably about 1562–1575 mm (about 61.5–62 inches); and more preferably about 1568 mm (about 61.5 inches). |
| 481 | No greater than about 1651 mm (about 65 inches); at least about 1219 mm (about 48 inches); preferably about 1346–1448 mm (about 53–57 inches); and more preferably about 1396 mm (about 55 inches). |
| 482 | No greater than about 102 mm (about 4 inches); at least about 71.1 mm (about 2.8 inches); preferably about 76.2–88.9 mm (about 3–3.5 inches); and more preferably about 84.1 mm (about 3.31 inches). |
| 483 | No greater than about 45.7 mm (about 1.8 inches); at least about 38.1 mm (about 1.25 inches); preferably about 35.6–40.6 mm (about 1.4–1.6 inches); and more preferably about 38.4 mm (about 1.51 inches). |
| 484 | No greater than about 7.6 mm (about 0.3 inches); at least about 2.5 mm (about 0.1 inches); preferably about 3.8–6.4 mm (about .15–.25 inches); and more preferably about 4.8 mm (about 0.19 inches). |

-continued

| Reference Number | Dimensios |
|---|---|
| 485 | No greater than about 102 mm (about 4 inches); at least about 51 mm (about 2 inches); preferably about 74–79 mm (about 2.9–3.1 inches); and more preferably about 76 mm (about 3 inches). |
| 486 | No greater than about 7.6 mm (about 0.3 inches); at least about 2.5 mm (about 0.1 inches); preferably about 3.8–6.4 mm (about .15–.25 inches); and more preferably about 4.8 mm (about 0.19 inches). |
| 487 | No greater than about 133 mm (about 5.25 inches); at least about 125 mm (about 4.9 inches); preferably about 127–128 mm (about 5.01–5.04 inches); and more preferably about 127.6 mm (about 5.025 inches). |
| 488 | No greater than about 76.2 mm (about 3 inches); at least about 38.1 mm (about 1.25 inches); preferably about 50.8–63.5 mm (about 2–2.5 inches); and more preferably about 57.2 mm (about 2.25 inches). |
| 489 | No greater than about 50.8 mm (about 2 inches); at least about 12.7 mm (about 0.5 inches); preferably about 19.1–31.8 mm (about 0.75–1.25 inches); and more preferably about 25.4 mm (about 1.00 inches). |
| 490 | No greater than about 88.9 mm (about 3.5 inches); at least about 63.5 mm (about 2.5 inches); preferably about 69.9–82.6 mm (about 2.75–3.25 inches); and more preferably about 74.9 mm (about 2.95 inches). |
| 491 | No greater than about 152 mm (about 6 inches); at least about 102 mm (about 4.0 inches); preferably about 114–140 mm (about 4.5–5.5 inches); and more preferably about 126 mm (about 4.95 inches). |
| 492 | No greater than about 191 mm (about 7.5 inches); at least about 165 mm (about 6.5 inches); preferably about 175–181 mm (about 6.88–7.12 inches); and more preferably about 178 mm (about 7.00 inches). |
| 493 | No greater than about 546 mm (about 21.5 inches); at least about 508 mm (about 20.0 inches); preferably about 531–538 mm (about 20.9–21.2 inches); and more preferably about 536 mm (about 21.1 inches). |
| 494 | No greater than about 368 mm (about 14.5 inches); at least about 343 mm (about 13.5 inches); preferably about 351–356 mm (about 13.8–14.0 inches); and more preferably about 353 mm (about 13.9 inches). |
| 495 | No greater than about 318 mm (about 12.5 inches); at least about 292 mm (about 11.5 inches); preferably about 300–305 mm (about 11.8–12.0 inches); and more preferably about 302 mm (about 11.9 inches). |
| 496 | No greater than about 279 mm (about 11.0 inches); at least about 241 mm (about 9.5 inches); preferably about 259–264 mm (about 10.2–10.4 inches); and more preferably about 262 mm (about 10.3 inches). |
| 497 | No greater than about 88.9 mm (about 3.5 inches); at least about 63.5 mm (about 2.5 inches); preferably about 72.4–78.6 mm (about 2.85–3.1 inches); and more preferably about 75.4 mm (about 2.97 inches). |
| 498 | No greater than about 610 mm (about 24.0 inches); at least about 533 mm (about 21.0 inches); preferably about 569–574 mm (about 22.4–22.6 inches); and more preferably about 572 mm (about 22.5 inches). |
| 499 | No greater than about 178 mm (about 7.0 inches); at least about 114 mm (about 4.5 inches); preferably about 137–142 mm (about 5.4–5.6 inches); and more preferably about 140 mm (about 5.5 inches). |

The construction of the muffler of FIG. 9 was made from the following materials: shell 512 comprises 0.032–0.073 inch thick aluminized steel; inner wall 544 comprises 0.032–0.073 inch thick aluminized steel; inlet tube 520 comprises 0.032–0.073 inch thick aluminized steel; outlet tube 550 comprises 0.032–0.073 inch thick aluminized steel; baffles 518, 530, 553, 555, and 557 each comprises 0.032–0.073 inch thick aluminized steel. It used packing material at 548, 565, 582, and 600 (FIG. 5) as described above with respect to FIG. 6.

The tables below describe examples of specific engines which use engine retarders, i.e. compression-type brakes:

CATERPILLAR
Heavy Duty Engine Ratings Used With Compression-Type Brakes

| ENGINE MODEL | RATED POWER (hp) | RATED SPEED (RPM) | GOVERNED POWER (hp) | GOVERNED SPEED (RPM) | PEAK-TORQUE (ft*lbf) | PEAK-TORQUE SPEED (RPM) |
|---|---|---|---|---|---|---|
| C-10 | 280 | 1800 | 209 | 2100 | 1050 | 1100 |
| C-10 | 305 | 1800 | 238 | 2100 | 1150 | 1100 |
| C-10 | 335 | 1800 | 273 | 2100 | 1250 | 1200 |
| C-10 | 335 | 1800 | 273 | 2100 | 1350 | 1200 |
| C-10 | 350 | 1800 | 290 | 2100 | 1350 | 1200 |

-continued

CATERPILLAR
Heavy Duty Engine Ratings Used With Compression-Type Brakes

| ENGINE MODEL | RATED POWER (hp) | RATED SPEED (RPM) | GOVERNED POWER (hp) | GOVERNED SPEED (RPM) | PEAK-TORQUE (ft*lbf) | PEAK-TORQUE SPEED (RPM) |
|---|---|---|---|---|---|---|
| C-10 | 370 | 1800 | 313 | 2100 | 1350 | 1200 |
| C-10 | 370 | 1800 | 313 | 2100 | 1350 MT | 1200 |
| C-10 | 280 | 2100 | 280 | 2100 | 975 | 1200 |
| C-10 | 305 | 2100 | 305 | 2100 | 1150 | 1100 |
| C-10 | 325 | 2100 | 325 | 2100 | 1250 | 1200 |
| C-12 | 355 | 1800 | 308 | 2100 | 1250 | 1200 |
| C-12 | 380 | 1800 | 337 | 2100 | 1450 | 1200 |
| C-12 | 410 | 1800 | 366 | 2100 | 1450 | 1200 |
| C-12 | 410 | 1800 | 365 | 2100 | 1550 | 1200 |
| C-12 | 410 | 1800 | 366 | 2100 | 1450 MT | 1200 |
| C-12 | 410 | 1800 | 365 | 2100 | 1550 MT | 1200 |
| C-12 | 410 | 1800 | 365 | 2100 | 1550 MT | 1200 |
| C-12 | 360 | 2100 | 360 | 2100 | 1350 | 1200 |
| C-12 | 390 | 2100 | 390 | 2100 | 1450 | 1200 |
| C-12 | 410 | 2100 | 410 | 2100 | 1550 | 1200 |
| C-12 | 425 | 2100 | 425 | 2100 | 1450 | 1200 |
| 3406E | 310 | 1800 | 244 | 2100 | 1150 | 1200 |
| 3406E | 310 | 1800 | 244 | 2100 | 1250 | 1200 |
| 3406E | 310 | 1800 | 244 | 2100 | 1350 | 1200 |
| 3406E | 330 | 1800 | 268 | 2100 | 1350 | 1200 |
| 3406E | 355 | 1800 | 315 | 2100 | 1350 | 1200 |
| 3406E | 355 | 1800 | 315 | 2100 | 1450 MT | 1200 |
| 3406E | 375 | 1800 | 335 | 2100 | 1450 | 1200 |
| 3406E | 375 | 1800 | 335 | 2100 | 1550 MT | 1200 |
| 3406E | 375 | 1800 | 335 | 2100 | 1550 MT | 1200 |
| 3406E | 375 | 1800 | 390 | 2100 | 1650 MT | 1200 |
| 3406E | 410 | 1800 | 367 | 2100 | 1450 | 1200 |
| 3406E | 410 | 1800 | 367 | 2100 | 1550 | 1200 |
| 3406E | 435 | 1800 | 390 | 2100 | 1550 | 1200 |
| 3406E | 435 | 1800 | 390 | 2100 | 1650 | 1200 |
| 3406E | 435 | 2100 | 435 | 2100 | 1450 | 1200 |
| 3406E | 435 | 2100 | 435 | 2100 | 1550 | 1200 |
| 3406E | 435 | 2100 | 435 | 2100 | 1650 | 1200 |
| 3406E | 455 | 1800 | 408 | 2100 | 1650 | 1200 |
| 3406E | 455 | 2100 | 455 | 2100 | 1650 | 1200 |
| 3406E | 455 | 2100 | 455 | 2100 | 1750 MT | 1200 |
| 3406E | 475 | 1800 | 426 | 2100 | 1650 | 1200 |
| 3406E | 475 | 1800 | 426 | 2100 | 1750 | 1200 |
| 3406E | 475 | 2100 | 475 | 2100 | 1650 | 1200 |
| 3406E | 475 | 2100 | 475 | 2100 | 1750 | 1200 |
| 3406E | 475 | 2100 | 500 | 2100 | 1850 MT | 1200 |
| 3406E | 500 | 1800 | 449 | 2100 | 1850 | 1200 |
| 3406E | 500 | 2100 | 485 | 2100 | 1450 | 1200 |
| 3406E | 500 | 2100 | 500 | 2100 | 1750 | 1200 |
| 3406E | 500 | 2100 | 500 | 2100 | 1850 | 1200 |
| 3406E | 550 | 1800 | 525 | 2100 | 1850 | 1200 |
| 3406E | 600 | 1800 | 576 | 2100 | 2050 | 1200 |

CUMMINS
Heavy Duty Engine Ratings Used With Engine Compression-Type Brakes

| ENGINE MODEL | ADVERTISE POWER (hp) | ADVERTISE SPEED (RPM) | GOVERNE POWER (hp) | GOVERNE SPEED (RPM) | PEAK-TORQU (ft*lbf) | PEAK-TORQU SPEED (RPM) |
|---|---|---|---|---|---|---|
| M11+ | 280 | 2100 | 280 | 2100 | 1050 | 1200 |
| M11+ | 280 | 2100 | 280 | 1800 | 1050 | 1200 |
| M11+ | 280 | 2000 | 280 | 2000 | 900 | 1200 |
| M11+ | 300 | 2100 | 300 | 2100 | 990 | 1200 |
| M11+ | 300 | 2100 | 300 | 2100 | 1100 | 1200 |
| M11+ | 310 | 2100 | 310 | 2100 | 1150 | 1200 |
| M11+ | 310 | 1800 | 310 | 1800 | 1150 | 1200 |
| M11 + ES | 310 | 1800 | 310/370 | 1800 | 1150/13 | 1200 |
| ESP | 330 | 1800 | 330/370 | 1800 | 1250/13 | 1200 |
| M11+ | 330 | 2100 | 330 | 2100 | 1250 | 1200 |

-continued

CUMMINS
Heavy Duty Engine Ratings Used With Engine Compression-Type Brakes

| ENGINE MODEL | ADVERTISE POWER (hp) | ADVERTISE SPEED (RPM) | GOVERNE POWER (hp) | GOVERNE SPEED (RPM) | PEAK-TORQU (ft*lbf) | PEAK-TORQU SPEED (RPM) |
|---|---|---|---|---|---|---|
| M11+ | 330 | 2100 | 330 | 2100 | 1350 | 1200 |
| M11+ | 330 | 1800 | 330 | 1800 | 1250 | 1200 |
| M11 + fle | 330 | 1800 | 330 | 1800 | 1250 | 1200 |
| M11+ | 330 | 1800 | 330 | 1800 | 1350 | 1200 |
| M11 + fle | 330 | 1800 | 330 | 1800 | 1350 | 1200 |
| M11 + ES | 350 | 1800 | 350/400 | 1800 | 1350/14 | 1200 |
| M11+ | 350 | 1800 | 350 | 1800 | 1350 | 1200 |
| M11+ | 350 | 2100 | 350 | 2100 | 1350 | 1200 |
| M11+ | 350 | 1800 | 350 | 1800 | 1350 | 1200 |
| M11 + fle | 370 | 2100 | 370 | 2100 | 1350 | 1200 |
| M11+ | 370 | 1800 | 370 | 1800 | 1350 | 1200 |
| M11 + ES | 370 | 1800 | 370/410 | 1800 | 1350/14 | 1200 |
| M11 + fle | 370 | 1800 | 370 | 1800 | 1350 | 1200 |
| M11+ | 400 | 1800 | 370 | 2100 | 1450 | 1200 |
| M11+ | 400 | 1800 | 400 | 1800 | 1450 | 1200 |
| M11+ | 450 | 1800 | 420 | 2100 | 1450 | 1200 |
| N14+ | 310 | 1800 | 310 | 1800 | 1250 | 1200 |
| N14 + ES | 330/410 | 1800 | 330/410 | 1800 | 1350/14 | 1200 |
| N14+ | 330 | 2100 | 330 | 2100 | | 1200 |
| N14+ | 330 | 1800 | 330 | 1800 | | 1200 |
| N14+ | 330 | 1800 | 330 | 1800 | | 1200 |
| N14+ | 350 | 2100 | 350 | 2100 | | 1200 |
| N14+ | 350 | 2100 | 350 | 2100 | | 1200 |
| N14+ | 350 | 1800 | 350 | 1800 | | 1200 |
| N14+ | 350 | 1800 | 350 | 1800 | | 1200 |
| N14+ | 350 | 1800 | 350 | 1800 | | 1200 |
| N14 + ES | 370/435 | 1800 | 370/435 | 1800 | 1450/15 | 1200 |
| N14+ | 370 | 2100 | 370 | 2100 | 1450 | 1200 |
| N14+ | 370 | 2100 | 370 | 2100 | 1450 | 1200 |
| N14+ | 370 | 1800 | 370 | 1800 | 1450 | 1200 |
| N14+ | 370 | 1800 | 370 | 1800 | 1450 | 1200 |
| N14+ | 370 | 1800 | 370 | 1800 | 1400 | 1200 |
| N14+ | 410 | 2100 | 410 | 2100 | 1450 | 1200 |
| N14+ | 410 | 1800 | 410 | 1800 | 1450 | 1200 |
| N14 + ES | 435/485 | 1800 | 435/485 | 1800 | 1550/16 | 1200 |
| N14+ | 435 | 2100 | 435 | 2100 | 1650 | 1200 |
| N14+ | 435 | 2100 | 435 | 2100 | 1550 | 1200 |
| N14+ | 435 | 2100 | 435 | 2100 | 1450 | 1200 |
| N14+ | 435 | 1800 | 435 | 1800 | 1550 | 1200 |
| N14+ | 435 | 1800 | 435 | 1800 | 1450 | 1200 |
| N14+ | 460 | 2100 | 460 | 2100 | 1650 | 1200 |
| N14+ | 460 | 2100 | 460 | 2100 | 1550 | 1200 |
| N14+ | 460 | 2100 | 460 | 2100 | 1475 | 1200 |
| N14+ | 500 | 2100 | 500 | 2100 | 1750 | 1200 |
| N14+ | 500 | 2100 | 500 | 2100 | 1650 | 1200 |
| N14+ | 500 | 2100 | 500 | 2100 | 1550 | 1200 |
| N14+ | 500 | 2100 | 500 | 2100 | 1475 | 1200 |
| N14+ | 525 | 1800 | 500 | 2100 | 1850 | 1200 |
| N14+ | 525 | 1800 | 500 | 2100 | 1550 | 1200 |

DETROIT DIESEL
Heavy Duty Engine Ratings Used With Compression-Type Brakes

| ENGINE MODEL | RATED POWE (hp) | RATED SPEED (RPM) | CRUISE POWER (hp) (at rated RPM) | PEAK-TORQUE (ft*lbf) | PEAK-TORQU SPEED (RPM) |
|---|---|---|---|---|---|
| Series | 300 | 1800 | 330 | 1150 | 1200 |
| Series | 330 | 1800 | 350 | 1250 | 1200 |
| Series | 330 | 2100 | 350 | 1250 | 1200 |
| Series | 330 | 1800 | 350 | 1350 | 1200 |
| Series | 330 | 2100 | 350 | 1350 | 1200 |
| Series | 330 | 1800 | 365 | 1350 | 1200 |
| Series | 370 | 1800 | 400 | 1450 | 1200 |

-continued

DETROIT DIESEL
Heavy Duty Engine Ratings Used With Compression-Type Brakes

| ENGINE MODEL | RATED POWE (hp) | RATED SPEED (RPM) | CRUISE POWER (hp) (at rated RPM) | PEAK-TORQUE (ft*lbf) | PEAK-TORQU SPEED (RPM) |
|---|---|---|---|---|---|
| Series | 370 | 1800 | 430 | 1450 | 1200 |
| Series | 370 | 2100 | 430 | 1450 | 1200 |
| Series | 430 | 2100 | 470 | 1450 | 1200 |
| Series | 370 | 1800 | 430 | 1550 | 1200 |
| Series | 430 | 1800 | 470 | 1550 | 1200 |
| Series | 430 | 2100 | 470 | 1550 | 1200 |
| Series | 430 | 1800 | 500 | 1650 | 1200 |

-continued

DETROIT DIESEL
Heavy Duty Engine Ratings Used With Compression-Type Brakes

| ENGINE MODEL | RATED POWE (hp) | RATED SPEED (RPM) | CRUISE POWER (hp) (at rated RPM) | PEAK-TORQUE (ft*lbf) | PEAK-TORQU SPEED (RPM) |
|---|---|---|---|---|---|
| Series | 430 | 2100 | 500 | 1650 | 1200 |
| Series | 300 | 1800 | NA | 1150 | 1200 |
| Series | 330 | 1800 | NA | 1150 | 1200 |
| Series | 330 | 1800 | NA | 1250 | 1200 |
| Series | 330 | 2100 | NA | 1250 | 1200 |
| Series | 330 | 1800 | NA | 1350 | 1200 |
| Series | 330 | 210 | NA | 1350 | 1200 |
| Series | 350 | 1800 | NA | 1250 | 1200 |
| Series | 350 | 1800 | NA | 1350 | 1200 |
| Series | 350 | 2100 | NA | 1250 | 1200 |
| Series | 350 | 2100 | NA | 1350 | 1200 |
| Series | 365 | 1800 | NA | 1350 | 1200 |
| Series | 370 | 1800 | NA | 1450 | 1200 |
| Series | 370 | 1800 | NA | 1550 | 1200 |
| Series | 370 | 2100 | NA | 1450 | 1200 |
| Series | 400 | 1800 | NA | 1450 | 1200 |
| Series | 400 | 1800 | NA | 1550 | 1200 |
| Series | 400 | 2100 | NA | 1450 | 1200 |
| Series | 430 | 1800 | NA | 1450 | 1200 |
| Series | 430 | 1800 | NA | 1550 | 1200 |
| Series | 430 | 1800 | NA | 1650 | 1200 |
| Series | 430 | 2100 | NA | 1450 | 1200 |
| Series | 430 | 2100 | NA | 1550 | 1200 |
| Series | 430 | 2100 | NA | 1650 | 1200 |
| Series | 430 | 2100 | NA | 1450 | 1200 |
| Series | 470 | 1800 | NA | 1550 | 1200 |
| Series | 470 | 1800 | NA | 1650 | 1200 |
| Series | 470 | 2100 | NA | 1550 | 1200 |
| Series | 470 | 2100 | NA | 1650 | 1200 |
| Series | 500 | 1800 | NA | 1550 | 1200 |
| Series | 500 | 1800 | NA | 1650 | 1200 |
| Series | 500 | 2100 | NA | 1450 | 1200 |
| Series | 500 | 2100 | NA | 1559 | 1200 |
| Series | 500 | 2100 | NA | 1650 | 1200 |

The specific engines above can be broken down into at least 3 groups. Group I includes engines with a rated power of under 300 hp, but typically greater than 250 hp. Group I includes two subgroups: those with the hp rated at speeds of 1800 rpm, and those with the hp rated speeds of 2100 rpm.

Group II includes engines with a rated power of between or equal to 300–450 hp. Group II includes two subgroups: those with the hp rated at speeds of 1800 rpm, and those with the hp rated at speeds of 2100 rpm.

Group III includes engines with a rated power of greater than 450 hp, and typically less than or equal to 600 hp. Group III includes two subgroups: those with the hp rated at speeds of 1800 rpm, and those with hp rated at speeds of 2100 rpm.

J. Experimental

1. Experimental Set-up and Methodology.

Examples I–VI below were tested and performed on an engine dynamometer and actual class 8 heavy duty trucks. Initially, the muffler performance was optimized on the dynamometer, and then the muffler was tested on the class 8 heavy duty truck. The dynamometer testing focused only on the exhaust noise coming from the engine. The testing on the truck took into account not only exhaust noise, but all other noise sources from the truck such as transmission and other mechanical noise, combustion noise from the engine, chassis and suspension squeak or rattle, tire noise, etc.

Figures 10, 11:
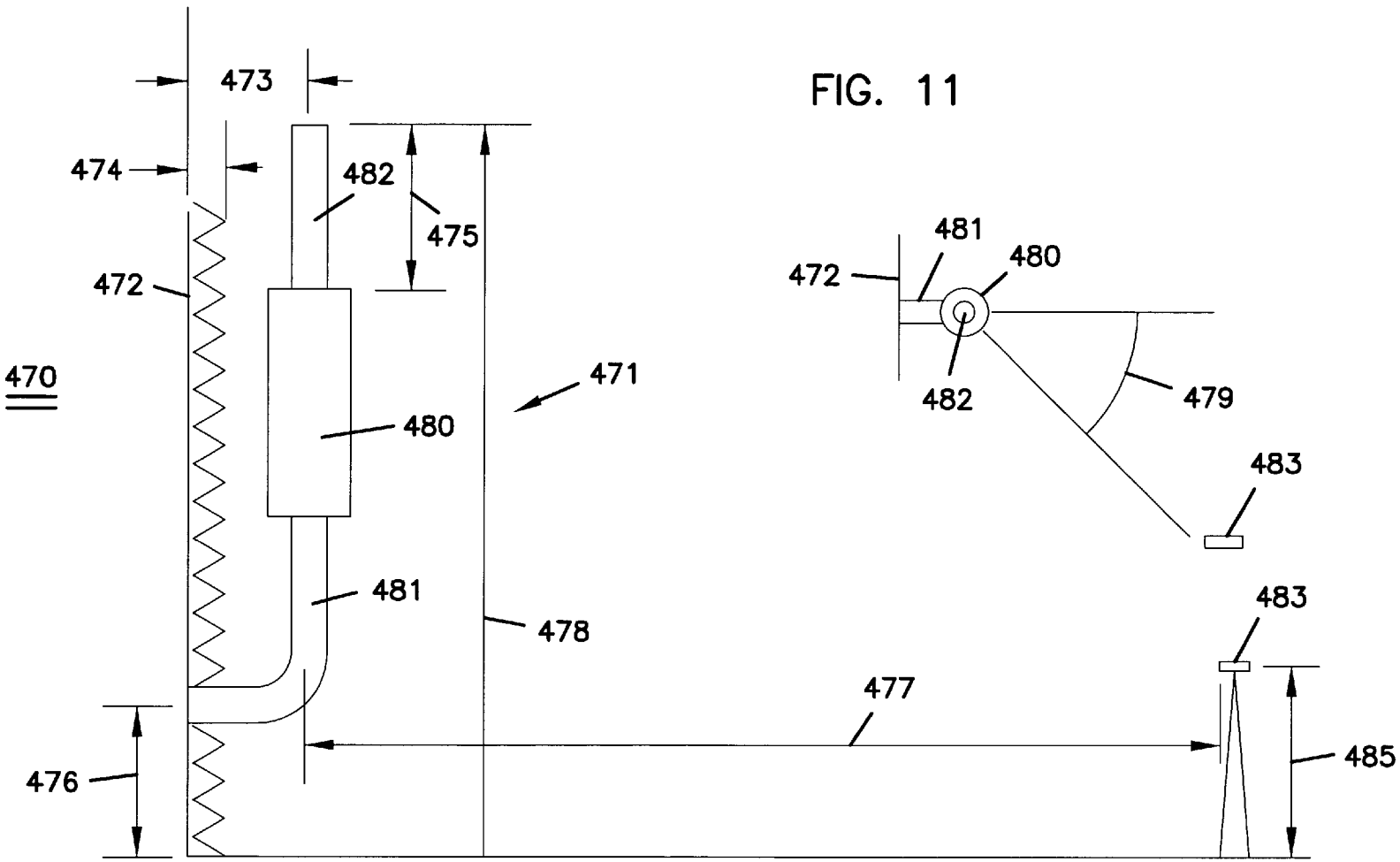
FIGS. 10 and 11 are schematic diagrams depicting experimental procedures for testing arrangements of the present invention.

The engine dynamometer set up is shown in FIGS. 10 and 11 for SVV. Specifically, the muffler 480 was mounted in a vertical orientation as shown. An inlet pipe 481 led from the dynamometer room 470 through the soundproof wall 472 and to the muffler 480. The wall is covered with acoustic wedge foam triangles to reduce sound reflection. An outlet pipe 482 extended from the muffler 480, as shown. A microphone 483 was set a distance away from the muffler to pick up sound properties. The exhaust was piped from the dynamometer room 470 to the outside 471 of the dynamometer room 470 where it was measured. Because the wall 472 was soundproof, any engine or dynamometer system noise was eliminated from the exhaust noise measurement.

The dynamometer test procedure was based on SAE J1207 (FEB87), Measurement Procedure for Determination of Silencer Effectiveness in Reducing Engine Intake or Exhaust Sound Level. Dynamometer tests, positive power, were run at the steady-state mode per J1207 and in a transient mode that simulates actual engine operation during the standard heavy duty truck noise test procedure, SAE J366. For braking noise tests, the dynamometer system was operated to reproduce the engine operation specified below for the truck braking test procedure. The noise measurements obtained from the dynamometer transient test cycles, positive power and braking, were used for characterization of muffler performance.

The engine dynamometer setup shown in FIGS. 10 and 11 were set up with the following dimensions:

| Reference Number | Dimensions |
|---|---|
| 473 | 30 inches |
| 474 | 12 inches |
| 475 | 4 ft. |
| 476 | 42 inches |
| 477 | 50 foot radius |
| 478 | 11.5–13 ft. (12.5 ft.) |
| 479 | 45° |
| 485 | 4 ft. |

the dual vertical muffler system (DVV), the setup as shown in FIG. 10 was the same. However, the top plan view differed from the view shown in FIG. 11 for the SVV as follows: For the DVV, there were two mufflers used. They were Donaldson M100582 mufflers. The first muffler was spaced from the inlet pipe from the soundproof room by 30 inches,and the second muffler was spaced from the inlet pipe by 48 inches. The distance between the centers of each of the two mufflers was 78 inches. The microphone was positioned at a point angled 68° from the midpoint between the two mufflers and a distance of about 54 feet from the midpoint between the two mufflers.

From the dynamometer testing, graphs plotting overall and individual octave band sound pressure levels vs. engine speed revolutions per minute were produced during each cycle. Several positive power and several negative power (braking) cycles were run to get an average or representative cycle for the test system. The muffler performance was determined as the peak (loudest) overall sound pressure level point from the cycle. The octave band plots labeled 63, 125, 250, 500, 1,000, 2,000, 4,000, and 8,000 formed the octave bands that made up the overall sound pressure level curves at the top of the plots. An octave band is a banded frequency range with each successive band twice as wide as the previous band. With each octave band center frequency defined above, its range was determined by the center of frequency divided by the square root of 2 and the center of frequency times the square root of 2 as the low point and high point, respectively.

Exhaust system (muffler and piping) back pressure on the dynamometer at the rated engine operating condition was also measured. Back pressure is the amount of extra pressure required in the exhaust to overcome the flow losses in the exhaust system and keep the gases flowing outward.

The on truck test procedures were made as follows: for positive power acceleration, the standard SAE J366 was followed. A diagram is shown on page 2 of SAE J366. For braking, section 4.2.4 of SAE J366 was deviated from. Rather, SAE section 4.2.4 was the starting point, with the following modifications:

1. The truck approached (along the vehicle path) the test microphone point at full throttle and maximum engine speed (high-idle);

a. the test was run in the highest gear which allows an entry speed (SAE J366 specified) at or below 55 km/hr;

b. the approach was long enough to stabilize engine operating conditions, engine speed, and turbo boost (intake manifold pressure).

By testing in the highest gear, as defined above and at stabilized engine conditions, consistent, repeatable, and higher more representable noise levels are ensured.

2. The throttle was released and the brake engaged at a line 10 meters before the microphone point. Several passes were run to ensure accuracy and repeatability. The final result was the average of the test passes.

The data were recorded and plotted. The loudest point during the test was taken as the sound pressure level of the truck. The octave band data, identified as "peak", was derived from the point that defines the peak average overall sound pressure level for that test run. In application Ser. No. 09/023,625, the data provided for the individual octave band was given in the "peak" form; that is, it was derived from the point that defines the peak average overall sound pressure level. In the present disclosure, the test results from these same experiments with the same original data are reported in another format, identified as "overall." The revolutions per minute range for a test under positive power is 1,400–2,200 revolutions per minute. This is two-thirds of the rated rpm of the tested engine up to its governed maximum RPM, as stated in SAE J366. The RPM range for a test for engine compression breaking is 2,200–900 RPM. This is the maximum governed engine speed down to approximately an idling condition. During a test, any particular muffler will measure its maximum sound pressure level at some RPM. The octave band composition at this instant in RPM is what is reported under the "peak" column. Because this instant in RPM may or may not be the maximum reading for any particular octave band, each octave band is surveyed for the entire RPM range. The maximum for each octave band is noted, regardless of the RPM at which the maximum sound pressure level occurred, in the "overall" column.

The equipment tested was a Detroit Diesel Corporation Series 60 engine rated at 500 hp at 2100 rpm. SAE technical paper 972038 and 971870, both of which are hereby incorporated by reference, indicate noise characterizations of that particular Detroit Diesel Series 60 engine.

The standard muffler tested in Example III was a single Donaldson M100580 muffler; and in Example IV was a dual Donaldson M100582 muffler.

To obtain the sound quality numbers (i.e., loudness, roughness, and sharpness), BAS System equipment from HEAD Acoustics of Aachen, Germany was used. The processing algorithms were as follows:

Loudness: ⅓ octave filter per ISO 532 algorithm;

Roughness: the modulation method within the BAS system;

Sharpness: ⅓ octave filter per ISO 532 algorithm.

EXAMPLE I

A 1997 Detroit Diesel Series 60 engine rated for operation at a power of at least 500 hp at 2100 rpm was tested without any muffler in an SVV system. This is called a "straight pipe" measurement. The overall sound pressure level during positive power was 89.5 dba, and during braking was 102.5 dba. For the specific octave bands, the results were as follows:

| | SPL (dba) | | |
|---|---|---|---|
| Octave Band Hz | Positive Power Max (At Peak) | Braking Max (At Peak) | Difference |
| 63 | Below Scale | Below scale | — |
| 125 | 70.5 | 76.5 | 6 |
| 250 | 75.5 | 86 | 10.5 |
| 500 | 87 | 99.5 | 12.5 |
| 1,000 | 79 | 97.5 | 18.5 |
| 2,000 | 79 | 97 | 18 |
| 4,000 | 76.5 | 90 | 13.5 |
| 8,000 | Below Scale | 82.5 | — |

| | SPL (dba) | |
|---|---|---|
| Octave Band Hz | Positive Power Max (overall) | Braking Max (overall) |
| 63 | Below Scale | 78.0 |
| 125 | 77.0 | 80.5 |
| 250 | 76.5 | 86.5 |
| 500 | 87.5 | 99.5 |
| 1,000 | 79.0 | 97.5 |
| 2,000 | 79.0 | 97.0 |
| 4,000 | 76.5 | 90.5 |
| 8,000 | Below Scale | 82.5 |

The loudness was 115.8 phons. The roughness was 19.3 aspers The sharpness was 6.9 acums.

EXAMPLE II

A 1997 Detroit Diesel Series 60 engine rated for operation at a power of at least 500 hp at 2100 rpm was tested with a dual vertical system (DVV) without any muffler. This is referred to as a "straight pipe" measurement. The overall sound pressure level during positive power was 91 dba, and during braking was 103 dba.

For the specific octave bands, The results were as follows:

| Octave Band | SPL (dba) | | |
|---|---|---|---|
| Hz | Positive Power | Braking | Difference |
| 63 | Below Scale | Below Scale | — |
| 125 | Below Scale | 81.5 | — |
| 250 | 74.5 | 84.5 | 9.5 |
| 500 | 88.5 | 100.5 | 12 |
| 1,000 | 81.5 | 96 | 14.5 |
| 2,000 | 78 | 95.5 | 17.5 |
| 4,000 | 74 | 88 | 14 |
| 8,000 | Below Scale | 79.5 | — |

| Octave Band Hz | SPL (dba) Positive Power Max (overall) | Braking Max (overall) |
|---|---|---|
| 63 | Below Scale | 74.5 |
| 125 | 75.5 | 82.0 |
| 250 | 75.0 | 85.0 |
| 500 | 88.5 | 100.5 |
| 1,000 | 81.5 | 96.0 |
| 2,000 | 78.5 | 96.0 |
| 4,000 | 75.5 | 90.0 |
| 8,000 | Below Scale | 80.0 |

The loudness was 115.2 phons. The roughness was 15.2 aspers. The sharpness was 6.7 acums.

EXAMPLE III

A 1997 Detroit Diesel Series 60 Engine rated for operation at a power of at least 500 hp at 2100 rpm and having a compression brake-type engine retarder such as a Jake Brake® engine retarder was tested as described above with a single Donaldson M100580 muffler. The overall sound pressure level during positive power was 70 dba, which was 19.5 dba less than the straight pipe (Example I). The overall sound pressure level during braking was 81 dba, which was 21.5 dba less than the straight pipe (Example I).

For the specific octave bands, measured at peak points, the results were as follows:

| Octave Band Hz | SPL (dba) Positive Power Max (at peak) | Braking Max (at peak) | Difference | Comparison To Straight Pipe Braking, SVV |
|---|---|---|---|---|
| 63 | 60 | 53.5 | −6.5 | — |
| 125 | 60.5 | 63.5 | 3 | −13 |
| 250 | 56.5 | 64 | 7.5 | −22 |
| 500 | 62.5 | 74 | 11.5 | −25.5 |
| 1,000 | 58 | 71.5 | 13.5 | −26 |
| 2,000 | 61.5 | 75 | 13.5 | −22 |
| 4,000 | 63 | 74.5 | 11.5 | −15.5 |
| 8,000 | 57.5 | 70.5 | 13 | −12 |

| Octave Band Hz | SPL (dba) Positive Power Max (overall) | Braking Max (overall) |
|---|---|---|
| 63 | 62.0 | 67.0 |
| 125 | 61.0 | 65.5 |
| 250 | 56.5 | 66.5 |
| 500 | 63.0 | 75.0 |
| 1,000 | 58.5 | 71.5 |
| 2,000 | 62.0 | 75.0 |
| 4,000 | 64.5 | 75.0 |
| 8,000 | 57.5 | 71.0 |

The loudness, during braking, was 99.5 phons which was 16.3 phons less than straight pipe braking (Example I).

The roughness during braking was 5.2 aspers, which was 14.1 aspers below straight pipe braking.

The sharpness during braking was 4.55 acums, which was 2.09 acums below straight pipe braking.

EXAMPLE IV

A dual vertical muffler system utilizing two Donaldson M100582 mufflers was tested on a 1997 Detroit Diesel series 60 truck engine rated at 500 hp at 2100 rpm. The overall sound pressure level during positive power was 68 dba, which was 23 dba less than the straight pipe (Example II) during positive power. The overall sound pressure level during braking was 80.5 dba, which was 22.5 dba less than the straight pipe during braking (Example II).

For the specific octave bands, the following data were collected:

| Octave Band Hz | SPL (dba) Positive Power (Peak) | Braking (Peak) | Difference | Comparison to Straight Pipe Braking (DVV) |
|---|---|---|---|---|
| 63 | 50 | 50.5 | 0.5 | — |
| 125 | 51 | 54 | 3 | −27.5 |
| 250 | 54.5 | 60.5 | 6 | −24 |
| 500 | 60.5 | 70 | 9.5 | −30.5 |
| 1,000 | 61.5 | 72 | 10.5 | −24 |
| 2,000 | 63 | 76 | 13 | −19.5 |
| 4,000 | 59 | 73.5 | 14.5 | −14.5 |
| 8,000 | 53.5 | 68 | 14.5 | −11.5 |

| Octave Band Hz | SPL (dba) Positive Power Max (overall) | Braking Max (overall) |
|---|---|---|
| 63 | 55.0 | 67.0 |
| 125 | 55.0 | 58.0 |
| 250 | 55.5 | 61.0 |
| 500 | 61.0 | 72.0 |
| 1,000 | 61.5 | 72.0 |
| 2,000 | 64.0 | 76.5 |
| 4,000 | 59.0 | 73.5 |
| 8,000 | 55.0 | 68.5 |

The loudness during braking was 97.2 phons, which was 18 phons below straight pipe braking (Example II).

The roughness during braking measured 3.48 aspers, which was 11.72 aspers below straight pipe braking (Example II).

The sharpness during braking was 3.96 acums, which was 2.69 acums below straight pipe braking (Example II).

EXAMPLE V

Example V(a)

A 1997 Detroit Diesel Series 60 truck engine rated at 500 hp at 2100 rpm was tested with the muffler arrangement 1, depicted in FIG. 2. The overall sound pressure level at positive power was 68.5 dba, which was 1.5 dba less than the Donaldson M100580 muffler (Example III), and 22 dba less than the straight pipe (Example I). At braking, the overall sound pressure level was 72.5 dba, which was 8.5 dba less than the Donaldson M100580 muffler, as tested in Example III, and 30.8 dba less than the straight pipe, as tested in Example I.

For the specific octave bands, the following data were collected:

| | SPL (dba) | | | | |
|---|---|---|---|---|---|
| Octave Band Hz | Positive Power (Peak) | Braking (Peak) | Differ-ence | Comparison To Standard Muffler Braking | Comparison to Straight Pipe Braking (SVV) |
| 63 | 66 | 55 | −11 | 1.5 | — |
| 125 | 60.5 | 65 | 4.5 | 1.5 | −11.5 |
| 250 | 50 | 65 | 15 | 1 | −21 |
| 500 | 53 | 61.5 | 8.5 | −12.5 | −38 |
| 1,000 | 53 | 61 | 8 | −10.5 | −36.5 |
| 2,000 | 53 | 66.5 | 13.5 | −8.5 | −30.5 |
| 4,000 | 53 | 65.5 | 12.5 | −9 | −24.5 |
| 8,000 | Below Scale | 55 | — | −15.5 | −27.5 |

| | SPL (dba) | | | |
|---|---|---|---|---|
| Octave Band Hz | Positive Power Max (overall) | Braking Max (overall) | Comparison to Standard Muffler Braking | Comparison to Straight Pipe Braking |
| 63 | 66.5 | 67.0 | 0.0 | −11.0 |
| 125 | 62.5 | 68.0 | 2.5 | −12.5 |
| 250 | 51.5 | 65.0 | −1.5 | −21.5 |
| 500 | 53.5 | 63.0 | −12.0 | −36.5 |
| 1,000 | 54.5 | 62.0 | −9.5 | −35.5 |
| 2,000 | 56.5 | 67.0 | −8.0 | −30.0 |
| 4,000 | 55.5 | 66.5 | −8.5 | −24.0 |
| 8,000 | Below Scale | 55.5 | −15.5 | −27.0 |

During braking, the loudness was 92 phons. As compared to the standard Donaldson M100580 muffler (Example III), this is at least 7.5 phons lower. As compared to a straight pipe (Example I), this was 23.8 phons lower.

The roughness during braking was 1.92 aspers. Compared to the Donaldson M100580 muffler (Example III), this was 3.25 aspers less. Compared to a straight pipe (Example I), this was 17.38 aspers less.

The sharpness during braking was 3.17 acums. Compared to the Donaldson M100580 muffler (Example III), this was 1.68 acums less. Compared to a straight pipe (Example I), this was 3.77 acums less.

Example V(b)

The same 1997 Detroit Series Diesel engine was tested on a muffler arrangement 240, as shown in FIG. 4.

The overall sound pressure level at positive power was 67 dba, which was 3 dba less than the Donaldson M100580 muffler (Example III), and 22.5 dba less than the straight pipe (Example I). At braking, the overall sound pressure level was 74 dba, which was 7 dba less than the Donaldson M100580 muffler, as tested in Example III, and 28.5 dba less than the straight pipe, as tested in Example I.

For the specific octave bands, the following data were observed:

| | SPL (dba) | | | | |
|---|---|---|---|---|---|
| Octave Band Hz | Positive Power (Peak) | Braking (Peak) | Differ-ence | Comparison To Standard Muffler Braking | Comparison To Straight Pipe Braking, SVV |
| 63 | 62.5 | 59 | −3.5 | 5.5 | — |
| 125 | 60.5 | 67.5 | 7 | 4 | −9 |
| 250 | 52 | 64.5 | 12.5 | 0.5 | −21.5 |
| 500 | 52.5 | 61 | 8.5 | −13 | −38.5 |
| 1,000 | 53 | 67 | 14 | −4.5 | −30.5 |
| 2,000 | 52 | 65.5 | 13.5 | −9.5 | −31.5 |
| 4,000 | 51.5 | 65 | 13.5 | −9.5 | −25 |
| 8,000 | Below Scale | 59 | — | −11.5 | −23.5 |

| | SPL (dba) | | | |
|---|---|---|---|---|
| Octave Band Hz | Positive Power Max (overall) | Braking Max (overall) | Comparison to Standard Muffler Braking | Comparison to Straight Pipe Braking |
| 63 | 63.0 | 68.5 | 1.5 | −9.5 |
| 125 | 64.0 | 69.0 | 3.5 | −11.5 |
| 250 | 53.0 | 65.0 | −1.5 | −21.5 |
| 500 | 57.0 | 61.0 | −14.0 | −38.5 |
| 1,000 | 54.0 | 67.0 | −4.5 | −30.5 |
| 2,000 | 53.5 | 65.5 | −9.5 | −31.5 |
| 4,000 | 53.5 | 65.5 | −9.5 | −25.0 |
| 8,000 | Below Scale | 59.0 | −12.0 | −23.5 |

The loudness during braking was 92.9 phons. This was 6.6 phons less than the Donaldson M100580 muffler, on the same engine (Example III). Compared to a straight pipe, this was 22.9 phons lower (Example I).

The roughness during braking was 2.4 aspers. This was 2.77 aspers less than the Donaldson M100580 muffler, on the same engine (Example III), and 16.9 aspers less than a straight pipe (Example I).

The sharpness during braking was 3.25 acums. This was 1.60 acums less than the Donaldson M100580 muffler, on the same engine (Example III), and 3.69 acums less than a straight pipe (Example I).

Example V(c)

The same 1997 Detroit Series Diesel engine was tested on a muffler arrangement 510, as shown in FIG. 5.

The overall sound pressure level at positive power was 68.5 dba, which was 1.5 dba less than the Donaldson M100580 muffler (Example III), and 21 dba less than the straight pipe (Example I). At braking, the overall sound pressure level was 71.8 dba, which was 9.2 dba less than the Donaldson M100580 muffler, as tested in Example III, and 30.7 dba less than the straight pipe, as tested in Example I.

For the specific octave bands, the following data were observed:

| Octave Band Hz | SPL (dba) Positive Power (Peak) | Braking (Peak) | Differ-ence | Comparison To Standard Muffler Braking | Comparison To Straight Pipe Braking, SVV |
|---|---|---|---|---|---|
| 63 | 55 | 56 | 1 | 2.5 | — |
| 125 | 61 | 63.5 | 2.5 | 0 | −13 |
| 250 | 59 | 57.5 | −1.5 | −6.5 | −28.5 |
| 500 | 63.5 | 63 | −0.5 | −11 | −36.5 |
| 1,000 | 59 | 64.5 | 5.5 | −7 | −33 |
| 2,000 | 58.5 | 59.5 | 1 | −15.5 | −37.5 |
| 4,000 | 57 | 67.5 | 10.5 | −7 | −22.5 |
| 8,000 | Below Scale | 60.5 | — | −10 | −22 |

| Octave Band Hz | SPL (dba) Positive Power Max (overall) | Braking Max (overall) | Comparison to Standard Muffler Braking | Comparison to Straight Pipe Braking |
|---|---|---|---|---|
| 63 | 64.5 | 66.5 | −0.5 | −11.5 |
| 125 | 64.0 | 64.5 | −1.0 | −16.0 |
| 250 | 59.0 | 60.5 | −6.0 | −26.0 |
| 500 | 64.0 | 62.5 | −12.5 | −37.0 |
| 1,000 | 59.0 | 64.5 | −7.0 | −33.0 |
| 2,000 | 58.0 | 61.0 | −14.0 | −36.0 |
| 4,000 | 57.0 | 68.0 | −7.0 | −22.5 |
| 8,000 | 50.5 | 60.5 | −10.5 | −22.0 |

EXAMPLE VI

A 1997 Detroit Diesel Series 60 engine rated at 500 hp at 2100 rpm was evaluated using a dual vertical muffler system, utilizing a muffler such as muffler 150, shown in FIG. 3. The overall sound pressure level at positive power was 65 dba, which was 3 dba less than the DVV Donaldson M100582 muffler (Example IV), and 26 dba less than the DVV straight pipe (Example II). At braking, the overall sound pressure level was 72 dba, which was 8.5 dba less than the Donaldson M100582 muffler, as tested in Example IV, and 31.0 dba less than the straight pipe, as tested in Example II.

At specific octave bands, the following data were collected:

| Octave Band Hz | SPL (dba) Positive Power (Peak) | Braking (Peak) | Differ-ence | Comparison To Standard Muffler Braking | Comparison To Straight Pipe Braking, DVV |
|---|---|---|---|---|---|
| 63 | 53 | 55 | 2 | 4.5 | — |
| 125 | 56.5 | 61 | 4.5 | 7.0 | −20.5 |
| 250 | 54.5 | 60.5 | 6 | 0.0 | −24.0 |
| 500 | 60.5 | 65 | 4.5 | −5.0 | −35.5 |
| 1,000 | 59 | 62 | 3 | −10.0 | −34.0 |
| 2,000 | 56 | 65.5 | 9.5 | −10.5 | −30.0 |
| 4,000 | 52 | 63.5 | 11.5 | −10.0 | −24.5 |
| 8,000 | Below Scale | 58 | — | −10. | −21.5 |

| Octave Band Hz | SPL (dba) Positive Power Max (overall) | Braking Max (overall) | Comparison to Standard Muffler Braking | Comparison to Straight Pipe Braking |
|---|---|---|---|---|
| 63 | 60.5 | 67.5 | 0.5 | −7.0 |
| 125 | 58.0 | 60.5 | 2.5 | −21.5 |
| 250 | 54.5 | 61.5 | 0.5 | −23.5 |
| 500 | 61.0 | 65.0 | −7.0 | −35.5 |
| 1,000 | 59.0 | 63.0 | −9.0 | −33.0 |
| 2,000 | 56.0 | 60.5 | −16.0 | −35.5 |
| 4,000 | 52.0 | 63.5 | −10.0 | −26.5 |
| 8,000 | Below Scale | 58.5 | −10.0 | −21.5 |

The loudness during braking was 91.8 phons. This was 5.4 phons less than the Donaldson M100582 muffler, measured on the same engine (Example IV) and 23.4 phons less than a straight pipe (Example II).

The roughness during braking was 0.79 aspers. This was 2.69 aspers less than the Donaldson M100582 muffler (Example IV), measured on the same engine in the same system and 14.4 aspers less than a straight pipe (Example II).

The sharpness during braking was 2.75 acums. This was 1.21 acums less than the Donaldson M100582 muffler (Example IV), measured on the same engine in the same system, and 3.90 acums less than a straight pipe (Example II).

K. The Embodiment of FIG. 12

Figure 12:
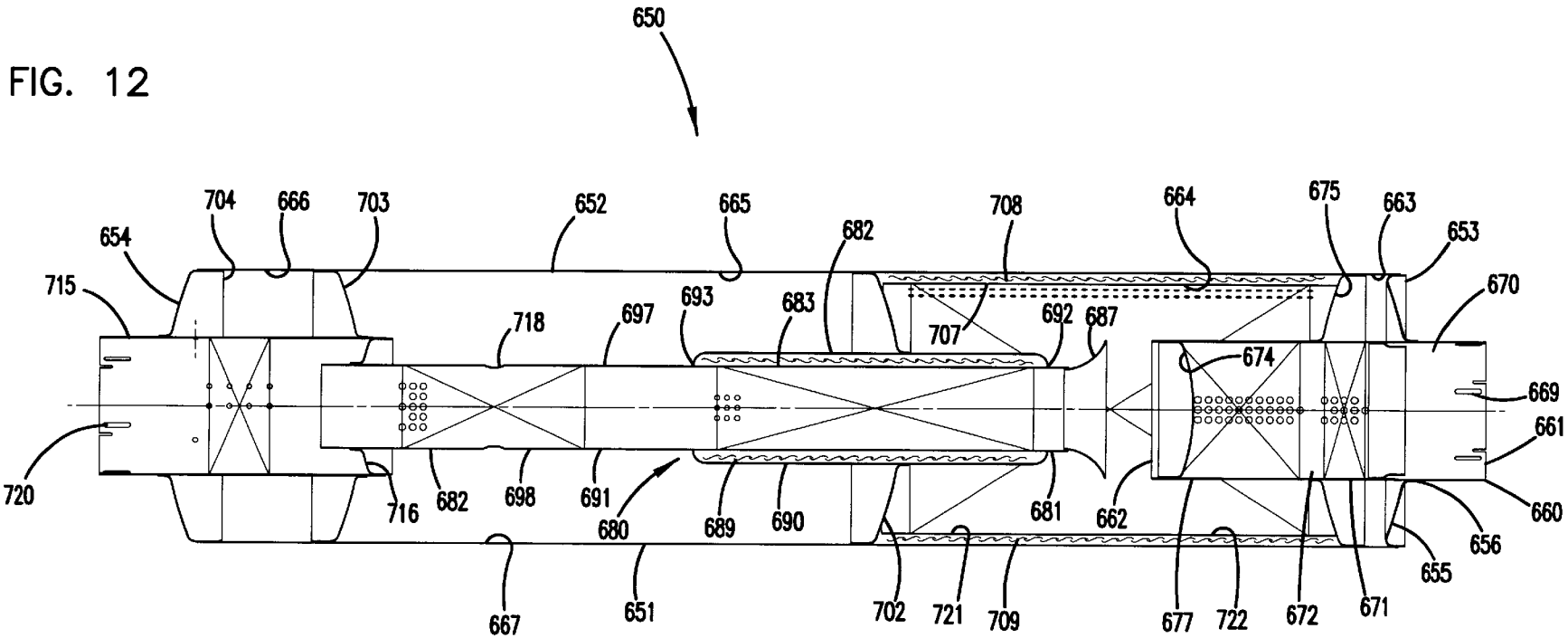
FIG. 12 is a schematic, cross-sectional view of a fifth embodiment of a muffler arrangement, according to principles of the present invention.

The arrangement of FIG. 12 is similar to the arrangement of FIG. 3, and is preferred for use with vehicles with dual muffler systems. The FIG. 12 embodiment differs from the FIG. 3 embodiment in that the FIG. 12 embodiment, in certain situations, has enhanced low frequency performance.

Referring now to FIG. 12, the improved muffler, indicated generally at reference 650, generally comprises an outer shell 651 defined by an outer wall 652 extending between a first end 653 and a second end 654. At end 653, the muffler 650 includes a baffle 655, preferably a solid baffle, having an interior aperture 656. The muffler 650 includes an inlet tube 660 (having an inlet end 661 and opposite end 662) positioned and secured within, and extending through, the aperture 656. The inlet tube 660 preferably defines slots 669, analogous to slots 169 in FIG. 3.

Within the shell 651 are preferably defined volumes 663, 664, 665, and 666. Volumes 665 and 666 may be viewed as sub-volumes within the volume or region 667. In the illustrated embodiment, region 667 is defined between a baffle 702 and a baffle 704.

Still referring to FIG. 12, the preferred inlet tube 660 is generally cylindrical and has a first, non-perforated section 670, to which the baffle 655 is secured. The inlet tube 660, inwardly from section 670, includes a perforated section 671, which preferably allows for expansion of gasses and sound into the volume 663. The inlet tube 660 further includes a solid section 672, inwardly from the perforated section 671. The solid section 672 provides a section for adjoining a baffle 675. The volume 663 preferably is defined between baffles 655 and 675 (and between the tube 660 and the outer wall 652). Thus, the volume 663 is circumferentially bounded by, and is circumscribed by, the outer wall 652. The volume 663 preferably operates as a Helmholtz resonator tuned to a peak attenuation frequency of about 1160 Hz, and operable for frequency bands at 1,000–1,300

Hz. Referring again to the inlet tube 660, the inlet tube 660 includes a perforated section 677 positioned inwardly in extension along the tube 660 from the solid section 672 (and the baffle 675).

The end 662 of the inlet tube 660 is closed by an end plug 679. Preferably, the plug 679 is solid, but can also be perforated. As with the embodiment of FIG. 3, preferably the end 662 has a circular cross-section, and the tube 660 is generally cylindrical (that is, not closed by a crimp). As used in the preferred construction herein, the inlet tube 660 operates as a full choke. The full choke is useful in broadband attenuation.

Generally, the muffler 650 includes an outflow tube construction 680. The tube construction 680 includes a section 681, provided with a bell section 687. It is noted that the preferred arrangement of FIG. 12 is also an "in-line" arrangement.

Preferably, the tube construction 680 further includes an extension section 697 that is generally cylindrical in configuration and preferably includes a perforated section 698. An anti-whistle bead 718 is preferably positioned midway of the perforated section 698. The location of the perforated section 698 relative to the bell 687 improves low frequency performance. The perforated section 698 is spaced from the bell 687 a distance of at least 20 percent, no greater than 80 percent, and in one example, about 40–60 percent of the total axial length of the outlet tube 680. The perforated section 698 is spaced from the baffle member 702 a distance of at least 25 percent, no greater than about 75 percent, and in one example about 40–60 percent of the axial length between the baffles 702 and 703.

The extension section 697 includes a perforated section 683. In the illustrated embodiment, section 683 is surrounded by a packing 689 (preferably, fibrous packing such as fiberglass as described above) contained against an outer wall 682 by a cylinder 690. The packing material 689, when compressed between cylinder 690 and section 683, in certain arrangements, will usually have a thickness of under 2 inches, and usually 1 inch or less. In some instances, the thickness of the packing 689 will be about 0.5 inch or less, while in other arrangements, the thickness of the packing 689 will be at least 0.25 inches. In some arrangements, the thickness of the packing 689 will be no greater than about 0.25 inches. The cylinder 690 extends generally around the section 683 in extension from a point 692 (which is adjacent to the bell section 687) to a point 693 (which is about ⅔ of the extension across the volume 665 from the end 654).

Extension section 697 includes a non-perforated section 691. The non-perforated section 691 is between and separates the perforated section 683 and the perforated section 698. The non-perforated section 691 has an axial length of at least 20 percent, no greater than about 75 percent, and generally about 30–40 percent of the axial length of the perforated section 683.

Preferably, the extension 697 extends and projects into the outlet tube 715. The outlet tube 715 is generally cylindrical and attached to the wall 682 at the baffle 716. The outlet tube 715 is generally a standard size, i.e., about a 5 in. diameter tube. Its diameter is greater than the diameter of extensions 697, 681, and 683 of the tube construction 680. Typically, the extensions 697, 681, and 683 have a diameter of about 3 in. This diameter of the tube construction 680 is smaller than the typical 5 in. diameter; as such, it allows for a greater expansion ratio, which results in a quieter, more muffled sound.

The outlet tube 715 preferably defines slots 720 outside of the muffler interior. The slots 720 help to connect the outlet tube 715 to other conduits, and are analogous to the slots 42 in FIG. 2.

The muffler 650 includes baffles 702 and 704, as described above, and further includes baffle 703.

The volume 664 is generally defined between baffles 675 and 702. Preferably, the volume 664 is a double-walled volume defined by an inner wall 707 and the outer wall 651 with an annular space 708 therebetween. Preferably, the annular space 708 is 0.25 in.–0.5 in. thick and is filled by packing 709, preferably fibrous packing such as fiberglass. The packing material 709, in some arrangements, will typically be under 1 inch thick, but can be anywhere under 2 inches thick. In some arrangements, the thickness of the packing 709 will typically be under 1 inch thick, and can be no greater than 0.5 inch thick. The annular space 708, when filled with the packing 709, functions as an absorptive attenuator and body shell damper, absorbing mid to high frequencies, such as the 500 Hz octave band and greater.

Between the perforated sections 677 and the inner wall 707 is a volume 722. That is, the volume 722 preferably is a sub-volume of volume 664 and boarded by, and contained within, the inner wall 707, the end of bell section 687, the baffle 675, perforated section 677, and solid section 672. The volume 722 acts as an expansion chamber that functions as a region of broadband attenuation.

Between the bell section 687 and the baffle 702 is a region 721. Region 721 is a sub-volume of volume 664. Region 721 attenuates frequencies on the order of 380–480 Hz, with peak attenuation at about 430 Hz.

The volume 665 is a sub-volume of volume 667. The volume 665 extends between baffle 72 and baffle 703. It is tuned to muffle frequencies in a broad range, from about 200 Hz and up, with peak attenuation at about 600 Hz.

Between the end baffle 704 and the inner baffle 703, the volume 666 is defined. The volume 666 is a sub-volume of volume 667 and attenuates frequencies on the order of 350–500 Hz, with peak attenuation at about 410 Hz.

L. The Embodiment of FIG. 13

Figure 13:
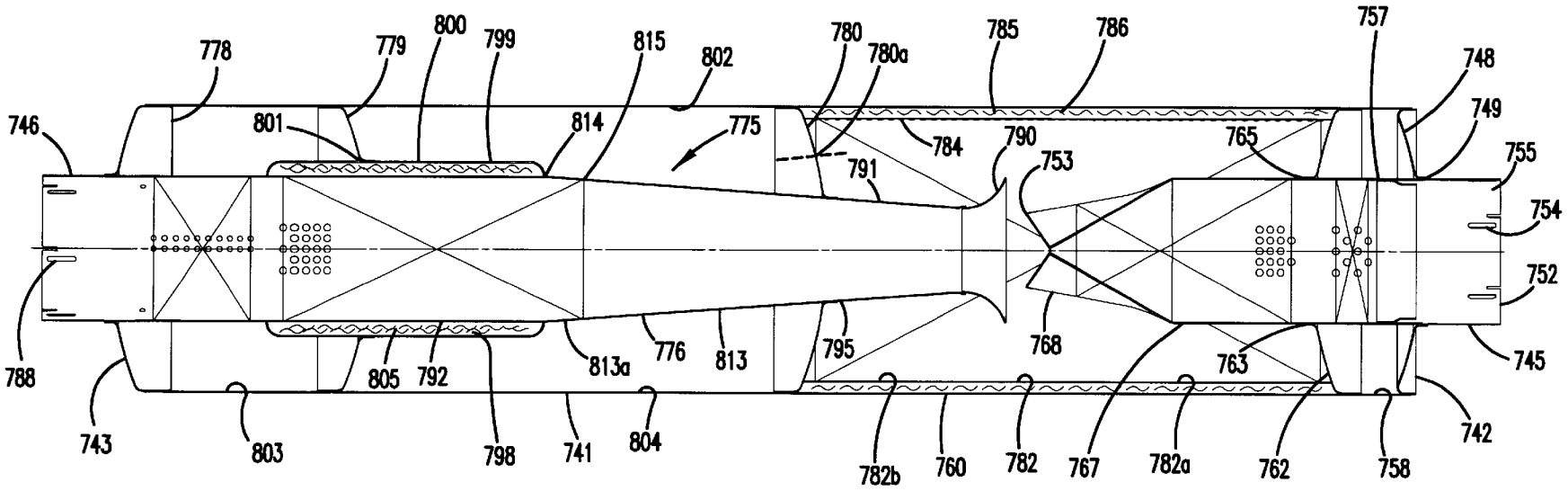
FIG. 13 is a schematic, cross-sectional view of a sixth embodiment of a muffler arrangement, according to principles of the present invention.

Attention is now directed to FIG. 13. The arrangement of FIG. 13 is analogous to the arrangement of FIG. 4. In certain applications, it has been found that the embodiment of FIG. 13 provides enhanced performance at low frequencies.

Referring to FIG. 13, a muffler 740 includes a outer shell 741 extending between a first end 742 and a second end 743. The muffler 740 includes an inlet tube 745 and an outlet tube construction 746. Again, a preferred in-line construction is used.

The muffler 740 includes an inlet baffle 748 at the first end 742. The inlet baffle 748 preferably is a solid baffle having a central aperture 749 therein. The inlet tube 745 is secured within the central aperture 749, for example, by welding.

The inlet tube 745 includes a first end 752 and second end 753. The inlet tube 745 preferably defines slots 754, analogous to slots 254 in FIG. 4. The inlet tube 745 includes a solid section 755 adjacent to the first end 752. The inlet baffle 748 is secured to the inlet 745 within the solid section 755.

Inwardly toward the second end 743 from the solid section 755, the inlet tube 745 preferably includes a perforated section 757. The perforated section 757 allows for expansion of sound and gasses into a volume 758. The volume 758 is defined between an outer wall 760 of the outer shell 741 and the inlet tube 745. It is contained on opposite ends or sides by the inlet baffle 748 and a central baffle 762. The inlet tube 745 is secured to a central aperture 763, for example, by welding at section 765. Preferably, the section 765 is a solid section. In general, the volume 758 operates as a Helmholtz resonator, and attenuates frequencies on the order of 650–825 Hz, with a peak attenuation of about 730 Hz.

In the example illustrated, between the section 765 and the second end 753, the inlet tube 745 is preferably perforated, having a perforated section 767. For the embodiment shown, the perforated section 767 is crimped or bent into a "star crimp" 768 of the type generally as described in U.S. Pat. No. 4,580,657, incorporated herein by reference. As used in the construction herein, the star crimp operates as a full choke, utilizing resistive attenuation techniques.

The muffler 740 includes an outlet tube construction 775. The outlet tube construction 775 includes an extension section 776. The extension section 776 preferably is secured centrally within the muffler 740 by an outer baffle 778, at the end 743 and central baffles 779 and 780. Preferably, the baffle 779 is a solid baffle. Preferably, the baffle 780 has a bleed hole 780*a* therethrough. The bleed hole 780*a* helps with enhanced low frequency performance. The bleed hole allows for the equalization of temperatures between the volumes on either side of the baffle 780.

Note that the outlet tube construction 775 includes a diverging duct section 813, between the bell 790 and point 814 (where the outer wall 799 begins). The diverging duct section is mostly solid, but includes a perforated section at region 813*a*. Region 813*a* is perforated between where outer wall 799 begins and point 815 that is about halfway between baffles 779 and 780.

A volume 782 is defined between baffle 762 and baffle 780. Within the volume 782, preferably the outer shell 741 has a double-wall construction comprising outer wall 760 and an inner wall 784, with an annular region 785 defined between the inner wall 784 and the outer wall 760. Preferably, the annular region 785 is filled with a packing 786, most preferably fibrous packing such as fiberglass. The packing material 786 in some arrangements, will typically have a thickness of 0.5 inch or less, but in some arrangements, may have a thickness of up to 1–2 inches. In many arrangements, the thickness of the packing 786 will range between 0.25–0.5 inch. The inner wall 784 preferably is a perforated section. The region 785 preferably functions as an absorptive attenuator and body shell damper, muffling mid-to-high frequencies, such as 500 Hz octave bands and higher.

The volume 782 preferably includes two subvolumes, volume 782*a* and 782*b*. The volume 782*a* is defined between the end of the bell 790 and the baffle 762. It operates as an expansion chamber with broad-band attenuation. Volume 782*b* is the volume in the space between the bell 790 and the baffle 780. The volume 782*b* is tuned to attenuate frequencies on the order of 450–600 Hz, with a peak attenuation of about 525 Hz.

The extension 776 preferably includes three portions; the bell 790, diverging section 791, and a cylindrical section 792. In preferred embodiments, the cylindrical section 792 is perforated. The perforated section of cylindrical section 792 is immediately adjacent to the perforated section 813*a*. The perforated section 813*a* allows for communication with a volume 804. Note that the perforated section 813*a* is spaced a greater distance from the bell 790 than the perforated section 292 is spaced from bell 290 in FIG. 4. This greater distance in FIG. 13 enhances the muffling performance at lower frequencies. The perforated section 813*a* is spaced from the bell 790 a distance of at least 20%, no greater than 50%, and in one example about 40–45% of the total axial length of the outlet tube 775. The perforated section 813*a* is spaced from the baffle 280 a distance at least 25%, no greater than 75%, and in one example about 40–60% of the axial length between the baffles 279, 280. The section 813, along with the perforated section 813*a*, acts as a resonator for low frequencies.

In general, the extension 776 is secured to the central baffle 780 at a solid region 795.

Attention is now directed to the cylindrical section 792 of the extension 776. In the example illustrated, surrounding a portion of the cylindrical section 792 is provided a packing annulus 798 defined by the outer wall 799 spaced from the cylindrical section 792 to define an annular volume 800 that preferably is filled with a fibrous packing 805. In many systems, the thickness of the packing 805, when oriented within the packing annulus 798 will be 1 inch or less, typically 0.5 inch or less. In some instances, the thickness of the packing 805 will be greater than 0.5 inch, and can be greater than 1.0 inch, usually less than 2 inches. Section 792, when annulus 798 contains packing 805, acts as an absorptive attenuator and muffles mid to high frequencies, such as the 500 Hz octave band and higher. In general, the outer wall 799 is secured to the central baffle 779 at aperture 801. In this manner, the extension 776 is secured in position by baffle 779.

The outlet tube construction 775 preferably defines slots 788 for aiding in the connection to other conduits in the exhaust system.

As a result of the construction described, the embodiment of FIG. 13 includes a volume 802 divided into sub-volumes 803 and 804. Preferably, the sub-volume 804, between baffles 779 and 780, is tuned to attenuate frequencies on the order of 250–500 Hz, with a peak at 330 Hz. Preferably, the sub-volume 803, between baffles 778 and 779 is tuned to attenuate frequencies on the order of 600–1200 Hz with peak attenuation of about 815 Hz.

M. The Embodiment of FIG. 14

Figure 14:
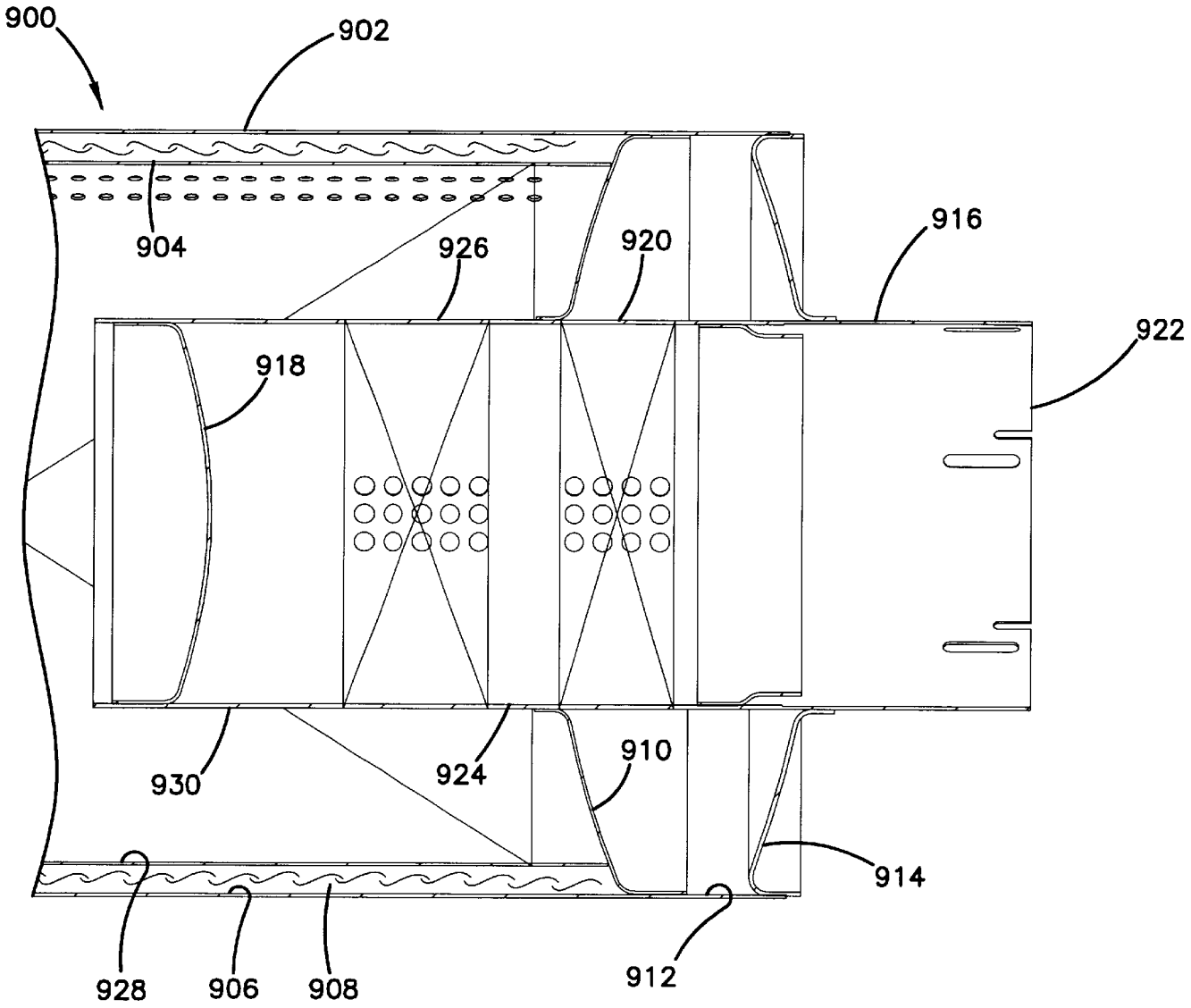
FIG. 14 is a schematic, fragmented, cross-sectional view of an alternate embodiment of an inlet end useable with various muffler arrangements described herein, according to principles of the present invention.

Attention is directed to FIG. 14. In FIG. 14, there is a fragmented, schematic, cross-sectional view of the inlet end of a muffler that can be used as the inlet end of various muffler constructions described herein.

Certain engines can vary on the noise they produce. Depending on the particular engine and the noise characteristics of that engine, certain fine tuning of the muffler constructions described herein can be made to account for the particular engine to be muffled. FIG. 14 represents an example of principles that may be employed to fine tune muffler constructions described herein.

In particular, it has been found that muffler constructions having inlet ends of the type shown in FIG. 14 with constructions such as that shown in FIG. 13 on DVV systems can improve the performance of the mufflers at low frequencies, such as the 125 Hz and 63 Hz octave bands.

In FIG. 14, reference number 900 depicts an alternate inlet end arrangement. An outer shell 902 circumscribes an inner, perforated wall 904. A packing annulus 906 is formed between the outer wall 902 and inner wall 904. The packing annulus 906 may contain fibrous packing material 908 having a thickness of typically, in most arrangements, 1 inch or less, typically about 0.5 inch, and in some arrangements about 0.25 inch. In certain arrangements, the thickness of the packing material 908 may be greater than 0.5 inch, and in some instances, the thickness of the packing material may be greater than 1 inch, but is usually less than 2 inches. A baffle is shown at 910, with a resonator chamber at 912. Note that the region of packing material 908 is separated from an end baffle 914 by the resonator chamber 912. An inlet tube 916 allows for the flow of gas into the internal chamber of the arrangement 900. Note that the inlet tube 916 is closed by an end plug 918, to operate as a full choke.

The inlet tube 916 includes a perforated section 920. The perforated section 920 allows for the gas to flow from the inlet tube 916 into the resonator chamber 912. In some instances, the perforated section 920 will have no more than 100 apertures each having a 0.25 inch diameter. One such system will use four rows of 21 apertures each, or about 84 apertures total. The pattern can be a staggered pattern, or the pattern can be a standard pattern.

In other systems, the perforated section 920 can be modified to have apertures of about 0.2 inch diameter, and between 100–200 apertures, typically about 160 apertures. In one arrangement, the apertures can be arranged in four rows of about 30–50 apertures each, typically about 40 apertures each. The pattern can be a standard pattern of 0.375 by 0.375 inches.

Moving inwardly from the end 922 of the inlet tube 916 is a solid or non-perforated section 924. Adjacent to and inwardly from the solid section 924 is a second perforated section 926. The second perforated section 926 allows for communication between the inlet tube 916 and the volume 928.

In some arrangements, the perforated section 926 has at least 150 holes, typically 200–300 holes, and in one example about 240–250 holes. Each of the holes has a diameter of about 0.25 inch, arranged in a standard pattern of 0.375 by 0.375 inch. In one typical arrangement, there is one row of 20 holes, five rows of 41 holes, and one row of 21 holes, for a total of 246 holes. In this arrangement, there is also a solid or non-perforated section 930 of the inlet tube between the end plug 918 and the perforated section 926.

In other arrangements, the second perforated section 926 extends to the end plug 918. In certain arrangements, there will be at least 250 holes, typically 300–400 holes, each having a diameter of about 0.2 inch. These holes may be arranged in a standard pattern of 0.375 by 0.375 inch. In some arrangements, these holes can be arranged in eight rows of 40 holes each, for a total of 320 holes.

In certain other arrangements, the second perforated section 926 will include a section of no more than 250 holes, typically 100–200 holes. These holes can have a diameter of about 0.25 inch, and be arranged in a standard pattern of about 0.375 by 0.375 inch. In some systems, perforated section 926 can have the holes arranged in a pattern of one row of about 20 holes, three rows of about 41 holes, and one row of about 21 holes, for a total of about 164 holes.

In other arrangements, the second perforated section 926 can have at least 400 holes, and usually no greater than 600 holes, typically 450–500 holes. In these types of systems, the diameter will be about 0.19 or 0.2 inch, and be arranged in a standard pattern of 0.375 by 0.375 inch. One convenient pattern is about twelve rows of about 40 holes each, for a total of about 480 holes. In systems such as these, it may be convenient to extend the perforated section through the inlet section 930 to extend to the end plug 918.

The first perforated section 920 can be adjusted in a variety of locations along with the length of the inlet tube 916. Measuring from the end 922 and extending inwardly, the first perforated section 920 can range from at least 3 inches, up to 6 inches. In some systems, the first perforated section will extend inwardly from the end 922 between 3.25–4.75 inches. In one example, the first perforated section 920 will be spaced about 3.5 inches from the end 922. In other systems, the first perforated section will extend inwardly from the end 922 about 4.7 inches.

The second perforated section 926 can also be adjusted along the length of the inlet tube 916, depending upon the desired result. In typical systems, the second perforated section will be spaced from the end 922 at least 6 inches, and typically between 7–9 inches. In one example system, the second perforated section 926 is spaced between about 7.25–7.75 inches. For example, 7.4 inches and 7.5 inches are convenient distances between the end 922 and the beginning of the second perforated section 926.

In one system, it was found that enhanced performance at low frequencies was achieved by using the inlet construction 900 of FIG. 14 together with remaining portions of the muffler construction depicted in FIG. 13 on a DVV system. In this arrangement, the muffler 740 shown in FIG. 13 includes the converging/diverging outlet tube, together with the inlet tube 916 having an end plug 918. Other adjustments and fine tuning of the muffler constructions, according to principles described herein, can be made to achieve other results.

N. Experimental

EXAMPLE VII

A 1998 Detroit Diesel Series 60 engine rated for operation at a power of 500 hp at 2100 rpm was tested, according to the procedure described above, without any muffler in an SVV system (a "straight pipe" measurement). The overall sound pressure level during positive power was 94.0 dba, and 101.5 dba during braking. For the specific octave bands, the results were as follows:

| | SPL (dBA) | | | |
|---|---|---|---|---|
| Octave Band Hz | Positive Power Max (Overall) | Positive Power Max (Peak) | Braking Max (Overall) | Braking Max (Peak) |
| 63 | 76.5 | 63.5 | 77.0 | below scale |
| 125 | 76.0 | 71.5 | 85.5 | 84.5 |
| 250 | 73.0 | 73.0 | 79.0 | 76.5 |
| 500 | 86.5 | 86.5 | 98.0 | 98.0 |
| 1000 | 91.5 | 91.0 | 98.0 | 97.5 |
| 2000 | 88.0 | 88.0 | 96.5 | 96.5 |
| 4000 | 84.0 | 84.0 | 90.5 | 89.5 |
| 8000 | 71.5 | 70.5 | 80.0 | 79.5 |

EXAMPLE VIII

The 1998 Detroit Diesel Series 60 engine rated for operation at a power of at least 500 hp at 2100 rpm was tested with a dual vertical system (DVV) without any muffler (a "straight pipe") measurement. The overall sound pressure level during positive power was 96.0 dba, and during braking was 101.5 dba. For the specific octave bands, the results were as follows:

| Octave Band Hz | SPL (dba) Positive Power Max (Overall) | Positive Power Max (Peak) | Braking Max (Overall) | Braking Max (Peak) |
|---|---|---|---|---|
| 63 | 64.0 | 61.0 | 74.5 | below scale |
| 125 | 73.5 | 70.0 | 80.5 | 77.5 |
| 250 | 74.0 | 74.0 | 85.0 | 84.0 |
| 500 | 90.0 | 90.0 | 99.0 | 99.0 |
| 1000 | 92.0 | 92.0 | 97.0 | 97.0 |
| 2000 | 89.0 | 88.0 | 94.5 | 94.0 |
| 4000 | 83.5 | 82.5 | 88.5 | 88.0 |
| 8000 | 69.0 | 67.5 | 79.0 | 79.0 |

EXAMPLE IX

A 1998 Detroit Diesel Series 60 engine rated for operation at a power of at least 500 hp at 2100 rpm and having a compression brake-type engine retarder was tested with a single Donaldson M100580 muffler. The overall sound pressure level during positive power was 72.5 dba, and during braking was 80.0 dba. For the specific octave bands, the results were as follows:

| Octave Band Hz | SPL (dba) Positive Power Max (Overall) | Positive Power Max (Peak) | Braking Max (Overall) | Braking Max (Peak) |
|---|---|---|---|---|
| 63 | 60.5 | 51.5 | 64.0 | below scale |
| 125 | 60.5 | 60.0 | 63.5 | 63.0 |
| 250 | 58.5 | 57.5 | 64.5 | 64.5 |
| 500 | 61.5 | 60.0 | 72.5 | 71.5 |
| 1000 | 63.0 | 63.0 | 70.0 | 70.0 |
| 2000 | 64.5 | 64.5 | 73.5 | 73.0 |
| 4000 | 70.0 | 70.0 | 74.0 | 74.0 |
| 8000 | 59.0 | 59.0 | 67.5 | 67.0 |

EXAMPLE X

A 1998 Detroit Diesel Series 60 engine rated for operation at a power of at least 500 hp at 2100 rpm and having a compression brake-type engine retarder was tested with two Donaldson M100582 mufflers in a DVV. The overall sound pressure level was 73.0 dba during positive power, and 81.0 dba during braking. For the specific octave bands, the results were as follows:

| Octave Band Hz | SPL (dba) Positive Power Max (Overall) | Positive Power Max (Peak) | Braking Max (Overall) | Braking Max (Peak) |
|---|---|---|---|---|
| 63 | 57.0 | below scale | 65.5 | below scale |
| 125 | 54.5 | 51.0 | 57.5 | 53.0 |
| 250 | 52.5 | 51.0 | 58.5 | 58.0 |
| 500 | 58.0 | 57.0 | 74.5 | 74.5 |
| 1000 | 67.5 | 67.5 | 73.5 | 73.0 |
| 2000 | 70.0 | 70.0 | 77.5 | 77.0 |
| 4000 | 63.5 | 63.5 | 72.0 | 72.0 |
| 8000 | 55.0 | 55.0 | 64.0 | 62.5 |

EXAMPLE XI

A 1998 Detroit Diesel Series 60 truck engine rated at 500 hp at 2100 rpm was tested with the muffler arrangement of FIG. 3. The overall sound pressure level at positive power was 68.5 dba, which was 4.0 dba less than the Donaldson M100580 muffler (Example IX) and 25.5 dba less than the straight pipe (Example VII). At braking, the overall sound pressure level was 73.0 dba, which as 7.0 dba less than the Donaldson M100580 muffler and 28.5 dba less than the straight pipe. For the specific octave bands, the results were as follows:

| Octave Band Hz | SPL (dba) Positive Power Max (Overall) | Positive Power Max (Peak) | Braking Max (Overall) | Braking Max (Peak) |
|---|---|---|---|---|
| 63 | 64.0 | 64.0 | 65.5 | below scale |
| 125 | 61.0 | 61.0 | 64.5 | 64.0 |
| 250 | 56.5 | 55.5 | 65.5 | 65.5 |
| 500 | 58.0 | 53.5 | 64.0 | 64.0 |
| 1000 | 60.5 | 57.0 | 67.0 | 66.5 |
| 2000 | 67.0 | 53.5 | 64.5 | 64.0 |
| 4000 | 67.0 | below scale | 60.0 | 60.0 |
| 8000 | below scale | below scale | 56.0 | 56.0 |

These data are compared to the standard Donaldson M100580 muffler (Example IX) below. The data below represents the sound pressure level difference between the FIG. 13 embodiment muffler and the Donaldson M100580 muffler:

| Octave Band Hz | SPL (dba) Positive Power Max (Overall) | Positive Power Max (Peak) | Braking Max (Overall) | Braking Max (Peak) |
|---|---|---|---|---|
| 63 | 3.5 | 12.5 | 1.5 | — |
| 125 | 0.5 | 1.0 | 1.0 | 1.0 |
| 250 | −2.0 | −2.0 | 1.0 | 1.0 |
| 500 | −3.5 | −6.5 | −8.5 | −7.5 |
| 1000 | −2.5 | −6.0 | −3.0 | −3.5 |
| 2000 | 2.5 | −11.0 | −9.0 | −9.0 |
| 4000 | −3.0 | — | −14.0 | −14.0 |
| 8000 | — | — | −11.5 | −11.0 |

As compared to straight pipe (Example VII), the FIG. embodiment performed as follows:

| Octave Band Hz | SPL (dba) Positive Power Max (Overall) | Positive Power Max (Peak) | Braking Max (Overall) | Braking Max (Peak) |
|---|---|---|---|---|
| 63 | −12.5 | 0.5 | −11.5 | — |
| 125 | −15 | −10.5 | −21.0 | −20.5 |
| 250 | −16.5 | −17.5 | −13.5 | −11.0 |
| 500 | −28.5 | −33.0 | −34.0 | −34.0 |
| 1000 | −31.0 | −34.0 | −31.0 | −31.0 |
| 2000 | −21.0 | −34.5 | −32.0 | −32.5 |
| 4000 | −17 | — | −30.5 | −29.5 |
| 8000 | – | – | −24.0 | −23.5 |

EXAMPLE XII

A 1998 Detroit Diesel Series 60 engine rated at 500 hp at 2100 rpm was tested with the muffler arrangement of FIG. 12. The overall sound pressure level at positive power was 71.0 dba, which was 2.0 dba less than the Donaldson M100582 muffler (Example X) and 25 dba less than the straight pipe (EXAMPLE VIII). At braking, the overall sound pressure level was 70 dba, which was 11.0 dba less than the Donaldson M100582 muffler and 31.5 dba less than the straight pipe. For the specific octave bands, the results were as follows:

| | SPL (dba) | | | |
|---|---|---|---|---|
| Octave Band Hz | Positive Power Max (Overall) | Positive Power Max (Peak) | Braking Max (Overall) | Braking Max (Peak) |
| 63 | 54.5 | 54.5 | 67.5 | 67.5 |
| 125 | 58.5 | 56.5 | 64.5 | 57.5 |
| 250 | 54.5 | 54.5 | 60.5 | 55.5 |
| 500 | 67.0 | 67.0 | 60.0 | 55.5 |
| 1000 | 63.5 | 63.0 | 63.0 | 58.0 |
| 2000 | 59.5 | 59.0 | 61.0 | 57.0 |
| 4000 | 59.5 | 58.5 | 62.0 | 53.5 |
| 8000 | 63.5 | 63.0 | 54.5 | below scale |

These data are compared to the standard Donaldson M100582 muffler (Example X) below:

| | SPL (dba) | | | |
|---|---|---|---|---|
| Octave Band Hz | Positive Power Max (Overall) | Positive Power Max (Peak) | Braking Max (Overall) | Braking Max (Peak) |
| 63 | −2.5 | — | 2.0 | — |
| 125 | 4.0 | 5.5 | 7.0 | 4.5 |
| 250 | 2.0 | 3.5 | 2.0 | −2.5 |
| 500 | 9.0 | 10.0 | −14.5 | −19.0 |
| 1000 | −4.0 | −4.5 | −10.5 | −15.0 |
| 2000 | −10.5 | −11.0 | −16.5 | −20.0 |
| 4000 | −4.0 | −5.0 | −10.0 | −18.5 |
| 8000 | 8.5 | 8.0 | −9.5 | — |

As compared to the straight pipe (Example VIII), the FIG. 12 embodiment performed as follows:

| | SPL (dba) | | | |
|---|---|---|---|---|
| Octave Band Hz | Positive Power Max (Overall) | Positive Power Max (Peak) | Braking Max (Overall) | Braking Max (Peak) |
| 63 | −9.5 | −6.5 | −7.0 | — |
| 125 | −15.0 | −13.5 | −16.0 | −20.0 |
| 250 | −19.5 | −19.5 | −24.5 | −28.5 |
| 500 | −23.0 | −23.0 | −39.0 | −43.5 |
| 1000 | −28.5 | −29.0 | −34.0 | −39.0 |
| 2000 | −29.5 | −29.0 | −33.5 | −37.0 |
| 4000 | −24.0 | −24.0 | −26.5 | −34.5 |
| 8000 | −5.5 | −4.5 | −24.5 | — |

O. Observations about the FIGS. 12 and 13 Embodiments

In general, the embodiments described in FIG. 12 and FIG. 13 provided enhanced performance at low frequencies, i.e., generally, the 125 octave band and 63 octave band.

It is noted that under positive power, at the 125 Hz octave band, a muffler constructed according to the FIG. 13 embodiment was at 61.0 dba (overall). This is versus the 64.0 dba (overall) for a muffler constructed according to the FIG. 4 embodiment. Thus, the muffler made according to the FIG. 13 embodiment was at least 1 dba and up to 3 dba lower than the muffler according to FIG. 4 embodiment.

At the 125 Hz octave band at braking, a muffler according to the FIG. 13 embodiment was at 64.5 dba (overall), versus the 69.0 dba for a muffler according to the FIG. 4 embodiment. At 63 Hz, for braking, a muffler according to the FIG. 13 embodiment measured 65.5 dba. In the FIG. 4 embodiment at 63 Hz for braking (overall), the sound pressure level was 68.5 dba. Thus, at low frequencies, during braking, a muffler according to the FIG. 13 embodiment is at least 2 dba lower, and at the 125 Hz octave band, up to 4.5 dba lower.

For the straight pipe measurements during braking, it is noted that a muffler constructed according to the FIG. 13 embodiment at 63 Hz was 11.5 dba lower than the dba level of the engine with no muffling system. This is compared to a muffler according to the FIG. 4 embodiment. A muffler according to the FIG. 4 embodiment during braking at 63 Hz was 9.5 dba lower than the straight pipe measurement. Again, during braking, at 125 Hz, a muffler according to the FIG. 13 embodiment was 21.0 dba lower than the straight pipe measurement. Compare this with the muffler according to the FIG. 4 embodiment, which was 11.5 dba lower than the straight pipe measurement.

For a dual vertical system, a muffler constructed according to the FIG. 12 embodiment measured at the 63 Hz octave band under positive power had a sound pressure level of 54.5. This is compared to the muffler according to the FIG. 3 embodiment that measured 60.5 dba under positive power at the 63 Hz octave band.

P. Applicable EPA Noise Abatement Regulations

Certain mufflers constructed according to the principles discussed herein are generally helpful in overall noise abatement. It has been found that, for example, mufflers constructed as described above in connection with FIGS. 2–14, when used with commercial trucks, such as those described above, help the trucks to comply with EPA Noise Abatement Regulations (40 C.F.R.), in particular, Subchapter G, Part 202 and Part 205, copyright 1993–1997. These EPA Noise Abatement Regulations are incorporated fully by reference herein.

In general, 40 CFR §202.20(b) provides the standards for highway operations for motor carriers engaged in interstate commerce. Specifically, the regulation states, "No motor carrier subject to these regulations shall operate any motor vehicle of a type to which this regulation is applicable which at any time or under any condition of highway grade, load, acceleration or deceleration generates a sound level in excess of 83 dB(A) measured on an open site with fast meter response at 50 feet from the centerline of lane of travel on highways with speed limits of 35 MPH or less; or 87 dB(A) measured on an open site with fast meter response at 50 feet from the centerline of lane of travel on highways with speed limits of more than 35 MPH."

Diesel trucks (including those operably equipped with engine compression brakes) have been found to comply with the regulations by not generating a sound level in excess of 83 dB(A), when equipped with certain mufflers constructed according to the principles described herein.

In general, 40 CFR §202.21(b) provides the standards for operation under stationary tests for motor carriers engaged in interstate commerce. Specifically, the regulation states, "No motor carrier subject to these regulations shall operate any motor vehicle of a type to which this regulation is applicable which generates a sound level in excess of 85 dB(A) measured on an open site with fast meter response at 50 feet from the longitudinal centerline of the vehicle when its engine is accelerated from idle with wide open throttle to governed speed with the vehicle stationary, transmission in neutral, and clutch engaged. This section shall not apply to any vehicle which is not equipped with an engine speed governor."

The regulations provide the test procedures at 40 CFR § 205.54-1, entitled "Low speed sound emission test procedures." The instrumentation is provided in section (a) as follows:

(1) A sound level meter which meets the Type 1 requirements of ANSI S1.4-1971, Specification for Sound Level Meters, or a sound level meter may be used with a magnetic tape recorder and/or a graphic level recorder or indicating meter, providing the system meets the requirements of § 205.54-2.

(2) A sound level calibrator. The calibrator shall produce a sound pressure level, at the microphone diaphragm, that is known to within an accuracy of ±0.5 dB. The calibrator shall be checked annually to verify that its output has not changed.

(3) An engine-speed tachometer which is accurate within ±2 percent of meter reading.

(4) An anemometer or other device for measurement of ambient wind speed accurate within ±10 percent.

(5) A thermometer for measurement of ambient temperature accurate within ±1 C.

(6) A barometer for measurement of ambient pressure accurate within ±1 percent.

The test site is provided in 40 CFR § 205.54-1(b) as follows:

(b)(1) The test site shall be such that the truck radiates sound into a free field over a reflecting plane. This condition may be considered fulfilled if the test site consists of an open space free of large reflecting surfaces, such as parked vehicles, signboards, buildings or hillsides, located within 100 feet (30.4 meters) of either the vehicle path or the microphone.

(2) The microphone shall be located 50 feet±4 in. (15.2±0.1 meter) from the centerline of truck travel and 4 feet±4 in. 1.2±0.1 meters) above the ground plane. The microphone point is defined as the point of intersection of the vehicle path and the normal to the vehicle path drawn from the microphone. The microphone shall be oriented in a fixed position to minimize the deviation from the flattest system response over the frequency range 100 Hz to 10 kHz for a vehicle traversing from the acceleration point through the end zone.

The microphone shall be oriented with respect to the source so that the sound strikes the diaphragm at the angle for which the microphone was calibrated to have the flattest frequency response characteristic over the frequency range 100 Hz to 10 kHz.

(3) An acceleration point shall be established on the vehicle path 50 feet (15 m) before the microphone point.

(4) An end point shall be established on the vehicle path 100 feet (30 m) from the acceleration point and 50 feet (15 m) from the microphone point.

(5) The end zone is the last 40 feet (12 m) of vehicle path prior to the end point.

(6) the measurement area shall be the triangular paved (concrete or sealed asphalt) area formed by the acceleration point, the end point, and the microphone location.

(7) The reference point on the vehicle, to indicate when the vehicle is at any of the points on the vehicle path, shall be the front of the vehicle except as follows:

(i) If the horizontal distance from the front of the vehicle to the exhaust outlet is more that 200 inches (5.1 meters), tests shall be run using both the front and rear of the vehicle as reference points.

(ii) If the engine is located rearward to the center of the chassis, the rear of the vehicle shall be used as a reference point.

(8) the plane containing the vehicle path and the microphone location shall be flat within ±2 inches (0.05 meters).

(9) Measurements shall not be made when the road surface is wet, covered with snow, or during precipitation.

(10) Bystanders have an appreciable influence on sound level meter readings when they are in the vicinity of the vehicle or microphone; therefore not more than one person, other than the observer reading the meter, shall be within 50 feet (15.2 meters) of the vehicle path or instrument and the person shall be directly behind the observer reading the meter, on a line through the microphone and observer. To minimize the effect of the observer and the container of the sound level meter electronics on the measurements, cable should be used between the microphone and the sound level meter. No observer shall be located within 1 m in any direction of the microphone location.

(11) The maximum A-weighted fast response sound level observed at the test site immediately before and after the test shall be at least 10 dB below the regulated level.

(12) The road surface within the test site upon which the vehicle travels, and, at a minimum, the measurements area shall be smooth concrete or smooth sealed asphalt, free of extraneous material such as gravel.

(13) Vehicles with diesel engines shall be tested using Number 1D or Number 2D diesel fuel possessing acetane rating from 42 to 50 inclusive.

(14) Vehicles with gasoline engines shall use the grade of gasoline recommended by the manufacturer for use by the purchaser.

(15) Vehicles equipped with thermo-statically controlled radiator fans may be tested with the fan not operating.

The procedure is provided in 40 CFR § 205.54-1(c) as follows:

(1) Vehicle operation for vehicles with standard transmissions. Full throttle acceleration and closed throttle deceleration tests are to be used. A beginning engine speed and a proper gear ratio must be determined for use during measurements. Closed throttle deceleration tests are required only for those vehicles equipped with an engine brake.

(i) Select the highest rear axle and/or transmission gear ("highest gear" is used in the usual sense; it is synonymous to the lowest numerical ratio) and an initial vehicle speed such that at wide-open throttle the vehicle will accelerate from the acceleration point.

(a) Starting at no more than two-thirds (66 percent) of maximum rated or of governed engine speed.

(b) Reaching maximum rated or governed engine speed within the end zone.

(c) Without exceeding 35 mph (56 k/h) before reaching the end point.

(1) Should maximum rated or governed rpm be attained before reaching the end zone, decrease the approach rpm in 100 rpm increments until maximum rated or governed rpm is attained within the end zone.

(2) Should maximum rated or governed rpm not be attained until beyond the end zone, select the next lower gear until maximum rated or governed rpm is attained within the end zone.

(3) Should the lowest gear still result in reaching maximum rated or governed rpm beyond the permissible end zone, unload the vehicle and/or increase the approach rpm in 100 rpm increments until the a maximum rated or governed rpm is reached within the end zone.

(ii) For the acceleration test, approach the acceleration point using the engine speed and gear ratio selected in paragraph (c)(1) of this section and at the acceleration point rapidly establish wide-open throttle. The vehicle reference shall be as indicated in paragraph (b)(7) of this section. Acceleration shall continue until maximum rated or governed engine speed is reached.

(iii) Wheel slip which affects maximum sound level must be avoided.

(2) Vehicle operation for vehicles with automatic transmissions. Full throttle acceleration and closed throttle deceleration tests are to be used. Closed throttle deceleration tests are required only for those vehicles equipped with an engine brake.

(i) Select the highest gear axle and/or transmission gear (highest gear is used in the usual sense; it is synonymous to the lowest numerical ratio) in which no up or down shifting will occur under any operational conditions of the vehicle during the test run. Also, select an initial vehicle speed such that at wide-open throttle the vehicle will accelerate from the acceleration point.

(a) Starting at two-thirds (66 percent) of maximum rated or of governed engine speed.

(b) Reaching maximum rated or governed engine speed within the end zone.

(c) Without exceeding 35 mph (56 k/h) before reaching the end point.

(1) Should maximum rated or governed rpm be attained before reaching the end zone, decrease the approach rpm in 100 rpm increments until maximum rated or governed rpm is attained within the end zone.

(2) Should the maximum rated or governed rpm not be attained until beyond the end zone, select the next lower gear until maximum rated or governed rpm is attained within the end zone.

(3) Should the lowest gear still result in reaching maximum rated or governed rpm beyond the permissible end zone, unload the vehicle and/or increase the approach rpm in 100 rpm increments until the maximum rated or governed rpm is reached within the end zone, notwithstanding that approach engine speed may now exceed two-thirds maximum rated or of full load governed engine speed.

(4) Should the maximum rated or governed rpm still be attained before entering the end zone, and the engine rpm during approach cannot be further lowered, begin acceleration at a point 10 feet closer to the beginning of the end zone. The approach rpm is to be used is to be that rpm used prior to the moving of the acceleration point 10 feet closure to the beginning of the end zone.

(5) Should the maximum rated or governed rpm still be attained before entering the end zone, repeat the instructions in c)(4)paragraph (c)(2)(i) (c)(4) of the section until maximum rated or governed rpm is attained within the end zone.

(ii) For the acceleration test, approach the acceleration point using the engine speed and gear ratio selected in paragraph (c)(2)(i) of this section and at the acceleration point rapidly establish wide-open throttle. The vehicle reference shall be as indicated in paragraph (b)(7) of this section. Acceleration shall continue until maximum rated or governed engine speed is reached.

(iii) Wheel slip which affects maximum sound level must be avoided.

(3) Measurements.

(i) The meter shall be set for "fast response" and the A-weighted network.

(ii) The meter shall be observed during the period while the vehicle is accelerating or decelerating. The applicable reading shall be the highest sound level obtained for the run. The observer is cautioned to rerun the test if unrelated peaks should occur due to extraneous ambient noises. Readings shall be taken on both sides of the vehicle.

(iii) The sound level associated with a side shall be the average of the first two pass-by measurements for that side, if they are within 2 dB(A) of each other. Average of measurements on each side shall be computed separately. If the first two measurements for a given side differ by more that 2 dB(A), two additional measurements shall be made on each side, and the average of the two highest measurements on each side, within 2 dB(A) of each other, shall be taken as the measured vehicle sound level for that side. The reported vehicle sound level shall be the higher of the two averages.

General requirements are provided in 40 CFR § 205.54-1(C) as follows:

(1) Measurements shall be made only when wind velocity is below 12 mph (10 km/hr).

(2) Proper usage of all test instrumentation is essential to obtain valid measurements. Operating manuals or other literature furnished by the instrument manufacturer shall be referenced to for both recommended operation of the instrument and precautions to be observed. Specific items to be adequately considered are:

(i) The effects of ambient weather conditions on the performance of the instruments (for example, temperature, humidity, and barometric pressure).

(ii) Proper signal level, terminating impedances, and cable lengths on multi-instrument measurement systems.

(iii) Proper acoustical calibration procedure to include the influence of extension cables, etc. Field calibration shall be made immediately before and after each test sequence. Internal calibration means is acceptable for field use, provided that external calibration is accomplished immediately before or after field use.

(3) (i) A complete calibration of the instrumentation and external acoustical calibrator over the entire frequency range of interest shall be performed at least annually as frequently as necessary during the yearly period to insure compliance with the standards cited in American National Standard S1.4-1971 "Specifications for Sound Level Meters" for a Type 1 instrument over the frequency range 50 Hz–10,000 Hz.

(ii) If calibration devices are utilized which are not independent of ambient pressure (e.g., a pistonphone) corrections must be made for barometric or altimetric changes according to the recommendation of the instrument manufacturer.

(4) The truck shall be brought to a temperature within its normal operating temperature range prior to commencement of testing. During testing appropriate caution shall be taken to maintain the engine temperatures within such normal operating range.

The above discussion represents a complete description of principles of the present invention. Many embodiments may be constructed according to the principles described herein.

What is claimed is:

1. A method for muffling noise from a system including a truck during operation of a compression-type engine retarder using no more than one muffler; the truck having an engine rated for operation at a rated rpm at a selected rpm value of 1800 or above, for a power of at least 500 hp; the muffler having an outer shell with an outside dimension of no greater than 11 inches and an overall length of no greater than 60 inches; the method comprising a step of:

(a) muffling engine noise, during operation of the compression-type engine retarder, at an octave band of 1,000 Hz, to no greater than 68 dBA.

2. A method according to claim 1 wherein:

(a) said step of muffling noises during operation of the compression-type engine retarder, is conducted such that the noise is muffled to less than 72.5 dBA at an octave band of 500 Hz.

3. A method according to claim 1 wherein:

(a) said step of muffling engine noise includes muffling engine noise in a vertical muffler system using a muffler having a cylindrical outer shell.

4. A method according to claim 1 further including:

(a) muffling engine noise, during positive power operation of the engine, at an octave band of 500 Hz, to less than 61.5 dBA.

5. A method according to claim 1 wherein:

(a) said step of muffling engine noise during operation of the engine compression brake includes muffling engine noise, at an octave band of 2,000 Hz, to no greater than 65.5 dBA.

6. In a muffler arrangement comprising an outer wall defining an internal volume and having first and second, opposite ends; the second end being in-line relative to the first end; an inlet tube oriented partially within said internal volume and adjacent to said first end; an outlet tube oriented partially within said internal volume and adjacent to said second end; a first, inner, perforated wall spaced from said outer wall and defining a first, annular, volume therebetween; the muffler arrangement comprising:

(a) a first region of packing material positioned within said annular volume; and (b) a second region of packing material positioned against, and around a section of, said outlet tube; said second region of packing material being positioned spaced from said outer wall.

7. A muffler arrangement according to claim 6 wherein:

(a) said first inner perforated wall circumscribes at least a portion of said inlet tube.

8. A muffler arrangement according to claim 6 wherein:

(a) said first inner perforated wall extends a distance of at least 25% of the axial length of the outer wall.

9. In a system comprising an engine rated for operation, at a rated rpm value of 1800 or above, for a power of at least 500 hp; an exhaust muffler system including no more than one muffler; each muffler of said muffler system having an outer shell with an outside dimension of no greater than 11 inches; each muffler outer shell having an overall length of no greater than 60 inches; the system including:

(a) said exhaust muffler system being constructed and arranged to muffle exhaust noise, during positive power operation of said engine to the following:

(i) at an octave band of 250 Hz, less than 58.5 dBA;

(ii) at an octave band of 500 Hz, less than 61.5 dBA; and (iii) at an octave band of 1000 Hz, less than 63.0 dBA.

10. A system according to claim 9 wherein:

(a) said system comprises a truck including a compression brake-type retarder; and (b) said exhaust muffler system is constructed and arranged to muffle exhaust noise, during operation of said compression brake-type retarder, to the following:

(i) at an octave band of 1,000 Hz, no greater than 68 dBA.

* * * * *